US011266254B2

(12) United States Patent
Marton et al.

(10) Patent No.: US 11,266,254 B2
(45) **Date of Patent: *Mar. 8, 2022**

(54) CRIB LINER

(71) Applicant: BreathableBaby, LLC, St. Louis Park, MN (US)

(72) Inventors: Steven Marton, New York, NY (US); Jennifer A. Loesch, Edina, MN (US); Darrell L. Vincent, Bristol, RI (US)

(73) Assignee: BreathableBaby, LLC, St. Louis Park, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/935,125

(22) Filed: Jul. 21, 2020

(65) Prior Publication Data

US 2020/0345156 A1 Nov. 5, 2020

Related U.S. Application Data

(63) Continuation-in-part of application No. 16/699,675, filed on Dec. 1, 2019, now abandoned, which is a (Continued)

(51) Int. Cl.
*A47D 15/00* (2006.01)
*A47D 13/06* (2006.01)

(52) U.S. Cl.
CPC ..... *A47D 15/008* (2013.01); *A47D 15/00* (2013.01); *A47D 13/06* (2013.01); *A47D 13/063* (2013.01)

(58) Field of Classification Search
CPC .... A47D 13/063; A47D 13/061; A47D 13/06; A47D 9/00; A47D 9/005; A47D 15/00; A47D 15/008; A47D 7/00; A47D 7/002
(Continued)

(56) References Cited

U.S. PATENT DOCUMENTS 1,056,712 A 3/1913 Schweda
2,128,978 A 9/1938 Akin
(Continued)

FOREIGN PATENT DOCUMENTS

DE 102006024855 A1 12/2007
ER 2867045 A1 9/2005
WO 9956588 A2 11/1999

OTHER PUBLICATIONS

"Safe-N-Secure Crib Liner" datasheet [online]. Tender Creations, Inc., Southampton, MN, [retrieved on Feb. 4, 2000], Retrieved from the Internet: <URL:http://www.tendercreations.com/cribliner.htm>; 8 pgs.

(Continued)

*Primary Examiner* — Robert G Santos
(74) *Attorney, Agent, or Firm* — Winthrop & Weinstine, P.A.; Alicia Griffin Mills; Nadeem W. Schwen

(57) ABSTRACT

The present disclosure relates to a crib liner suitable for use with a crib, wherein the crib has a perimeter, and wherein a plurality of spaced vertical support elements are provided along the perimeter. In one embodiment, the crib liner may include a first panel configured to cover a portion of the spaced vertical support elements. The first panel may have first and second ends, a breathable body portion, a bottom border, and a top border. In some embodiments, the first panel may further comprise side borders. Fastening mechanisms may be provided at either or both ends for attaching the first panel to the crib. The breathable body portion may have an air permeability of between 385 CFM and 1530 CFM, a light permeability of between 47 and 99%, and a CO2 rebreathing value of less than 20%.

17 Claims, 70 Drawing Sheets

Related U.S. Application Data continuation of application No. 15/729,514, filed on Oct. 10, 2017, now Pat. No. 10,492,624.

(60) Provisional application No. 62/559,117, filed on Sep. 15, 2017.

(58) Field of Classification Search
USPC ..... 5/424, 425, 427, 93.1, 99.1, 100, 663, 5/946
See application file for complete search history.

(56) References Cited

U.S. PATENT DOCUMENTS 2,566,790 A 9/1951 Bloomfield
2,727,242 A 2/1954 Pascal
2,784,420 A 3/1957 Moltane
2,808,596 A 10/1957 Schreiner
2,927,331 A 3/1960 Ruiz
3,103,669 A 9/1963 Mundis
3,183,527 A 5/1965 Turner
3,199,123 A 8/1965 Komiske
3,241,158 A 3/1966 Berl
3,325,832 A 6/1967 Malicki
3,438,069 A 4/1969 Long
3,619,824 A 11/1971 Doyle
3,877,090 A 4/1975 Schutz
3,882,871 A 5/1975 Taniguchi
4,232,415 A 11/1980 Webber
4,280,342 A 7/1981 Eng et al.
4,370,765 A 2/1983 Webber
4,518,649 A 5/1985 Wang et al.
4,526,830 A 7/1985 Ferziger et al.
4,579,753 A 4/1986 Gjendemsjo
4,644,591 A 2/1987 Goldberg
4,670,923 A 6/1987 Gabriel et al.
4,716,594 A 1/1988 Shannon
4,724,558 A 2/1988 Reiff
4,750,225 A 6/1988 Simons et al.
4,767,419 A 8/1988 Fattore
4,864,669 A 9/1989 Jones
4,890,346 A 1/1990 Rist
4,914,772 A 4/1990 Difloe
4,922,565 A 8/1990 Blake
5,010,611 A 4/1991 Mallett
5,027,457 A 7/1991 Sweet
5,086,530 A 2/1992 Blake
5,093,947 A 3/1992 Henegar et al.
5,111,544 A 5/1992 Graebe
5,241,718 A 9/1993 Pope
5,385,036 A 1/1995 Spillane et al.
5,410,765 A 5/1995 Youngblood
5,421,046 A 6/1995 Vande Streek
5,509,157 A 4/1996 Story
5,515,559 A 5/1996 Benson
5,517,707 A 5/1996 LaMantia
5,566,407 A 10/1996 Lien
5,575,025 A 11/1996 Peters
5,577,276 A 11/1996 Nicholson et al.
5,600,850 A 2/1997 Shannon
5,642,545 A 7/1997 Howard
5,699,571 A 12/1997 Yowell
5,706,534 A 1/1998 Sherman
5,787,534 A 8/1998 Hargest et al.
5,806,112 A 9/1998 Harms
5,855,031 A 1/1999 Swift, Jr.
5,857,232 A 1/1999 Mahdavi
5,870,785 A 2/1999 Hoorens
5,881,408 A 3/1999 Bashista et al.
5,897,164 A 4/1999 Kagan et al.
5,933,885 A 8/1999 Glassford
5,937,458 A 8/1999 DeRosa
5,950,264 A 9/1999 Wyner et al.
6,012,189 A 1/2000 Dudley
6,012,756 A 1/2000 Clark-Dickson
6,017,601 A 1/2000 Amsel
6,019,421 A 2/2000 Roh
6,039,393 A 3/2000 Roh
6,055,690 A 5/2000 Koenig
6,079,980 A 6/2000 Durand
6,089,947 A 7/2000 Green
D433,851 S 11/2000 Roh
6,168,495 B1 1/2001 Yoon
6,170,101 B1 1/2001 McCloud
6,174,584 B1 1/2001 Keller et al.
6,178,573 B1 1/2001 Wagner et al.
6,243,895 B1 6/2001 Amin
D444,329 S 7/2001 Newman
6,256,813 B1 7/2001 Aaron
6,263,529 B1 7/2001 Chadwick et al.
6,302,487 B1 10/2001 Fujita et al.
6,315,364 B1 11/2001 Fujita et al.
6,347,422 B2 2/2002 Heavrin
6,421,857 B2 7/2002 Whatman et al.
6,438,775 B1 8/2002 Koenig
6,489,000 B1 12/2002 Ogura et al.
6,550,083 B1 4/2003 LaMantia
6,564,403 B1 5/2003 Titus
6,618,880 B1 9/2003 Chase
6,670,018 B2 12/2003 Fujita et al.
6,681,421 B2 1/2004 Carroll
6,684,437 B2 2/2004 Koenig
6,718,577 B2 4/2004 Li
6,718,578 B2 4/2004 Li
6,754,919 B2 6/2004 Leaphart, Jr. et al.
6,772,457 B1 8/2004 Alaback
6,859,958 B2 3/2005 LaMantia
6,859,962 B2 3/2005 Diak/Ghanem
6,910,896 B1 6/2005 Owens et al.
6,934,985 B2 8/2005 Sanders
D510,217 S 10/2005 Neveau
6,957,464 B1 10/2005 Coauette
6,971,130 B2 12/2005 Chase
7,003,823 B1 2/2006 Reed et al.
7,007,325 B1 3/2006 Gomeh
7,055,192 B2 6/2006 Waters et al.
7,107,638 B2 9/2006 Wilson
7,181,797 B2 2/2007 Chase
D584,555 S 1/2009 Estee
7,523,513 B2 4/2009 Waters et al.
7,694,364 B1 4/2010 Toma
7,743,442 B2 6/2010 Maloney et al.
7,793,368 B2 9/2010 Burrell, IV
7,887,387 B2 2/2011 Colvin
8,069,496 B2 12/2011 Sesselmann
8,161,584 B1 4/2012 Del Rio
8,220,088 B2 7/2012 Waters et al.
8,321,980 B2 12/2012 Maloney
8,365,323 B2 2/2013 Crumrine
8,402,580 B2 * 3/2013 Walvius ..... A47G 9/0246 5/495
8,434,179 B2 5/2013 Reeves et al.
8,539,626 B2 9/2013 Dunne et al.
8,566,982 B2 * 10/2013 Walvius ..... D06C 7/02 5/495
8,590,081 B1 11/2013 Dunne et al.
8,646,128 B2 2/2014 Kaplan et al.
8,661,581 B2 3/2014 Kaplan et al.
8,689,379 B2 4/2014 Cicci
8,713,734 B2 5/2014 Davis
8,793,813 B2 8/2014 Waters et al.
8,887,332 B2 11/2014 Alletto
8,959,683 B2 2/2015 Rochlin
9,015,883 B2 4/2015 Alletto
9,038,222 B2 5/2015 Cicci
9,109,309 B2 * 8/2015 Walvius ..... D04B 9/42
9,167,922 B1 10/2015 Holbrook et al.
9,167,923 B1 10/2015 Holbrook
9,204,731 B2 12/2015 Corodemus
9,247,826 B1 2/2016 Holbrook et al.
9,265,369 B1 2/2016 Beliveau
9,554,655 B2 * 1/2017 Abadi ..... A47C 23/24
9,615,615 B2 4/2017 Slank
10,016,064 B2 7/2018 Corodemus
10,022,000 B2 * 7/2018 Walvius ..... A47G 9/0246

(56) References Cited

U.S. PATENT DOCUMENTS

| | | | | |
|---|---|---|---|---|
| 10,492,624 | B2 | 12/2019 | Marton et al. | |
| 10,694,868 | B2 * | 6/2020 | Waters | A47D 15/00 |
| 10,722,049 | B2 * | 7/2020 | Waters | A47D 13/06 |
| 2001/0000362 | A1 | 4/2001 | Wagner et al. | |
| 2003/0224691 | A1 | 12/2003 | Carey | |
| 2004/0128764 | A1 | 7/2004 | McGrath et al. | |
| 2004/0199999 | A1 | 10/2004 | Landry | |
| 2005/0132498 | A1 | 6/2005 | Vrionis | |
| 2005/0177942 | A1 | 8/2005 | Finn | |
| 2005/0217030 | A1 | 10/2005 | Seigler | |
| 2006/0010608 | A1 | 1/2006 | DeFranks et al. | |
| 2009/0313755 | A1 | 12/2009 | Burrell, VI | |
| 2010/0154119 | A1 | 6/2010 | Shuttleworth | |
| 2011/0000020 | A1 * | 1/2011 | Walvius | A47G 9/02 5/495 |
| 2011/0041247 | A1 | 2/2011 | Moon | |
| 2011/0113552 | A1 | 5/2011 | Miller | |
| 2012/0024013 | A1 * | 2/2012 | Walvius | D05B 1/04 66/28 |
| 2012/0030874 | A1 * | 2/2012 | Walvius | D04B 1/14 5/484 |
| 2012/0278995 | A1 | 11/2012 | Kaplan et al. | |
| 2012/0311792 | A1 | 12/2012 | Reeves et al. | |
| 2012/0317721 | A1 | 12/2012 | Dunne et al. | |
| 2013/0097784 | A1 | 4/2013 | Kaplan et al. | |
| 2013/0283533 | A1 | 10/2013 | Bendickson | |
| 2013/0298335 | A1 * | 11/2013 | Abadi | A47C 31/105 5/691 |
| 2013/0333112 | A1 | 12/2013 | Dunne et al. | |
| 2014/0096320 | A1 | 4/2014 | Wilson | |
| 2014/0196211 | A1 | 7/2014 | Kaplan et al. | |
| 2014/0223664 | A1 | 8/2014 | Kanbar | |
| 2015/0342370 | A1 | 12/2015 | Ashworth | |
| 2015/0351563 | A1 | 12/2015 | Alletto | |
| 2015/0359353 | A1 | 12/2015 | Vainberg | |
| 2016/0015193 | A1 | 1/2016 | Alletto | |
| 2016/0022061 | A1 * | 1/2016 | Walvius | A47G 9/0246 5/484 |
| 2016/0166092 | A1 | 6/2016 | Alletto | |
| 2016/0331159 | A1 | 11/2016 | Alletto | |
| 2017/0020312 | A1 | 1/2017 | Davis | |
| 2017/0035215 | A1 | 2/2017 | Scorgie | |
| 2017/0055737 | A1 | 3/2017 | Rochlin | |
| 2017/0065093 | A1 | 3/2017 | Scorgie | |
| 2017/0099967 | A1 | 10/2017 | Holbrook | |
| 2017/0367496 | A1 | 12/2017 | Waters et al. | |
| 2017/0367497 | A1 | 12/2017 | Waters et al. | |
| 2017/0367498 | A1 | 12/2017 | Waters et al. | |
| 2017/0367499 | A1 | 12/2017 | Waters et al. | |
| 2018/0027999 | A1 | 2/2018 | Marton et al. | |
| 2019/0082859 | A1 | 3/2019 | Marton et al. | |
| 2019/0246802 | A1 | 8/2019 | Dacks et al. | |
| 2019/0261791 | A1 | 8/2019 | Marton et al. | |
| 2019/0374046 | A1 | 12/2019 | Waters et al. | |
| 2020/0037793 | A1 * | 2/2020 | Waters | A47G 9/0223 |
| 2020/0100603 | A1 * | 4/2020 | Marton | A47D 15/008 |
| 2020/0345156 | A1 * | 11/2020 | Marton | A47D 15/00 |

OTHER PUBLICATIONS

"Baby Carrier Air" datasheet [online], Babybjorn AB, Danderyd, Sweden, [retrieved on Nov. 3, 2006], Retrieved from the Internet: <URL:http://www.babybjorn.com/TemplatesWeb/ProdcutDetailers.asp?ItemId=2284>; 1 page.

"Cozy Crib Tent" magazine advertisement. Tots in Mind, Inc., Salem, NH; 1 page.

"High-Tech Toy Testing Equipment" datasheet [online], U.S. Consumer Product Safety Commission [retrieved on Feb. 15, 2007], Retrieved from the Internet: URL:http://www.cpsc.gov/cpscput/prerel/prhtm101/0155.html; 2 pgs.

"Virtual Child Model" datasheet [online], Nemours, Jacksonville, FL, [retrieved on Feb. 15, 2007], Retrieved from the Internet: URL:http//nemours.org/internet?url=no/news/releases/2000/001212_unsafe_toys.html; 2 pgs.

Safe-N-Secure Crib Liner, 1998 Show Directory, The 29th Annual International Juvenile Products Show, Oct. 25-28, 1998 (Dallas, Texas).

Cribble™ Crib Slat Safety Wraps, The 1999 International Juvenile Products Show Directory Oct. 23-26, 1999 (Dallas, Texas).

Defendant's Prior Art Chart from Prior Art Statement in *BreathableBaby, LLC* v. *Crown Crafts, Inc. and Crown Crafts Infant Products, Inc.*, Civil Case No. 12-cv-00094 (PJS/TNL) before the United States District Court, District of Minnesota.

Plaintiffs Response to Prior Art Statement in *BreathableBaby, LLC* v. *Crown Crafts, Inc. and Crown Crafts Infant Products, Inc.*, Civil Case No. 12-cv-00094 (PJS/TNL) before the United States District Court, District of Minnesota.

International Search Report and Written Opinion for PCT/US2021/042621; dated Nov. 9, 2021; 12 pages.

* cited by examiner

FIG. 2A
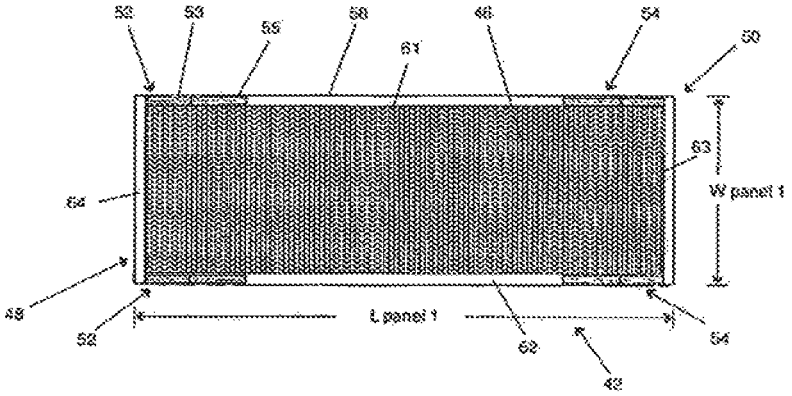
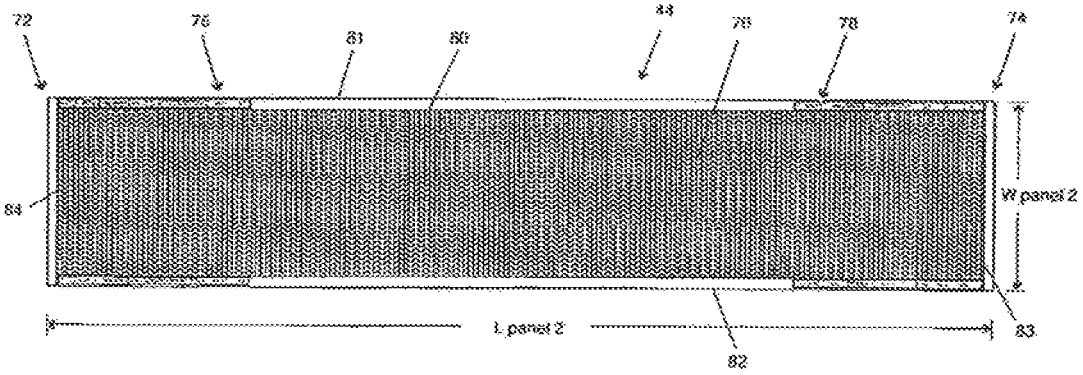
FIG. 2D

FIG. 2G
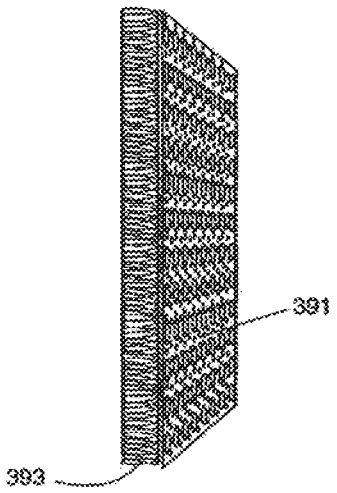
FIG. 2E
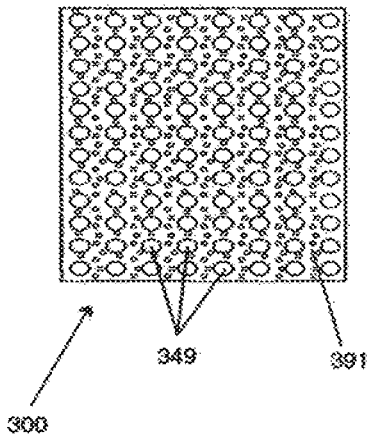
FIG. 2H
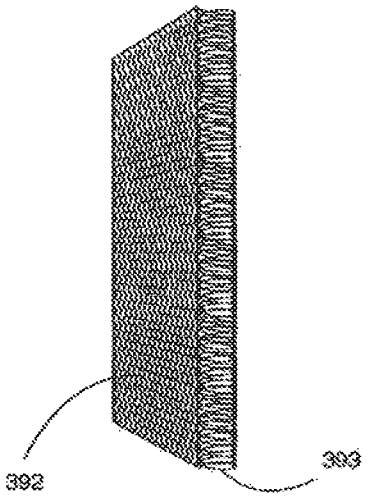
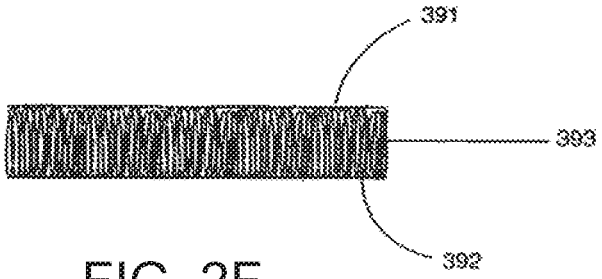
FIG. 2F

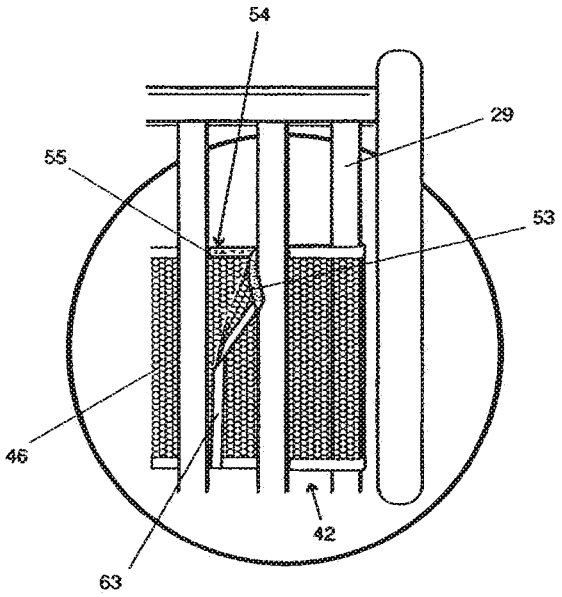
FIG. 3A
FIG. 3B
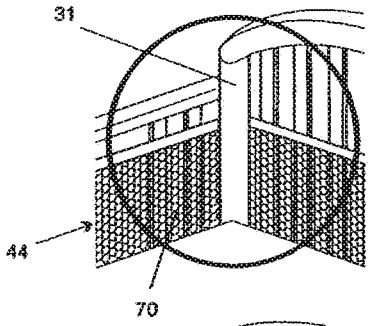
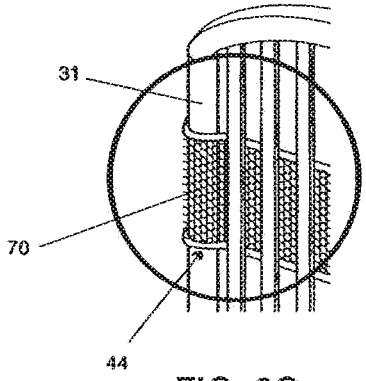
FIG. 3C

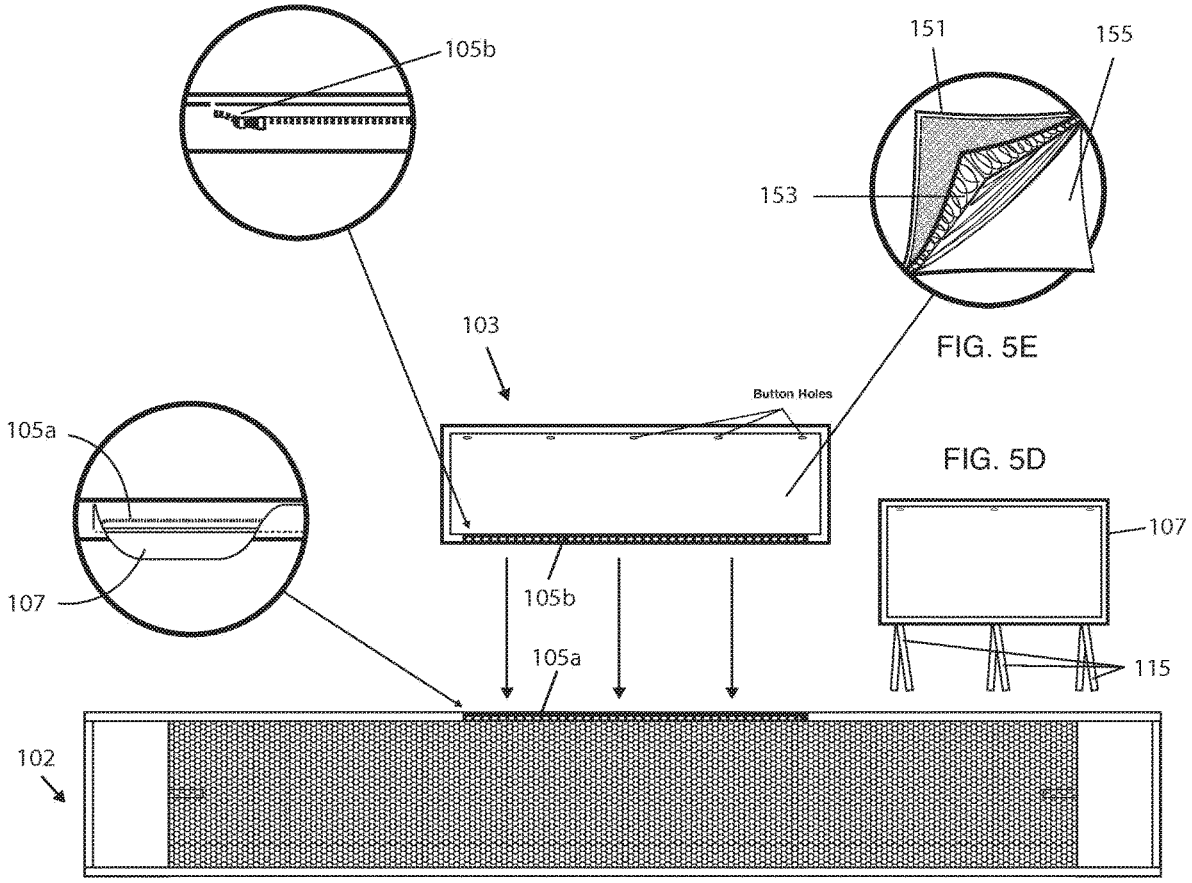
FIG. 5E
FIG. 5D
FIG. 5C
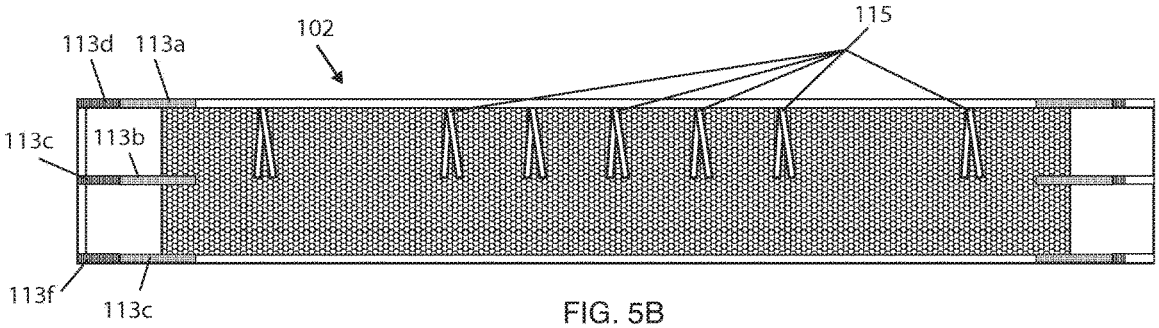
FIG. 5B

FIG. 6C
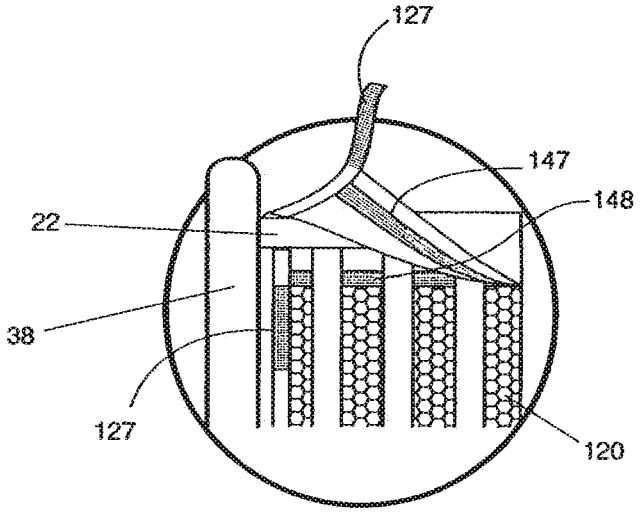
FIG. 6D
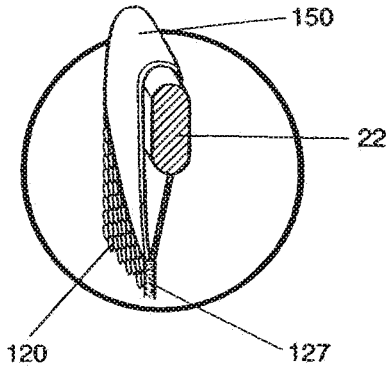
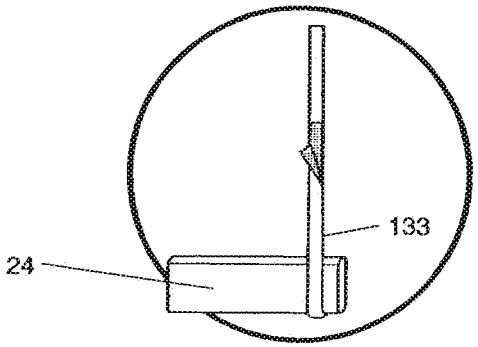
FIG. 6E
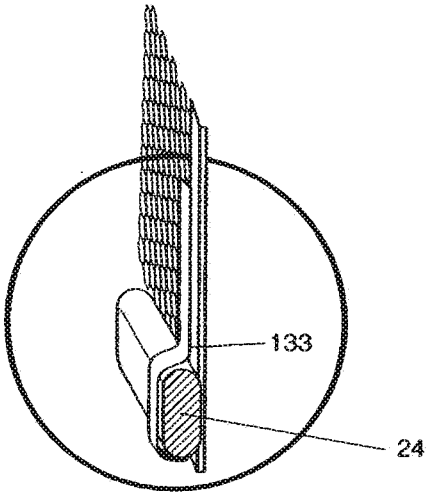
FIG. 6F

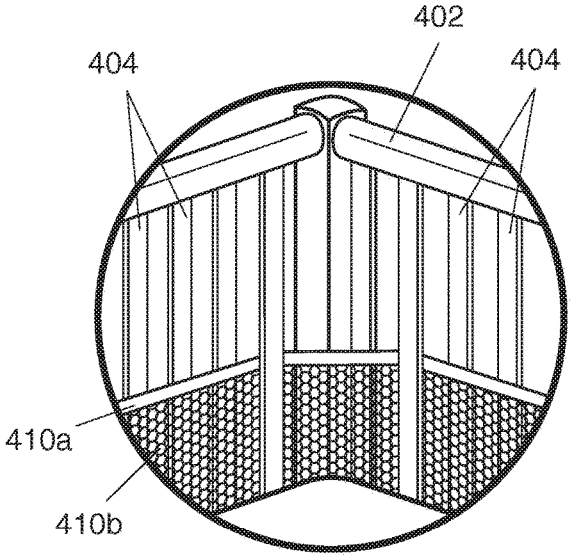
FIG. 15A
FIG. 15B
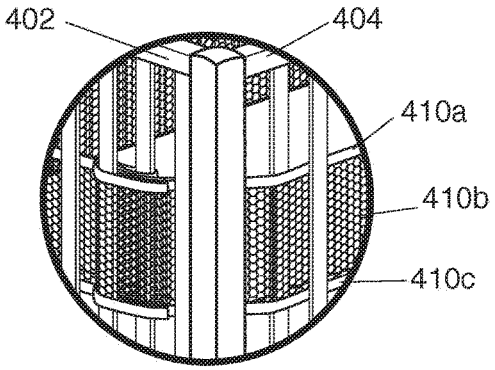
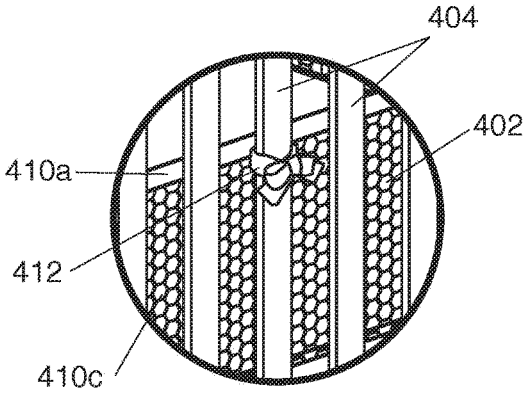
FIG. 15C

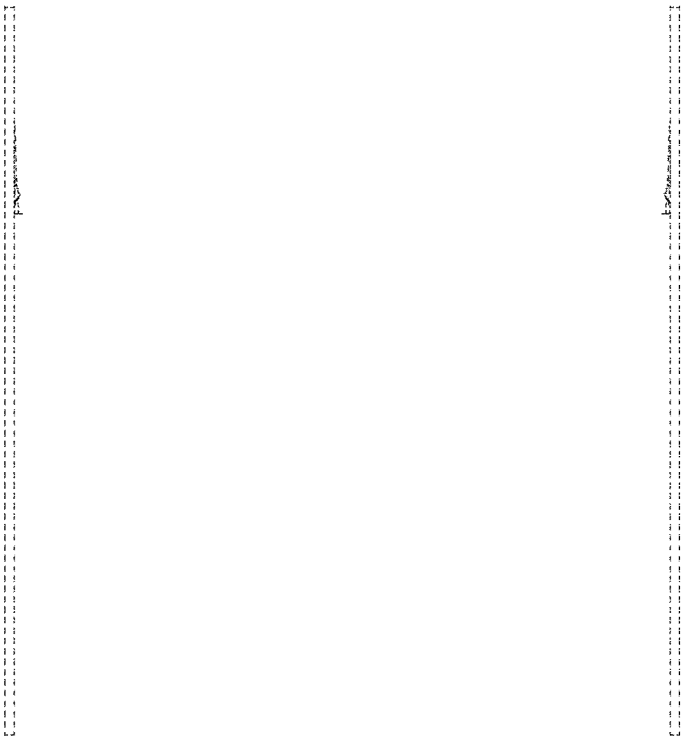
FIG. 22E
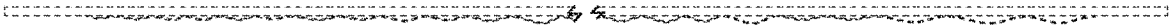
FIG. 22F
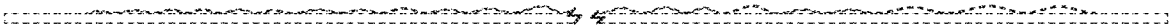
FIG. 22G
FIG. 22H

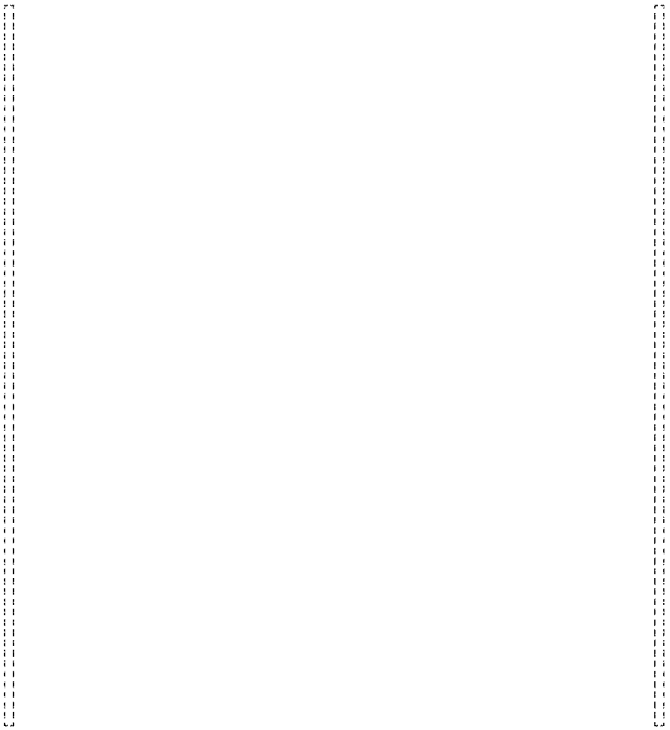
FIG. 24E
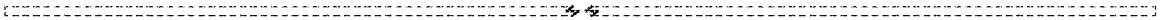
FIG. 24F
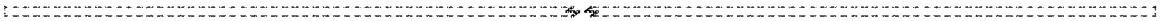
FIG. 24G
FIG. 24H

FIG. 25E
FIG. 25F
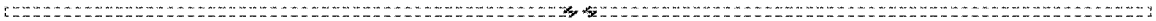
FIG. 25G
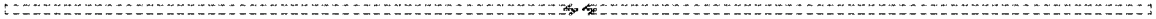
FIG. 25H

FIG. 26E

FIG. 26F

FIG. 26G

FIG. 26H

FIG. 27E
FIG. 27F
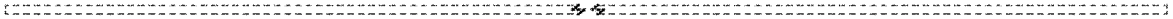
FIG. 27G
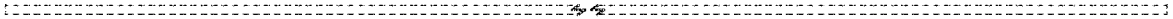
FIG. 27H

CRIB LINER

CROSS-REFERENCE TO RELATED APPLICATIONS

This application is a continuation-in-part of U.S. patent application Ser. No. 16/699,675, filed on Dec. 1, 2019, now abandoned, which is a continuation application of U.S. patent application Ser. No. 15/729,514, filed on Oct. 10, 2017 and issued as U.S. Pat. No. 10,492,624, which claims the benefit of U.S. Provisional Patent Application No. 62/559,117, filed Sep. 15, 2017. The contents of the aforementioned applications are incorporated herein in their entirety for all purposes.

FIELD OF THE INVENTION

The present disclosure relates to novel and advantageous crib liners. Particularly, the present disclosure relates to novel and advantageous crib liners having a breathable body portion having an air permeability of between 385 CFM and 1530 CFM, a light permeability of between 47 and 99%, and a CO2 rebreathing value of less than 20%.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Conventional baby cribs typically include side rails that are made up of top and bottom horizontal bars interconnected by a series of spaced supports (e.g., vertical slats). Frequently, babies and toddlers, while sleeping or playing in their cribs, intentionally or accidentally extend their limbs out of the crib between the slats and have difficulty drawing them back into the crib. If this occurs when the child is sleeping, the extended limbs will remain uncovered and become cold, and the child will ultimately be awakened or harmed. Cribs may also have headboards and footboards (i.e., endboards) that are also made with spaced-apart supports and the baby may also extend its arms or legs out of the crib between these slats.

Although various types of apparatuses have been used to prevent such problematic situations (i.e., extension of limbs outside of the crib through the spaced-apart supports), many of such apparatuses exhibit their own problems. For example, as described herein, ventilation may be problematic (e.g., such as that leading up to and resulting in suffocation). For example, crib bumpers are widely used in cribs. Such bumpers may be used for blocking the openings between slats and/or for protecting a child from injury caused by bodily impact of the child against the sides of the crib that define the interior boundary of the crib. However, in many cases, such bumpers do not allow for adequate ventilation, or air flow, within the crib and also obstruct viewing of the child.

Infants usually breathe through their nasal passages. However, during crying or in the event their nasal passages are blocked, infants may breathe through their oral cavities. Mechanical resistance suffocation takes places when respiration is interrupted if these passages are both blocked externally by an object. When respiration is interrupted, $CO_2$ levels in the blood rise. The body's response to this elevation in $CO_2$ levels is to attempt more rigorous respiration. If the agent of suffocation is not removed, the incident may be fatal after two or three minutes. Further, the accumulation of $CO_2$ or other dangerous gases inside the crib or around the infant may be a possible cause of sudden infant death syndrome (SIDS). Existing crib apparatuses, such as crib bumpers, tend to trap dangerous gases inside the crib. Further, such apparatuses may block the nasal and oral passages of infants under certain circumstances. Existing crib bumpers are known to lead to impaired respiration.

Thus, there is a need in the art for an apparatus to block the openings between the slats of cribs without risking blocking the nasal and oral passages of infants or trapping dangerous gases in the crib.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present invention, as described herein, addresses the problems described above and other problems of prior art systems and methods that will become apparent to one skilled in the art from the description below.

The present disclosure, in one or more embodiments, relates to a crib liner suitable for use with a crib, wherein the crib has a perimeter, and wherein a plurality of spaced vertical support elements are provided along the perimeter. In one embodiment, the crib liner may include a first panel configured to cover a portion of the spaced vertical support elements. The first panel may have first and second ends, a breathable body portion, a bottom border, and a top border. In some embodiments, the first panel may further comprise side borders. A first fastening mechanism may be provided at the first end, wherein the first fastening mechanism attaches the first panel to the crib. In some embodiments, the crib liner may further comprise a second fastening mechanism at the second end, wherein the second fastening mechanism attaches the first panel to the crib. Either or both of the first and second fastening mechanisms may be hook and loop fasteners. The breathable body portion may have an air permeability of between 385 CFM and 1530 CFM, a light permeability of between 47 and 99%, and a CO2 rebreathing value of less than 20%.

In some embodiments, the breathable body portion of the first panel of the crib liner may include a front layer and a back layer, wherein the front layer and the back layer have different fabric weaves and are attached to one another. The breathable body portion may further comprise an intermediate layer between the front layer and the back layer. The intermediate layer may be a pile layer.

In some embodiments, the breathable body portion may comprise a padded spacer mesh.

In some embodiments, the breathable body portion may comprise a mesh-type material having a mesh coverage of between 32% and 91%.

The crib liner may further comprise a second panel configured to cover a portion of the spaced vertical support elements. The second panel may have first and second ends, a breathable body portion, a bottom border, and a top border. A first fastening mechanism may be provided at the first end, wherein the first fastening mechanism attaches the second panel to the crib. The breathable body portion may have an air permeability of between 385 CFM and 1530 CFM, a light permeability of between 47 and 99%, and a CO2 rebreathing value of less than 20%.

The second panel may be removably coupleable to the first panel. For example, the second end of the second panel may be removably coupleable to the second end of the first panel. In some embodiments, a length of the first crib liner may be less than a length of the second crib liner.

The present disclosure, in one or more embodiments, relates to a crib liner suitable for use with a crib, wherein the crib has a perimeter, and wherein a plurality of spaced vertical support elements are provided along the perimeter. In one embodiment, the crib liner may include a first panel configured to cover a portion of the spaced vertical support elements. The first panel may have first and second ends, a breathable body portion, a bottom border, and a top border. In some embodiments, the first panel may further comprise side borders. A first fastening mechanism may be provided at the first end, wherein the first fastening mechanism attaches the first panel to the crib. In some embodiments, the crib liner may further comprise a second fastening mechanism at the second end, wherein the second fastening mechanism attaches the first panel to the crib. Either or both of the first and second fastening mechanisms may be hook and loop fasteners. The breathable body portion may have an air permeability of between 385 CFM and 1530 CFM, a light permeability of between 47 and 99%, and a CO2 rebreathing value of less than 20%.

The present disclosure, in one or more embodiments, relates to a crib liner suitable for use with a crib, wherein the crib has a perimeter, and wherein a plurality of spaced vertical support elements are provided along the perimeter. In one embodiment, the crib liner may include a first panel configured to cover a portion of the spaced vertical support elements and a second panel configured to cover a portion of the spaced vertical support elements. Each of the first panel and the second panel may have first and second ends, a breathable body portion, a bottom border, and a top border. In some embodiments, each of the first panel and the second panel may further comprise side borders. A fastening mechanism may be provided at the first end of the first panel, wherein the fastening mechanism attaches the first panel to the crib. A fastening mechanism may be provided at the first end of the second panel, wherein the fastening mechanism attaches the second panel to the crib. Either or both of the fastening mechanisms may be hook and loop fasteners. The breathable body portion may have an air permeability of between 385 CFM and 1530 CFM, a light permeability of between 47 and 99%, and a CO2 rebreathing value of less than 20%.

The present disclosure, in one or more embodiments, relates to a crib liner suitable for use with a crib, wherein the crib has a perimeter, and wherein a plurality of spaced vertical support elements are provided along the perimeter. In one embodiment, the crib liner may include a first panel configured to cover a portion of the spaced vertical support elements. The first panel may have first and second ends, a breathable body portion, a bottom border, and a top border. In some embodiments, the first panel may further comprise side borders. A first fastening mechanism may be provided at the first end, wherein the first fastening mechanism attaches the first panel to the crib. In some embodiments, the crib liner may further comprise a second fastening mechanism at the second end, wherein the second fastening mechanism attaches the first panel to the crib. Either or both of the first and second fastening mechanisms may be hook and loop fasteners. The first panel comprises a breathable material having an air permeability of between 385 CFM and 1530 CFM, a light permeability of between 47 and 99%, and a $CO_2$ rebreathing value of less than 20%. The breathable material may be a functional fabric that at least partially blocks a hazard from penetrating the crib liner. Such hazard may be any hazard now known or later discovered to be hazardous to an infant including, but not limited to, mold, mildew, allergens, heat, ultraviolet light (UV), and electric and magnetic forces (EMF).

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

FIG. 2A is a top view of one embodiment of a first side panel of the crib shield system shown in FIG. 1 in an unattached position laid flat, according to one example embodiment of the present invention.

FIG. 2D is a top view of one embodiment of a second side panel of a crib shield system in an unattached position laid flat, according to one example embodiment of the present invention.

FIGS. 2E-2H show details of one embodiment of a breathable mesh material that may be used in forming the side panels and the crib shield system, as well as other apparatus or objects described in other figures, according to one example embodiment of the present invention.

FIGS. 3A-3C illustrate the attachment of the first and second side panels to a crib, according to one example embodiment of the present invention.

FIG. 5B is a back side of a crib shield mesh, according to one example embodiment of the present invention.

FIG. 5C is a front side and several magnified views of a side panel for use in a crib shield system, according to one example embodiment of the present invention.

FIG. 5D is a side view of a second crib rail cover, according to one example embodiment of the present invention.

FIG. 5E is an illustration of a rail cover having multiple layers of fabric, according to one example embodiment of the present invention.

FIGS. 6A-6F are various illustrations for use in describing the attachment of the side panel shown in FIG. 5 to a crib side rail according to one example embodiment of the present invention.

FIGS. 15A-C are detailed illustrations of a crib liner, according to one example embodiment of the present invention.

FIG. 22E is a first side view of an illustration of an example body portion of the crib liner of FIG. 22A, according to one example embodiment of the present invention.

FIG. 22F is a second side view of an illustration of an example body portion of the crib liner of FIG. 22A, according to one example embodiment of the present invention.

FIG. 22G is a top view of an illustration of an example body portion of the crib liner of FIG. 22A, according to one example embodiment of the present invention.

FIG. 22H is a bottom view of an illustration of an example body portion of the crib liner of FIG. 22A, according to one example embodiment of the present invention.

FIG. 24E is a first side view of an illustration of an example body portion of the crib liner of FIG. 24A, according to one example embodiment of the present invention.

FIG. 24F is a second side view of an illustration of an example body portion of the crib liner of FIG. 24A, according to one example embodiment of the present invention.

FIG. 24G is a top view of an illustration of an example body portion of the crib liner of FIG. 24A, according to one example embodiment of the present invention.

FIG. 24H is a bottom view of an illustration of an example body portion of the crib liner of FIG. 24A, according to one example embodiment of the present invention.

FIG. 25E is a first side view of an illustration of an example body portion of the crib liner of FIG. 25A, according to one example embodiment of the present invention.

FIG. 25F is a second side view of an illustration of an example body portion of the crib liner of FIG. 25A, according to one example embodiment of the present invention.

FIG. 25G is a top view of an illustration of an example body portion of the crib liner of FIG. 25A, according to one example embodiment of the present invention.

FIG. 25H is a bottom view of an illustration of an example body portion of the crib liner of FIG. 25A, according to one example embodiment of the present invention.

FIG. 26E is a first side view of an illustration of an example body portion of the crib liner of FIG. 26A, according to one example embodiment of the present invention.

FIG. 26F is a second side view of an illustration of an example body portion of the crib liner of FIG. 26A, according to one example embodiment of the present invention.

FIG. 26G is a top view of an illustration of an example body portion of the crib liner of FIG. 26A, according to one example embodiment of the present invention.

FIG. 26H is a bottom view of an illustration of an example body portion of the crib liner of FIG. 26A, according to one example embodiment of the present invention.

FIG. 27E is a first side view of an illustration of an example body portion of the crib liner of FIG. 27A, according to one example embodiment of the present invention.

FIG. 27F is a second side view of an illustration of an example body portion of the crib liner of FIG. 27A, according to one example embodiment of the present invention.

FIG. 27G is a top view of an illustration of an example body portion of the crib liner of FIG. 27A, according to one example embodiment of the present invention.

FIG. 27H is a bottom view of an illustration of an example body portion of the crib liner of FIG. 27A, according to one example embodiment of the present invention.

DETAILED DESCRIPTION

Figure 1A:
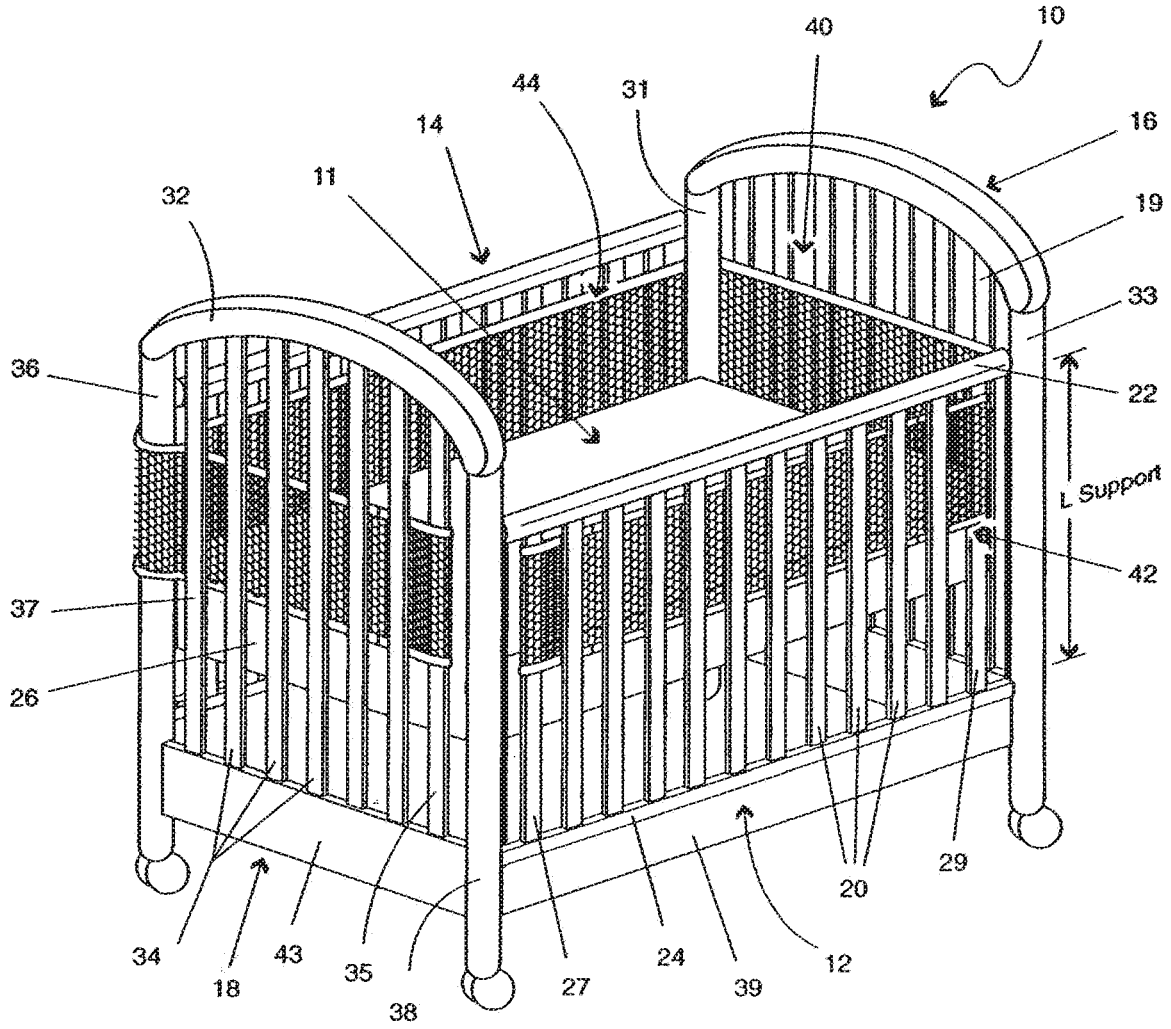
FIG. 1A is a perspective view of one embodiment of a crib shield system attached to a crib, according to one example embodiment of the present invention.

The present disclosure relates to novel and advantageous crib liners. Particularly, the present disclosure relates to novel and advantageous crib liners having a breathable body portion having an air permeability of between 385 CFM and 1530 CFM, a light permeability of between 47 and 99%, and a CO2 rebreathing value of less than 20%.

The present disclosure relates to a crib liner suitable for use with a crib, wherein the crib has a perimeter, and wherein a plurality of spaced vertical support elements are provided along the perimeter. In one embodiment, the crib liner may include a first panel configured to cover a portion of the spaced vertical support elements. The first panel may have first and second ends, a breathable body portion, a bottom border, and a top border. In some embodiments, the first panel may further comprise side borders. Fastening mechanisms may be provided at either or both ends for attaching the first panel to the crib. The breathable body portion may have an air permeability of between 385 CFM and 1530 CFM, a light permeability of between 47 and 99%, and a CO2 rebreathing value of less than 20%.

In general, the present invention is related to a crib liner that allows air to flow through it and provides some protection from limbs getting entangled in crib slats. In various embodiments, the crib liner may yield CO2 rebreathing values of less than about 20%. The crib liner can be made from any airflow material, such as mesh, and can comprise one or more panels suitable for attachment to a crib. It is to be appreciated that any reference to "mesh" is intended to include mesh-like materials in addition to materials commonly referred to as mesh. The crib liner may allow air flow primarily in the area of an infant's head and can provide less in other less critical areas, such as the borders of the liner. Since, in general, crib liners are removed from the crib as the infant gains the ability to sit or stand, the primary area of airflow concern is from the crib mattress surface up 4 or 5 inches in height, where the infant's head lies during sleeping. As such, for example, a crib liner that has a bottom border of 0.5 to 1 inches, a middle area of 4 to 5 inches of mesh in height and a top border of any height, say for example 10 inches can allow air flow even though the total amount of mesh makes up only 4 inches of the total 15 inches. In other words, in some embodiments, only 26.7% of the above crib liner may be mesh. However, that mesh is provided such that the area of the crib liner proximate an infant's head during sleep may be or may be close to 100% mesh.

In general, a crib liner, suitable for use with a crib, is disclosed. A typical crib suitable for use with the crib liner has first, second, third, and fourth sides configured for receiving a mattress is disclosed. Such crib also includes four corners, wherein each corner is constructed as part of where two adjacent sides meet; wherein at least one of the first, second, third, or fourth sides has a horizontal top bar and a plurality of vertical spaced support elements. A crib liner as disclosed herein may be used with any structure in which an infant may rest and it is not necessary that such structure have, for example, first, second, third, and fourth sides. The crib liner may be used with a crib having a perimeter inside which a mattress may be received, wherein the perimeter includes a plurality of vertical spaced support elements. Similarly, there are situations wherein an infant may be laid in a structure that does not have a mattress. It is to be appreciated that liners as provided herein may also be used with such structures.

The crib liner may include at least a first panel configured to cover a portion of the vertical spaced support elements. The first panel may include a breathable body portion, a bottom border, a top border, and side borders. The first panel may further include first and second fasteners at each end to attach the first panel to the crib. The breathable body portion includes a first material having a front layer and a back layer, the front layer and the back layer being attached to each other and having different fabric weaves. The breathable body portion may have an air permeability of between 385 CFM to 1530 CFM and a light permeability of between 47 and 99%. The crib liner may yield $CO_2$ rebreathing values of less than about 20%.

Air permeability is the measure of air flow passed through a given area of a fabric. Air permeability is defined as the flow rate of air per unit area at a given differential pressure and may be expressed as cubic feet per minute, CFM. In the context of the liner, air permeability quantifies the resistance of a material to allow a baby to breathe the air on the contralateral side of the material. Air permeability may be influenced by thickness of material, density of material, and the material construction.

Light permeability, sometimes referred to as light transmission, may be defined as the percentage of light that passes through the fabric from a first side to a second side.

Carbon dioxide ($CO_2$) is the gas the body naturally produces as waste. Humans breathe in oxygen ($O_2$) and breathe out $CO_2$. When someone rebreathes $CO_2$, that is, when they inhale the exhaled $CO_2$, it can have harmful effects on the body. $CO_2$ rebreathing (also referred to as $CO_2$RB) can be measured and used as a metric for quantifying impaired respiration. The $CO_2$ rebreathing value is the percentage of $CO_2$ contained in a unit of air that is rebreathed.

Various embodiments of crib liners shall be described with reference to FIGS. 1-27I and the below description. Additional embodiments of the various materials allowing airflow used within the crib liners shall be described. The particular features of the disclosed embodiments should not be limited to just those illustrated configurations. Instead, the various features disclosed may be combined to create exponentially more embodiments not explicitly illustrated. For example, the various fastener apparatuses and configurations for attaching the crib liner to a crib disclosed may be combined in far more configurations than illustrated within the confines of this disclosure. Further, some exemplary embodiments are illustrated as one panel embodiments while other exemplary embodiments are illustrated as two panel embodiments. It should be understood that the features of such illustrated one panel embodiments and illustrated two panel embodiments (e.g., size, shape, fastener arrangement, method of attaching to crib, etc.) may be interchanged and/or combined to form exponentially more embodiments not explicitly illustrated within this disclosure. Further, more than two panels may be provided. As such, the claims should not be limited only to such exemplary illustrated embodiments. Additionally, airflow material not only includes mesh material, padded mesh material, and mesh-like material, but may also include alternate material(s) that have similar airflow and/or padding properties (e.g., the weave found in cotton sweaters, such as a corded cotton sweater, may be sufficiently padded and/or breathable).

FIG. 1A shows a conventional crib 10. The crib 10 can include two sides 12, 14, or side rails, and further, a third side 16 (or side rail or footboard), and a fourth side 18 (or side rail or headboard). The sides 12, 14 extend between the third side 16 and fourth side 18 along a length thereof. In one embodiment, sides 12 and 14 are side rails and sides 16 and 18 are a footboard and a headboard, respectively. The headboard 18, footboard 16, and side rails 12, 14 are connected and sized for receiving a mattress within an interior 11 of the crib 10. As illustrated, the crib is configured to receive a standard rectangular-shaped crib mattress. Of course, other crib configurations are possible. One or more of the side rails or end boards may be solid and the terms "side" or "end" are interchangeable. Essentially the crib 10 has four sides 12, 14, 16 and 18 that define an interior boundary 11 extending proximate and around a periphery of the mattress 26 disposed within the crib 10. While a conventional generally rectangular crib is shown and described, it is to be appreciated that a crib liner as disclosed herein may alternatively be used with cribs having other configurations, such as a round crib.

The mattress 26 is supported within the crib 10 by various structures not shown in FIG. 1A. For example, a bottom structural member may be provided at one or more positions about the interior boundary of the crib 10 or in any other fashion. In many conventional cribs 10, the mattress 26 and/or a supporting member therebelow may be raised and/or lowered. In FIG. 1A, the mattress 26 is shown in a raised state. In contrast, in FIG. 4A. (described more fully below), the mattress is shown in a lowered state. The lowered state is closer to the ground or floor upon which the crib 10 is positioned than the raised state. As such, the depth inside the crib is adjustable.

The side rail 12 generally includes a top bar 22 and a bottom bar 24 positioned approximately parallel to one another. A plurality of generally vertically-spaced side support elements 20, such as slats, extend between the horizontal top bar 22 and horizontal bottom bar 24. Although less prevalent due to crib regulation, the side rail 12 in some older cribs may be moveable from a raised state to a lowered state. For example, the moveable side rail 12 allows a user to lower the side rail 12 in order to have easier access to a child lying on mattress 26. As shown in FIG. 1A, side rail 12 can be raised or lowered relative to support structure element 39 and the remainder of the crib 10. The present invention allows for the side rail 12 to be moved from a lowered state to a raised state, or vice versa, even with a crib shield system 40 attached to the crib 10.

Typical cribs today do not have a moveable side rail. In addition, cribs may or may not have slats on one or more sides as the current trend in cribs is to have a crib that is convertible to a toddler bed, using one or more of the crib sides (or foot and head boards) as the foot and/or headboard of the toddler bed. In some cribs typical corner posts are not apparent. Therefore reference to a corner post herein does not strictly refer to a structural member at the corner of the crib and can also simply include where two sides meet.

Side rail 14 may be similarly configured to side rail 12. For example, side rail 14 may be moveable from a lowered to a raised state, and vice versa. However, side rail 14 may also be in a stationary position fixedly attached to corners 36, 31. Likewise, side rail 12 may be moveable or in a fixed position. As moveable side rails are conventional configurations, no further description is provided with respect to the mechanisms for allowing such movement thereof. In addition, any of the sides of the crib may or may not include slats and the crib may or may not include corner posts. The crib shield systems described herein also work with various mechanisms for moving side rails, e.g., side and bottom latch systems and gliding side mechanisms, fixed rails, rails with no As shown in FIG. 1A, the plurality of spaced-apart side support elements 20, 34 of the side rails 12, 14 and the headboard and footboard 16, 18 define slats.

Generally, headboard 18 of crib 10 includes an upper bar 32, here having a decorative curved shape but any shape may be used, as well as a bottom horizontal element 43, each connected in a fixed position to corners 36, 38. In a similar manner to the side rails 12, 14, the generally vertically-spaced support elements 34 extend between the top bar 32 and the horizontal element 43. It will be recognized that many cribs may or may not have spaced support elements that define a part of the footboard 16 or headboard 18. For example, the headboard and footboard may be solid materials as opposed to spaced-apart supports. The footboard 16 is configured in a manner like that of headboard 18 and include corners 31, 33. Of course, in certain cribs there may or may not be corner posts, e.g. the convertible crib. Therefore the term "corner post" may be used herein to refer to where two sides meet without requiring a specific physical structure.

As shown in FIG. 1A, the plurality of spaced-apart side support elements 20, 34 of the side rails 12, 14 and the headboard and footboard 16, 18 are used to define the interior boundary extending proximate and around the periphery of a mattress 26 disposed within the crib 10. In one embodiment, and as shown in FIG. 1A, at least one panel of a crib shield system 40 or liner may be sized for covering at least a portion of the plurality of spaced-apart side support elements and configured to extend along at least a portion of the interior boundary. Of course, if there are no spaced-apart side support elements and there is a solid structure such as a solid headboard, the one panel would still cover the structure. As is described herein, in one preferred embodiment, a significant amount of the panel, up to the entirety of the panel excluding binding at the edges, is formed of a material allowing air to flow through it (e.g. "breathable") and the panel includes at least one fastening apparatus for securing at least one panel to the crib 10.

As used herein, the term mattress may include any structure disposed within the crib 10 and upon which objects and/or human beings may be placed. In other words, mattress refers to any structure and not just a soft sleeping apparatus. For example, the crib could be configured into a playpen-type structure with a solid hard and/or flat bottom that is, for example, lowered very close to the floor. As such, and as used herein, a crib can be equated to and encompasses the various structures similar to a crib, such as those for containing a small child (e.g., playpens, portable cribs, basinets, convertible cribs, round cribs, or other structures including, for example, spaced-apart side supports that require an apparatus or system such as that described herein). In some embodiments, no mattress or other structure may be provided within the crib, playpen, basinet, or other and the crib liner may simply work with the bottom surface of the crib, playpen, basinet, or other.

As further shown in FIG. 1A, crib shield system 40 is attached to crib 10 along a portion of the interior boundary of the crib 10 defined by the headboard 18, footboard 16, and side rails 12, 14. In the embodiment shown, the crib shield system 40 comprises a first panel 42 and a second panel 44. These panels 42, 44 may be side panels. As shown in FIG. 1A, the first side panel 42 is attached to side rail 12. The second side panel 44 is attached in a manner to at least partially cover the side rail 14, footboard 16, and headboard 18. However, one skilled in the art will recognize that the second side panel 44 may also be configured to cover just the second side rail 14 and the footboard 16 (e.g., such as when the headboard 18 lacks vertical spaced-apart side support elements), or may cover just side rail 14 and headboard 18 (e.g., such as when footboard 16 lacks spaced-apart side support elements). In other words, the configuration of the second side panel 44 may differ depending upon the configuration of crib 10 upon which it is attached. Likewise, the configuration of the first side panel 42 may differ depending upon the configuration of crib 10 upon which it is attached. In addition, the attachments may be different if attaching to a rail with no slats, for example. The crib shield system 40 can include only one panel, two panels or more panels. Further, the crib shield system may or may not cover all sides of the crib 10.

Figure 1B:
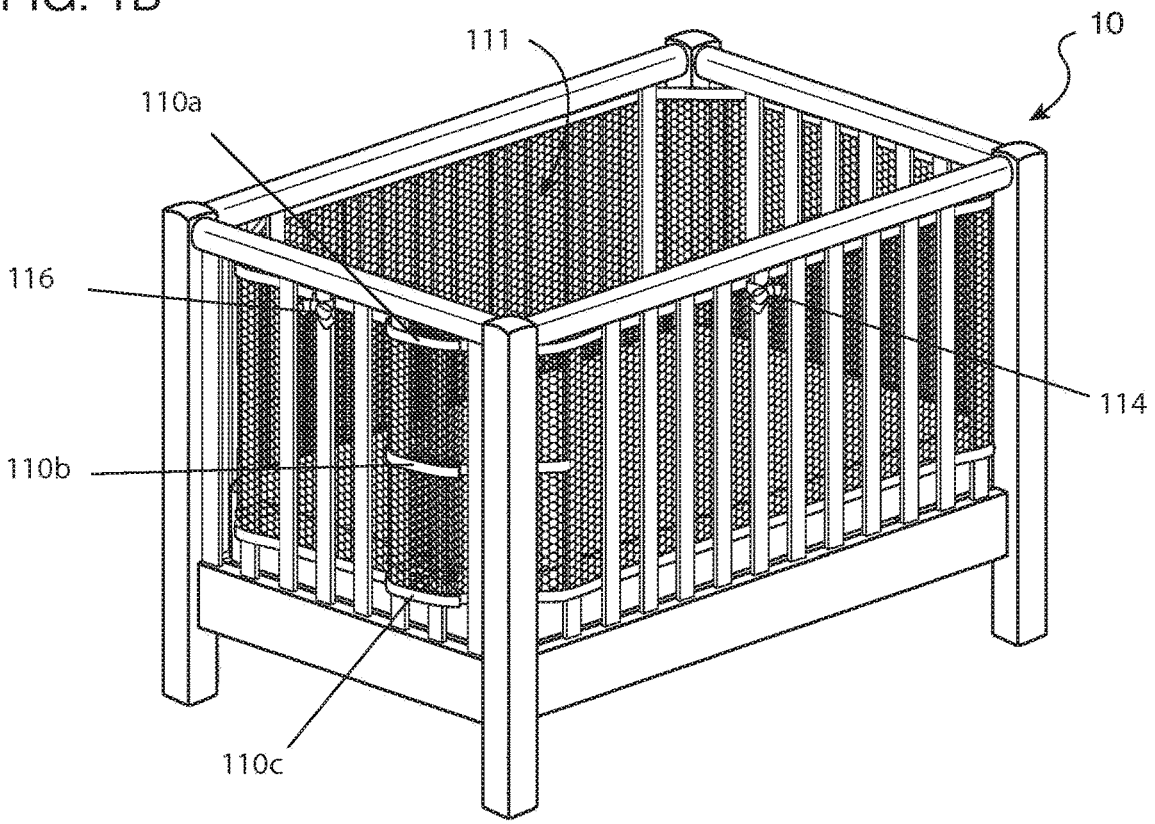
FIG. 1B is a perspective view of one embodiment of a single-wrap crib shield system attached to a crib, according to one example embodiment of the present invention.

In another embodiment of the crib shield system, the crib shield may extend nearly the full height of the crib. FIG. 1B illustrates such an embodiment. It is to be appreciated that the embodiment of FIG. 1A may be made with the crib shield 40 having the height of the crib shield 111 of FIG. 1B.

FIG. 1B shows a perspective view of one embodiment of a single-wrap crib shield system attached to a crib with a side rail of the crib in a raised or fixed state. The crib shield 111 may include wraps 110*a*, 110*b*, and 110*c* positioned at different vertical locations along the crib shield 111. The wraps 110*a*, 110*b*, and 110*c* may be hook and loop (e.g. Velcro™), ties, snaps, zipper, or any other suitable fastener. The crib shield 111 may be fastened to the crib 10 using fasteners 114 and 116. The fasteners 114 and 116 may be located anywhere along the vertical height of the crib shield 111 or perimeter of the crib 10.

Figure 1C:
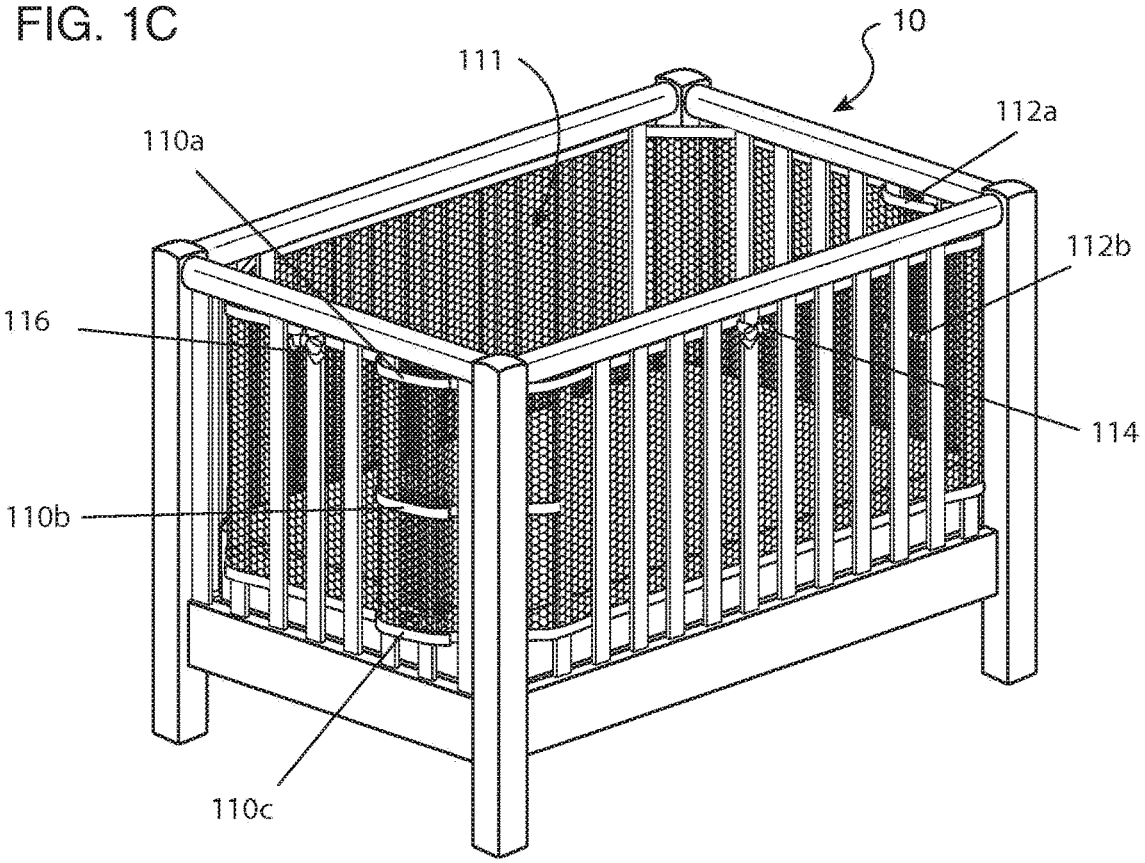
FIG. 1C is a perspective view of one embodiment of a double-wrap crib shield system attached to a crib, according to one example embodiment of the present invention.

The crib shield of FIG. 1B illustrates a full height shield with a single set of wraps 110*a*, 110*b*, 110*c*. In other embodiments, additional sets of wraps may be used to secure the crib shield. FIG. 1C shows a perspective view of one embodiment of a double-wrap crib shield system attached to a crib with a side rail of the crib in a fixed or raised state. The crib shield 111 of FIG. 1C includes a second set of wraps 112*a* and 112*b* located at different vertical heights along the crib shield 111.

Figure 1D:
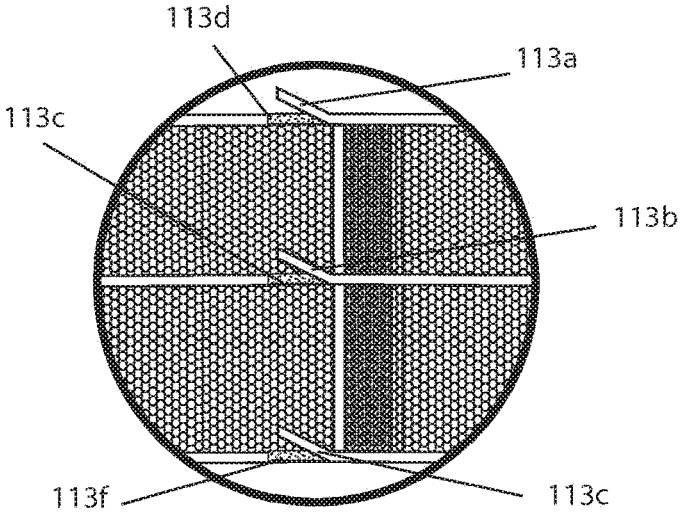
FIG. 1D is a side view of one embodiment of a hook and loop attachment, according to one example embodiment of the present invention.
Figure 1E:
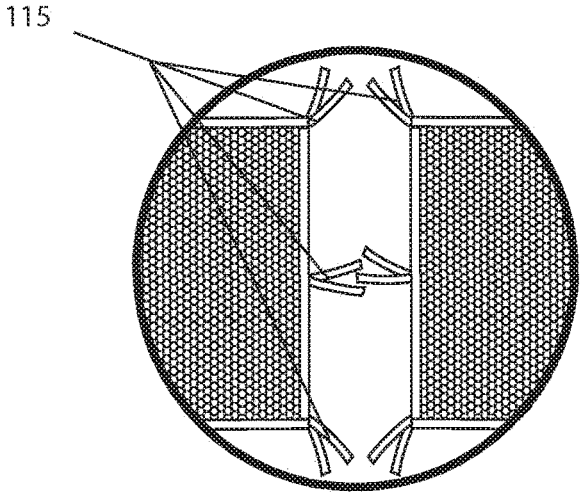
FIG. 1E is a side view of one embodiment of tie attachments, according to one example embodiment of the present invention.
Figure 1F:
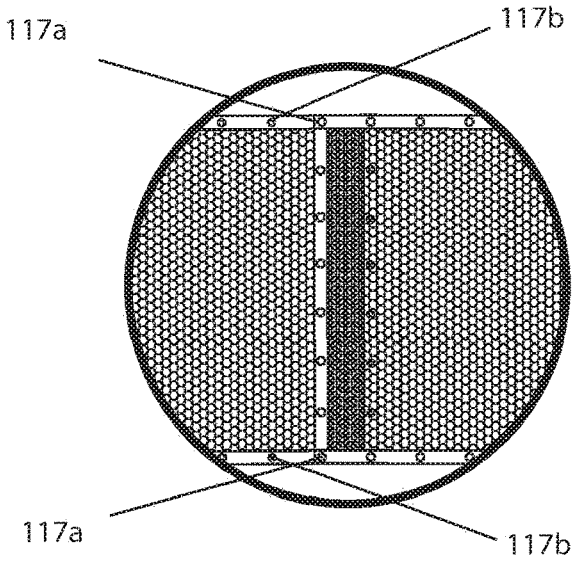
FIG. 1F is a side view of one embodiment of snap attachments, according to one example embodiment of the present invention.

Various wrap types are illustrated in FIGS. 1D-1F. FIG. 1D is a side view of one embodiment of a hook and loop (e.g. Velcro™) attachment. Hooks 113*a*, 113*b*, and 113*c* located at different vertical positions may attach to loops 113*d*, 113*e*, and 113*f*, respectively. FIG. 1E shows a side view of one embodiment of tie attachments. Ties 115 may be loose pieces of string located on ends of the crib shield or locations along the perimeter of the crib shield to allow an individual to tie one of the ties to another tie. FIG. 1F is a side view of one embodiment of snap attachments. One side of the crib shield may include snap receptors 117*b* while another side of the crib shield may include snap attachments 117*a*. An individual snaps on one of the snap receptors 117*b* to a snap attachment 117*a* to secure the crib shield. A crib shield with snap attachments 117*a* and 117*b* allows an individual to custom size the crib shield by selecting where to couple a snap attachment to a snap receptor. Of course, one of ordinary skill would recognize there are multiple attachments available and multiple ways to attach the crib liner to the crib.

FIG. 2A shows a first side panel 42 in an unattached laid flat position. Preferably, the first side panel 42 includes a body 46 formed of a breathable material, such as a mesh-type material, that extends along the length (L panel 1) from a first end 48 of the first side panel 42 to a second end 50 of the first side panel 42. The length (L panel 1) of the first side panel 42 is sized for allowing attachment to the side rail 12 of crib 10. For example, the length (L panel 1) may be slightly longer than the distance between spaced-apart side support elements 27, 29 of FIG. 1. In such a manner, the first side panel 42 can be wrapped about side support elements 27, 29 and fastened thereto using hook and loop closures 52, 54, as is further described herein with reference to FIG. 3A.

In some embodiments, the body portion 46 has a width (e.g., W panel 1) that is less than a length (e.g., L support as shown in FIG. 1) of a vertical spaced support element 20 of the first side rail 12. In some embodiments, the width (e.g., W panel 1) is less than one-half the length (L support) of the vertical spaced side support element 20.

Preferably, the crib liner is configured to be secured to a crib such that a portion of the liner, e.g., a bottom border 62, is located approximately between the mattress and the crib, and as such, the breathable material of the liner exposed to an infant in the crib is not significantly reduced by the bottom border 62, which may be composed of less breathable materials. Typically, the bottom border may range from 0.25 inches to 1.5 inches in height. Of course, if the bottom border is above the surface of the mattress, the crib liner is still very breathable. For example, a crib liner that has a bottom border of 1 inches, a middle area of 4 inches of mesh in height and a top border of any length, say for example 10 inches can allow air flow even though the total amount of mesh makes up on 4 inches of the total 15 inches. In other words, only 26.7% of this crib liner is mesh but it is still about 80% mesh where the infant's head is resting during sleep if the bottom border is above the surface of the mattress. In some embodiments, the mesh is provided such that the area of the crib liner proximate an infant's head during sleep is, or is close to, 100% mesh.

Figure 2B:
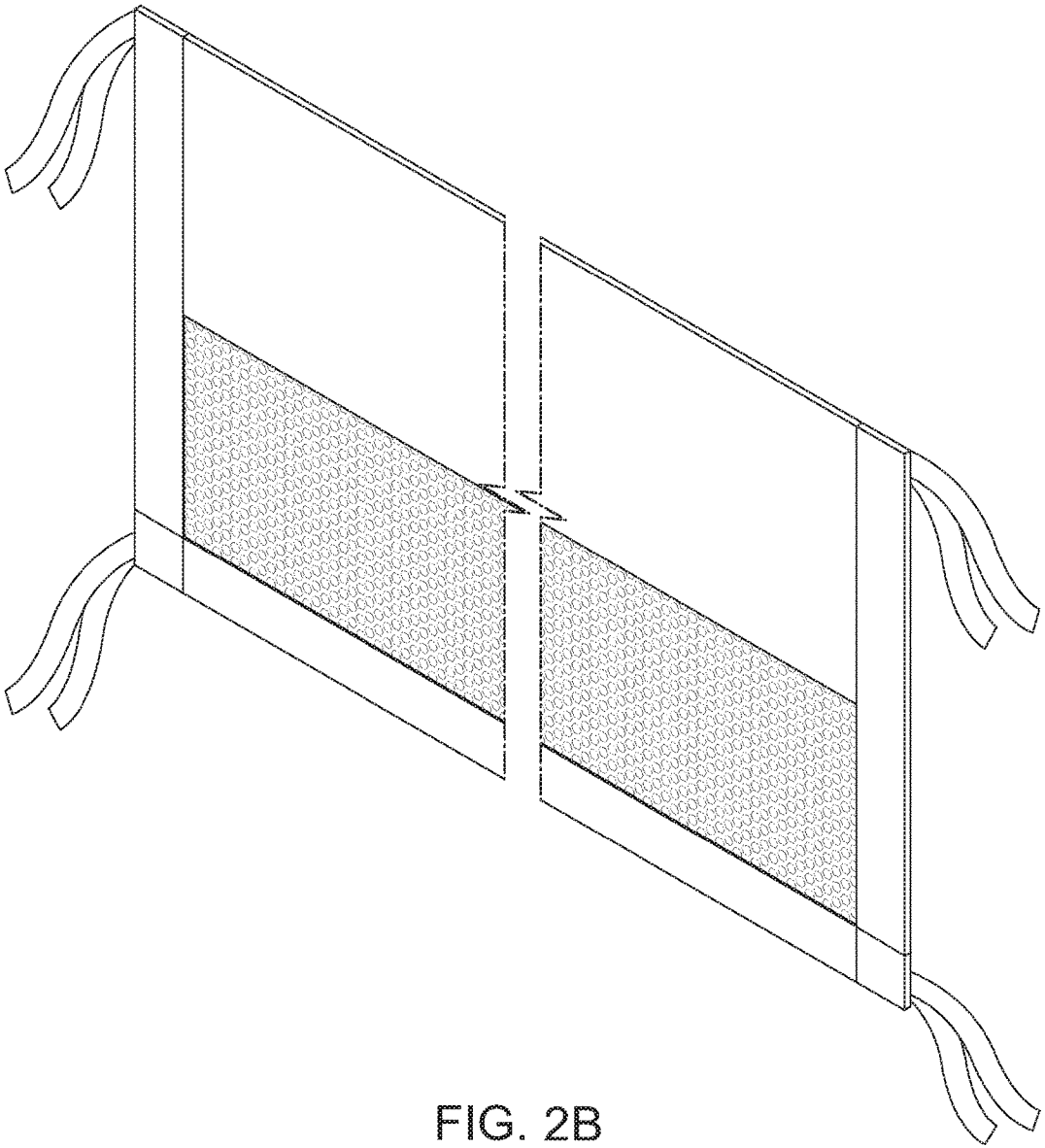
FIG. 2B is a perspective view of an embodiment of a crib liner, according to one example embodiment of the present invention.
Figure 2C:
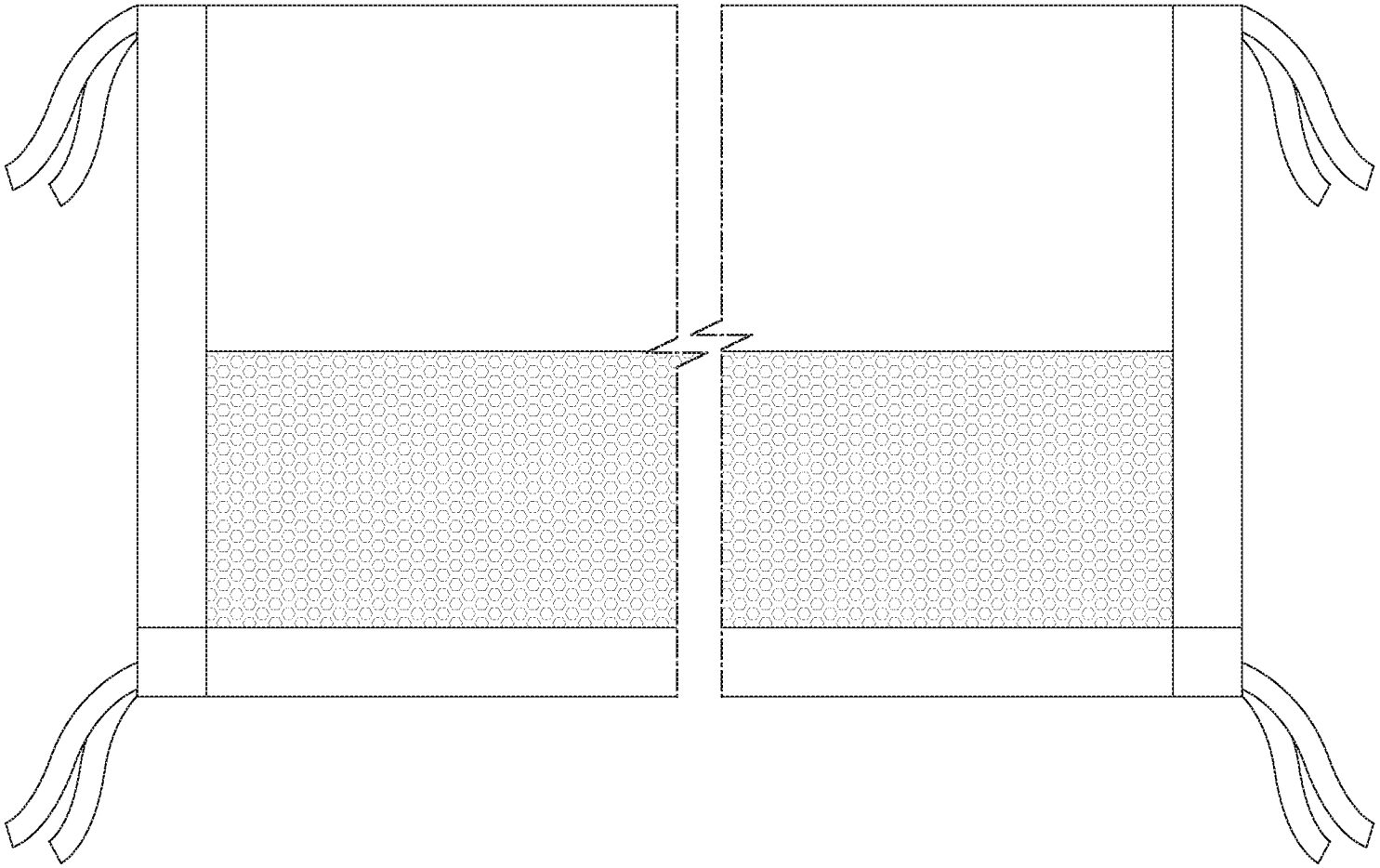
FIG. 2C is a top view of the crib liner of FIG. 2B, according to one example embodiment of the present invention.

In many embodiments, the crib liner is configured to provide breathable material along the four sides of the crib such that the head of an infant lying in the crib is exposed to mainly breathable material regardless of positioning of the infant in the crib. In some embodiments, the panel has an approximately four (4) inch height of breathable material, or greater, above the bottom border 62, such that an infant resting against a side rail or endboard will mainly be exposed to the breathable material. It is less relevant if top and bottom borders are breathable as they are not significantly in the area of the infant's head. Therefore, it is possible for a liner to be 12 or more inches in height as long as there is approximately 3 or 4 inches or more of breathable material in the area of the infant's head when the infant is lying down resting her head against the mattress. In this example embodiment, the mesh may be only 25% of the total height of the liner, but it is a majority mesh near the infant's head where breathability matters most. FIGS. 2B and 2C illustrate such an alternative embodiment wherein the top border is substantially larger in height then the body portion but the crib liner is breathable near the infants head when the infant is lying down resting, even if the bottom border is installed above, or extends above, the surface of the mattress.

In many embodiments, the liner is configured to provide between five inches to eight inches or more of breathable material along the width W of the panel (extending upwardly from the mattress, between the bottom border and the top border). This may also be referred to as a height when considering the liner as deployed in a crib, wherein the breathable body portion of a panel extends for a height of at least 3 inches, at least 4 inches, at least 5 inches, at least 8 inches, at least 10 inches, at least 12 inches, or more up to the entire width of the liner. It should be understood that the portion of breathable material may be determined based upon the average head size of an infant, which may be determined using available Center of Disease Control (CDC) data (e.g., average infant head circumference data). In most embodiments, the width of breathable material is at least the portion that extends from the top edge of the crib mattress and extends upward to the top of an average baby's head. In this area, the liner comprises a majority or more of breathable material.

Returning now to FIG. 2A, the first side panel 42 may include a first fastening apparatus 52 at the first end 48 of the first side panel 42 and a second fastening apparatus 54 at the second end 50 of the first side panel 42. In the embodiment shown, the fastening apparatus 52 includes fastening portions 53, 55, such as hook and loop closures (e.g., Velcro™). In one embodiment, fastening apparatus 54 is the same as fastening apparatus 52, however, such closure structures may also be different.

Various fastening apparatus may be used to attach one or more of the panels of the crib shield system to a crib or similar infant holder. For example, various types of fastening apparatus may include hook and loop closures (e.g., Velcro), snaps, buttons/buttonholes, ties, straps, buckles, zippers, etc. Although hook and loop fasteners are convenient, any other closure or fastener apparatus suitable for attaching panels to crib 10 may be used.

In one embodiment, a finishing edge material 58, or border, is provided along the periphery of the body portion 46. For example, as shown in FIG. 2A, a finishing edge material (e.g., a decorative material) may be used along edges 61-64. The finishing edge typically does not affect the breathability of the liner since it is not in close proximity to the infant's head.

FIG. 2D shows the second side panel 44 in an unattached laid flat position. The second side panel 44 includes a body portion 70 that extends along a length (L panel 2) from a first end 72 thereof to a second end 74 of the second side panel 44. The length (L panel 2) of the second side panel 44 is sized for allowing attachment to footboard 16 and headboard 18 and across side rail 14 of crib 10. For example, the length (L panel 2) is slightly longer than the combined lengths of the three sides of the crib 10 (i.e., the lengths of the footboard 16, headboard 18, and side rail 14). In such a manner, the second side panel 44 can be wrapped about support elements 19, 35 and fastened thereto using hook and loop closures 76, 78, as is further described herein. Further, the second side panel 44 has a width (W panel 2) that, at least in one embodiment, has substantially the same width as the width (W panel 1) of first panel 42.

Second side panel 44 may include fastening apparatus 76 at first end 72 of the second side panel 44 and fastening apparatus 78 at the second end 74 of the second panel 44. Such fastening apparatus 76, 78 may be substantially similar to the hook and loop fasteners described with respect to first panel 42. Further, in a like manner, finishing edge material 80 may be used around the perimeter of the body portion 70 as shown by the finishing material 80 along edges 81-84.

The breathable material of the body portion 46 of first side panel 42 and body portion 70 of second side panel 44 may include any suitable material that provides breathable functionality such as a mesh type material. Breathable functionality refers to the ability of the material to allow air to move effectively therethrough. As used herein, when air is indicated as moving effectively through a material, it is meant that the material includes openings (e.g., mesh openings, open-framework, spaces between elements thereof, or even those that may not be visually perceivable openings but still allow a breathable function to occur) that do not impede air movement to an extent that would prevent a human being from breathing through (e.g., when a human's respiratory openings (e.g., nose/mouth) are in direct contact with a material) such a material in order to help prevent suffocation and further that such openings are too small to permit an infant to insert a finger or toe therethrough. For example, such materials may include cotton, silk, polyester, nylon, modal/semi-cellulose based fabrics, etc.

The first side panel and the second side panel may be removably coupleable to one another. In other embodiments, the first side panel and the second side panel may be fixed together. Further, in various embodiments, more than two side panels may be used.

As discussed above, the breathable material of the body portions of the panels of the crib shield system may comprise a material that is breathable, is air permeable, is light permeable, and has a low $CO_2$ rebreathing value. In various embodiments, the breathable material may have an air permeability of between 385 CFM to 1530 CFM and a light permeability of between 47 and 99%. The specific light permeability level for the crib shield system may vary and may be chosen based on parental preferences. The crib liner may yield $CO_2$ rebreathing values of less than about 20%, less than about 10%, less than about 7%, less than about 5%, or less than about 3%.

The $CO_2$ rebreathing value may be influenced by the tendency for $CO_2$ to become retained within the fibers of the material. This in turn may sometimes be related to the air permeability of the material. Accordingly, in some embodiments, a crib shield system may be provided having a high air permeability and a low $CO_2$ rebreathing value. A mesh material may be useful by also limiting the influence of force (the pressure of an infant's head) against the material to $CO_2$ pushed into the liner. That is, the level of $CO_2$ rebreathing may be largely unchanged with increased force using certain mesh materials. This is thought to result from the lack of effective seal made between the infant's face and the mesh material. Accordingly, a mesh liner as disclosed herein may maintain a stable low $CO_2$ rebreathing value independent of applied force.

In one embodiment, the mesh-type material may include a mesh available from Apex Mills, Inc. under the trade designation TA1 Mesh. However, other various similar mesh materials (e.g., mesh material having suitable openings) are available. A Suffocation Hazard Assessment was performed by RAM Consulting (Oak Brook, Ill.) (e.g., the Assessment is further described herein and for which protocol is available from RAM Consulting) on the TAI Mesh resulting in average readings of 1.6 cm $H_2O$ and, for an upper specification limit of 5 cm $H_2O$, a Z-value of 9.0 was obtained.

In one example embodiment, the breathable material is a breathable generally mesh-type material 300 (e.g., a padded spacer mesh), such as that shown generally in FIGS. 2E-2H. Padding generally refers to a characteristic of the weaving of the mesh and a separate padding need not be applied to the mesh material. The breathable material 300 includes openings 349 on a front substructure 391 thereof, as shown in top view of the material 300 of FIG. 2E. As shown in the cross-section of the breathable padded mesh material 300 in FIG. 2F the material 300 further includes a back substructure 392. The front substructure 391 and the back substructure 392 may be mesh materials. A pile substructure 393 may be integrated with extend between the front and back substructures 391, 392. In some embodiments, the pile substructure is a vertical structure extending from the front substructure to the back substructure as a product of a weaving process. In another embodiment, the pile substructure 393 may be a separate substructure and be attached at certain locations and extend between the front and back substructures. Each of the substructures (e.g., the front, back, and pile substructures) allows air to substantially move effectively therethrough. That is, each of the substructures has air permeability of between 385 CFM to 1530 CFM, or more. Each of the substructures has a $CO_2$ rebreathing value of less than about 20%, less than about 10%, or less than about 5%. It is to be appreciated that the front substructure, back substructure, and pile substructure may alternatively be referred to as a front layer, a back layer, and a pile layer.

The material 300 is further shown in the perspective views of FIGS. 2G-2H. As illustrated, pile substructure 393 may be generally linear (some wave and collapsing may occur) when extending between the front substructure 391 and back substructure 392. This linear configuration generally provides optimal air flow between the front and back substructures. However, in a few alternate embodiments, it may be beneficial to use a pile substructure 393 that is less than linear, whether lofted, matted, and/or bunched fibers. This may be done to improve padding properties, especially with padding that is sufficiently breathable—meaning, that the pile substructure has air permeability, light permeability and $CO_2$ rebreathing values as discussed herein with respect to the material 300. In a few alternate embodiments, the substructure 393 is attached only to the front substructure 391 or the back substructure 392. Of course other breathable materials can be used including a single layer mesh.

Figure 2I:
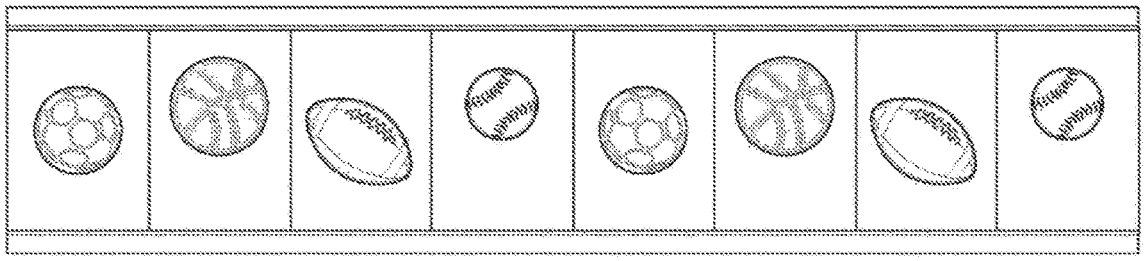
FIGS. 2I-J show illustrations of printed mesh designs for crib liners, according to one example embodiment of the present invention.
Figure 2J:
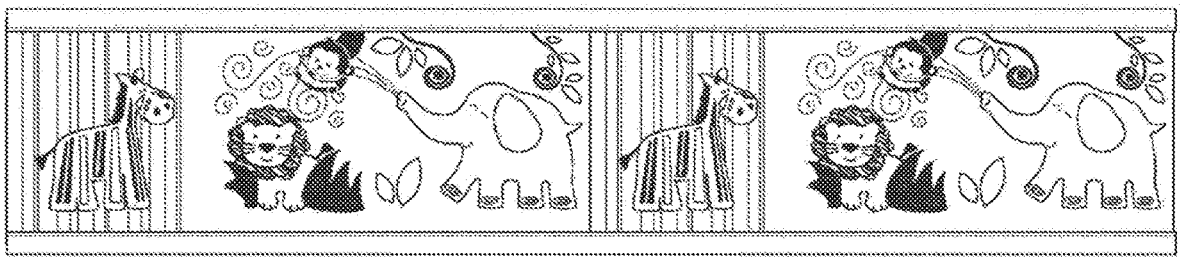

The meshes or other fabrics shown in FIGS. 2A-2H may include designs on the mesh. FIG. 2I shows an illustration of a printed mesh according to one embodiment of the disclosure. FIG. 2J shows an illustration of a printed mesh according to another embodiment of the disclosure. The meshes or other fabrics may also include a variety of mesh designs and types.

It will be recognized that the thickness of the padded mesh material may vary, as well as for other materials described herein. For example, more padding may create a softer more plush effect with slightly different breathability/ventilation properties and more opaqueness (e.g., less light transmissive) whereas less padding may create more breathability and buoyancy with less opaqueness (e.g., more light transmissive). In some embodiments, the panels described herein are at least somewhat transparent such that at least motion of the child in the crib can be seen.

In further embodiments, the padded mesh material if the crib shield system is collapsible. As such, when installed or uninstalled, should a child stand on it, the material will collapse. This reduces the risk of the mesh material being leverage to a climbing infant (unlike most conventional bumpers).

The breathable material may be a woven polymeric fiber mesh material that is integrated with or attached to a front and/or back substructure 391, 392. Both the front substructure 391 and the back substructure 392 may comprise openings. In some embodiments, the front substructure 391 may include larger openings than the back substructure 392. In one example embodiment, the padded mesh material 300 may comprise front and back substructures 391, 392 with fibers of the pile substructure 393 woven therethrough, as shown in FIG. 2D-F. In another embodiment, the breathable material may be integrated by sewing, or otherwise attaching, the padded mesh material 300 between a front and back substructure or other substructures (not shown). That is, in this embodiment the padded mesh material is integrated by attaching to other materials, such as breathable materials or pad materials, to form a multi-layer structure (not shown). The multi-layer structure may be, for example, laminated or quilted.

In one embodiment, for example, the breathable padded mesh material 300 may include a padded spacer mesh available from Apex Mills, Inc. under the trade designation DNB27 Spacer Mesh. However, other various similar padded spacer mesh materials are available.

In another embodiment, the mesh-type material is a breathable padded mesh material in combination with one or more other material layers. For example, the breathable padded mesh material may be used in combination with one or more layers of other material adjacent to (e.g., one material laid flat against the other) either the front substructure and/or the back substructure of the breathable padded mesh material. In various embodiments of such a combination, one or more layers of material may be used substantially adjacent the front substructure, one or more layers of material may be used substantially adjacent the back substructure, or one or more layers of material may be used substantially adjacent both the front substructure and the back substructure. For example, such additional layers may be layers of cotton material, knit jersey material, etc. Such additional material layers may provide additional benefits such as, for example, thermal properties with breathability.

In some embodiments, the mesh material may have functional properties. Accordingly, in some embodiments, the liner may comprise a functional fabric having air permeability of between 385 CFM and 1530 CFM, a light permeability of between 47 and 99%, and a $CO_2$ rebreathing value of less than 20%. The functional fabric may at least partially blocks a hazard from penetrating the crib liner. Such hazard may be any hazard now known or later discovered to be hazardous to an infant including, but not limited to, mold, mildew, allergens, heat, ultraviolet light (UV), and electric and magnetic forces (EMF). In other embodiments, the functional fabric may at least partially block any undesirable element from penetrating the crib liner, regardless of whether such element poses a hazard. This may be provided by, for example, applying a functional coating to one or more of the substructures or adding a functional threading through one or more of the substructures.

Further, for example, the breathable material, such as breathable material 300 of FIG. 2F, when used alone, or in combination with one or more additional layers, may form a breathable material (e.g., a breathable padded mesh material, such as a spacer mesh, with layers) that has a suffocation resistance level of less than about 15 cm $H_2O$, and preferably less than about 5 cm $H_2O$. Suffocation resistance as referred to herein may be determined according to the RAM Consulting Virtual Child Suffocation Hazard Assessment Model, which is a physical model and testing methodology that quantitatively assesses the potential suffocation hazards posed by various types of materials. The details of this model are available from RAM Consulting (Oak Brook, Ill.). Further, according to this model, Z-values are determined that are statistical measurement tools that describe and predict product performance in relation to its specification limit (e.g., such as those described below). For example, the suffocation resistance limit of 5 cm $H_2O$ is an upper specification limit for materials or products that foreseeably are used and/or intended for young infants with high accessibility; and further, the suffocation resistance limit of about 15 cm $H_2O$ is an upper specification limit for other materials or products (e.g., those for toddlers). A Z-value of 4.0 or greater with the corresponding upper specification limit for each applicable testing technique is required for a product to be classified as a very low suffocation risk. The details regarding the determination of Z-values are available from RAM Consulting (Oak Brook, Ill.).

Suffocation Hazard Assessment was performed by RAM Consulting (Oak Brook, Ill.) on various configurations of crib shield systems disclosed herein using the breathable padded mesh material available from Apex Mills, Inc. under the trade designation DNB27 Spacer Mesh.

1 Configuration 1: Single Layer of Padded Spacer Mesh Configuration 2: Layer 1: Padded Spacer Mesh Layer 2: Cotton Configuration 3: Layer 1: Knit Jersey Layer 2: Padded Spacer Mesh Layer 3: Cotton Configuration 4: Layer 1: Cotton Layer 2: Padded Spacer Mesh Layer 3: Cotton Configuration 5: Layer 1: Knit Jersey Layer 2: Padded Spacer Mesh Layer 3: Knit Jersey Configuration 6: Layer 1: Padded Spacer Mesh Layer 2: Flannel Fabrics tested: Knit Jersey Manufacturer: NATEX Content: 50% Polyester/50% Cotton Knit Jersey Style #: INT Cotton Manufacturer: SOUTHERN BELLE Content: 100% Cotton Style #: L93N67 Flannel Manufacturer: QUELTERS CORNER Content: 100% Cotton Style #: RN41324.

A screening was performed on all configurations in both a dry and wet state. The spacer padded mesh when layered with fabrics, including knit jersey, flannel, 50% polyester/50% cotton, and cotton, resulted in a satisfactory reading based on values in cm $H_2O$, wherein the specification upper limit for products young children are intended to lie on is equal to 5 cm $H_2O$ (e.g., mattress pads or items young infants are intended to have their face on) and wherein the specification for products young children are not intended to lie on is equal to 15 CM $H_2O$.

Four individual readings were performed with an average being determined. Dry state readings did not register, thus presenting very low hazard when the configurations were dry (i.e., under the 5 cm $H_2O$ specification limit). In the wet state (after application of 8 ml of sprayed on water), the average readings for the configurations were between 4.6 cm $H_2O$ and 6.2 cm $H_2O$.

For an individual single layer of spacer padded mesh, comprising a front substructure, a pile substructure, and a back substructure, average readings of 1.7 cm $H_2O$ were taken. Further, for an upper specification limit of 5 cm 1120, a Z-value of 9.5 was obtained.

As shown in FIG. 1A, according to one example embodiment, the first side panel 42 is attached to first side rail 12 by wrapping first end 48 of the first spacer panel 42 about spaced side support element 27 and mating the hook and loop fastener portions 53, 55 as shown in FIG. 3A. The second end 50 of first spacer panel 42 is wrapped around side support element 29 and fastening apparatus 54 is used to hold the first side panel in place. For example, in one embodiment, the fastening apparatus 54 is attached to the side support element 27. Thereafter, the user pulls the panel taut across the plurality of spaced side support elements 20 by pulling on the second end 50 containing the fastening apparatus 54. Fastening apparatus 54 is the attached to support element 29 in such a manner to hold the taut panel in place. As such, the first side panel 42 is prevented from slipping after being attached to the spaced side support elements 27, 29. Of course other suitable methods of using the liner are contemplated.

In at least one embodiment, the first side panel 42 is configured to cover at least a portion of the first side rail 12 and to extend along the length of the crib 10. As used herein when a panel extends along the length of the crib 10, it will be recognized that the panel may not extend completely along the entire length, but may end proximate the headboard and footboard. For example, depending upon the fastening techniques used, the panel may be attached a short distance from the corners of the crib (see panel 42 as shown in FIG. 1A).

In a like manner, second side panel 44 is attached to the crib 10. FIG. 2D illustrates the body portion 70 of the second side panel 44 having a first end 72 and a second end 74. A fastening apparatus 78 (e.g. hook and loop closures) may be provided to fasten the second end 74 to the crib. For example, as shown in FIG. 1A, the second end 74 of the second side panel 44 is wrapped about spaced support element 35 of headboard 18. Fastening apparatus 78 (e.g., hook and loop closures) is used to fasten the second end 74 about the support element 35.

Further, as shown in FIG. 1A, the body portion 70 of the second side panel 44 is fed to the inside of the crib 10 (e.g., to the inside portions of support elements 34) and thereafter fed to the outside of the crib 10 and around corner 36. The body portion 70 is continued to be fed back into the inside of the crib 10 (e.g., to the inside of the support elements of the second side rail 14) and thereafter fed once again to the outside of the crib 10 and around corner 31 (see FIGS. 3B-3C). Thereafter, the body portion 70 of the second side panel 44 is fed to the inside of the crib 10 once again at the footboard 16 and then wrapped around support element 19 of footboard 16 in a similar manner to the fastening of the second side panel 44 around support element 35 of headboard 18.

One will recognize that the second side panel may be attached to any number of different support elements, may be fed around and/or to the outside of one or more spaced support elements, and, as with the first side panel 42, is pulled taut prior to fastening to keep the second side panel 44 in position. Further, the weaving of the second side panel 44 around the corners and/or around one or more of the spaced support elements also assists in maintaining the second side panel 44 in position (e.g., in a position higher on the crib 10 when the mattress is raised relative to the floor and lower in the crib 10 when the mattress is lowered to the floor). In addition, any of the panels may be positioned such that a portion of the panel is below the upper surface of the mattress (e.g., a few centimeters below the surface along the side of the mattress) to assist in securing the crib and preventing arms and legs from going under the panel.

In another embodiment, the crib shield system may comprise a single side panel such as shown in FIG. 1B. As contemplated herein, the crib shield system or crib liner may be one or more panels and may or may not include a bottom panel (that lies under the mattress). As shown in FIG. 1B, the crib 10 is substantially the same as that shown in FIG. 1A except that the side rail 12 is fixed and cannot be lowered or raised.

The single side panel 111, as shown in FIG. 1B and with reference to FIG. 2D, includes a body portion 70 that extends along a length (L panel 3) from a first end 72 thereof to a second end 74 of the single side panel 111, in a like manner with the second side panel 44 in FIG. 2B. The length (L panel 3) of the single side panel 111 may be sized for allowing attachment to footboard 16 and headboard 18 and across side rail 12 and 14 of crib 10. For example, the length (L panel 3) is slightly longer than the combined lengths of the four sides of the crib 10 (i.e., the lengths of the footboard 16, headboard 18, side rail 12, and side rail 14). In this embodiment, the single side panel 111 may be wrapped about support elements 35, installed along all four sides of the crib, and fastened to support elements 27 using hook and loop closures, as shown in FIG. 3A. Further, the single side panel 111 may have a width (W panel 3) that, at least in one embodiment, may have substantially the same width as the width (W panel 1) of first panel 42 of FIG. 2A.

As shown in FIGS. 1B-1C, single side panel 111 may include fastening apparatuses 110*a-c* at first and second ends of the single side panel 111. Such fastening apparatuses 110*a-c* may be substantially similar to the hook and loop fasteners described with respect to first panel 42. In alternative embodiments, other fastening apparatuses may be used. In one embodiment, finishing edge material 80 may be attached around the perimeter of the body portion 70 as shown by the finishing material 80 along edges 81-84.

In one embodiment, the single side panel 111 may be attached to headboard 18 by wrapping first end 72 of the single side panel 111 about spaced side support element 35 and mating the hook and loop fastener portions 110*a-c*, as shown in FIG. 3A.

Further, as shown in FIG. 1B, and with reference to FIG. 1A, the body portion 70 of the single side panel 111 may be fed to the inside of the crib 10 (e.g., to the inside portions of support elements 34) and thereafter fed to the outside of the crib 10 and inside corner 36. The body portion 70 may be continued to be fed back into the inside of the crib 10 (e.g., to the inside of the support elements of the second side rail 14) and thereafter fed once again to the outside of the crib 10 and inside corner 31 (see FIGS. 1A, 1B, 1C). Thereafter, the body portion 70 of the single side panel 111 may be fed to the outside of the crib 10 once again at the footboard 16 and then fed inside of corner 33 to the inside of the crib 10 (e.g., to the inside portions of support elements 20). Finally, the second end 74 of single side panel 111 may be wrapped around side support element 27 and fastening apparatus is used to hold the single side panel in place. Thereafter, the user may pull the panel taut across the plurality of spaced side support elements on all four sides of the crib by pulling on the second end 74 containing the fastening apparatus. Fastening apparatus may be attached to support element 27 in such a manner to hold the taut panel in place. The single side panel 111 may be deterred from slipping after being attached to the spaced side support elements 35, 27.

Figure 4A:
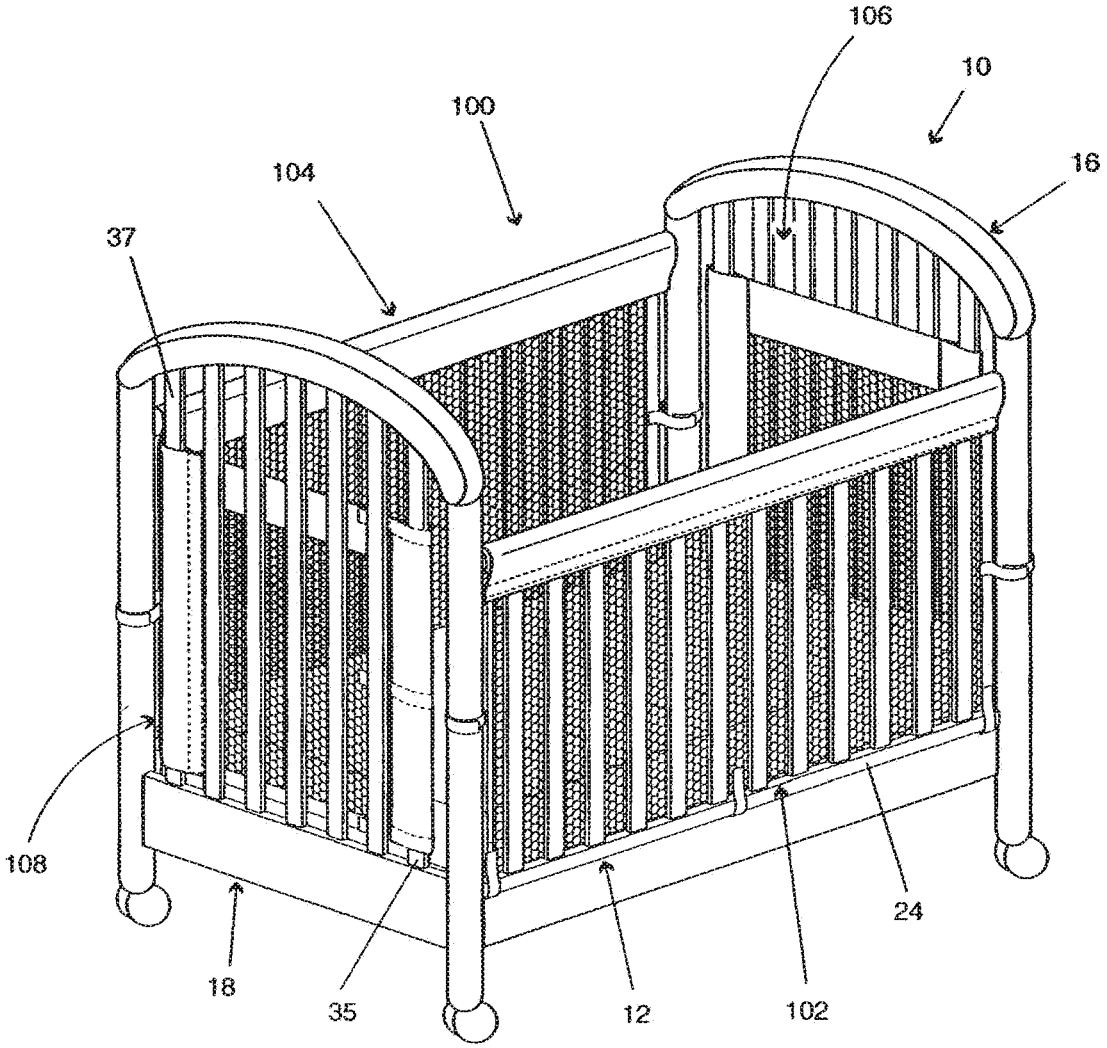
FIG. 4A is a perspective view of a full crib shield system attached to a crib with the mattress of the crib in a lowered position, according to one example embodiment of the present invention.

As shown in the exemplary embodiment of FIG. 4A, the crib 10 is substantially the same as that shown in FIGS. 1A-1C except that the mattress (26 in FIG. 1A) is in a lowered position. As shown in FIG. 4A, the side rail 12 is a side rail that can be lowered or raised. Like the crib shield system 40 in FIG. 1A, the illustrated embodiment of crib shield system 100, shown in FIG. 4A, allows the side rail 12 to be moved even with the crib shield system 100 attached to crib 10.

The illustrated embodiment of crib shield system 100 includes a first side panel 102 and a second side panel 104 for attachment to respective side rails 12, 104. Further, the crib shield system 100 includes a first end panel 106 for attachment to the footboard 16 and a second end panel 108 for attachment to the headboard 18.

Figure 4B:
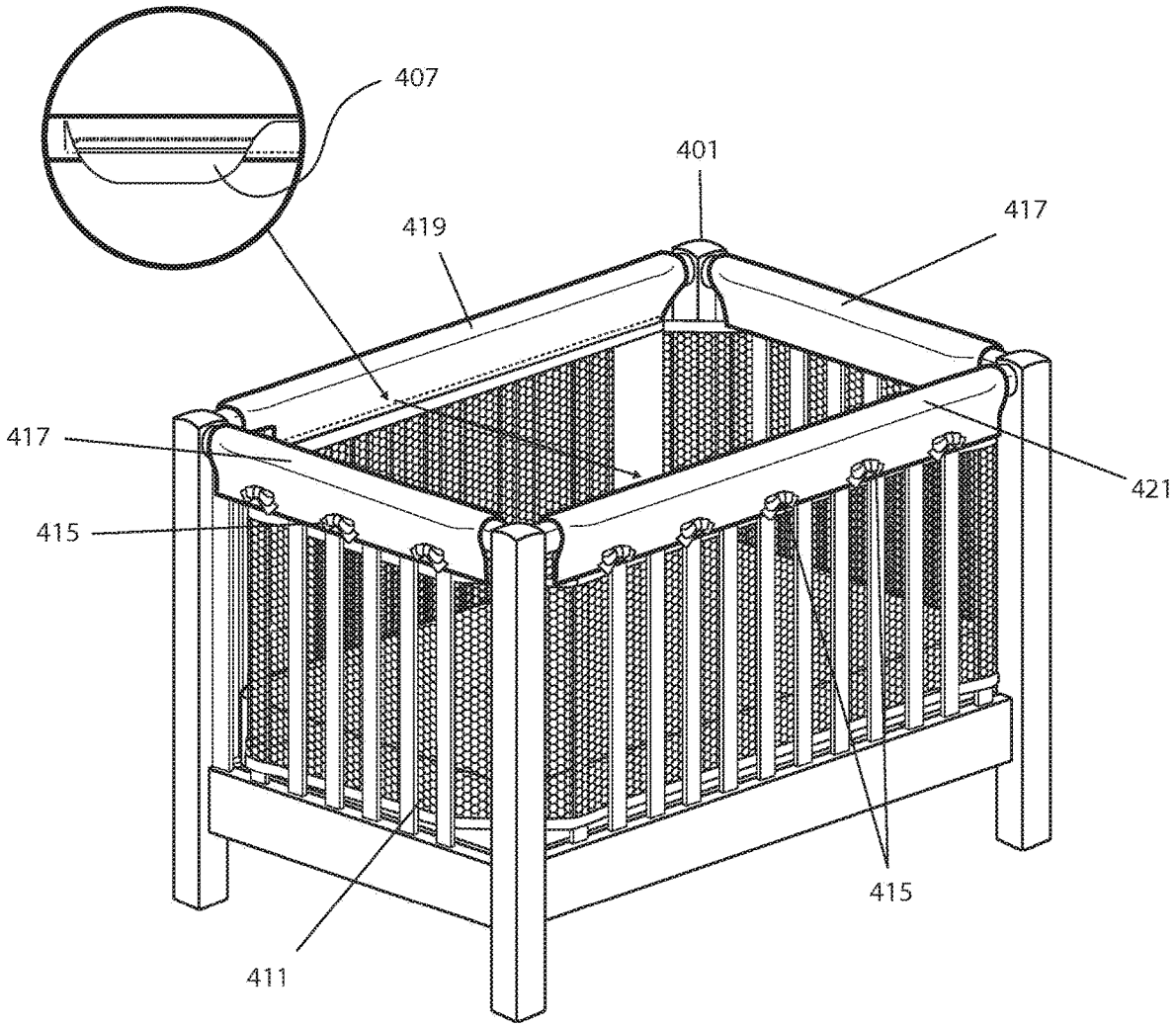
FIG. 4B is a perspective view of a full crib shield system attached to a crib, according to another example embodiment of the present invention.

FIG. 4B shows a perspective view of another embodiment of a full crib shield system attached to a crib. A mesh 411 extends around a crib 401. A number of ties 415 attach side rail covers 417, a back rail cover 419, and a front rail cover 421 to the mesh 411. A hidden zipper (not shown) may attach a front side of the rail covers 417, 419, and 421 to the mesh 411. The hidden zipper may be concealed by a flap 407, such as in a gusset pocket. In some embodiments, the rail covers 417, 419, and 421 may be available as upgrades to a basic mesh crib liner 411. The rail covers 417, 419, and 421 may be a solid color or may include patterns. The rail covers 417, 419, and 421 may be made of washable material with quick drying capability.

Figure 5A:
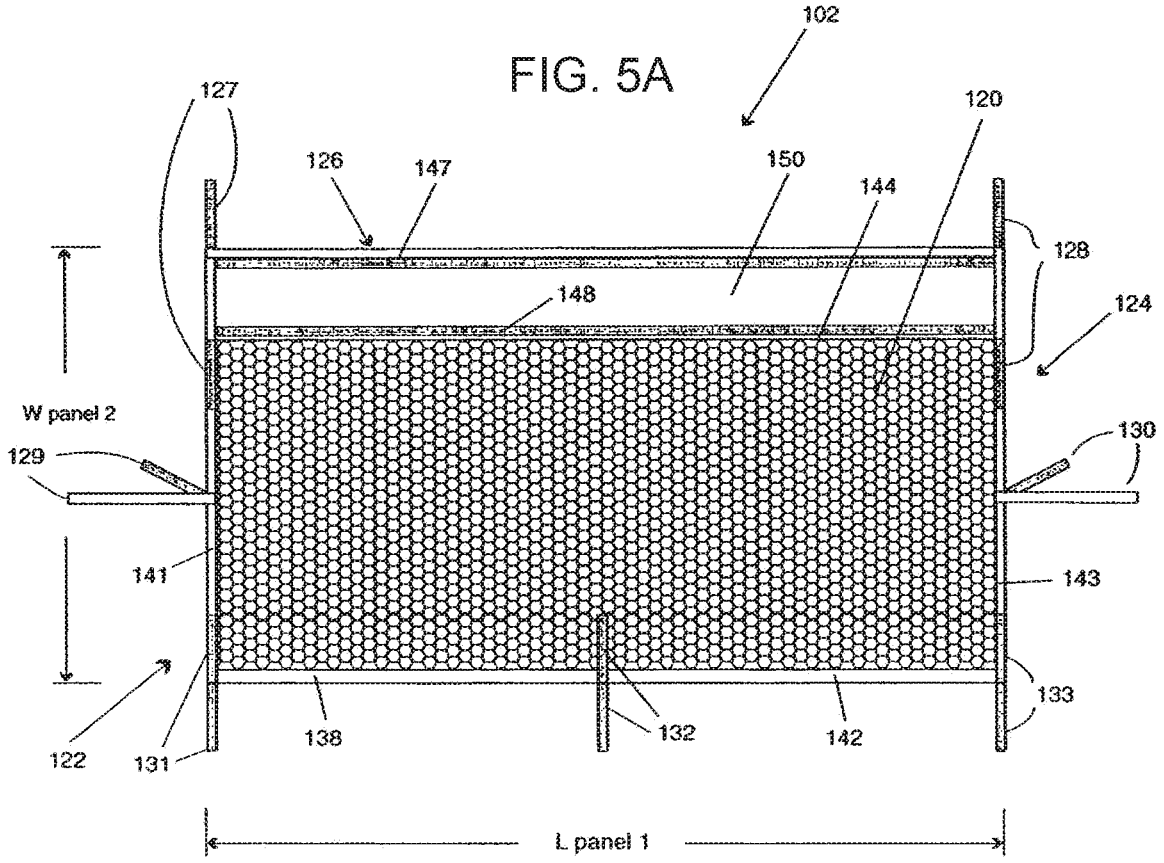
FIG. 5A is a top view of a side panel for use in the full crib shield system shown in FIG. 4A in an unattached position laid flat, according to one example embodiment of the present invention.

FIG. 5A shows a first side panel 102 of an exemplary crib shield system 100 in an unattached laid flat position. The first side panel 102 includes a body portion 120 formed of a mesh-type material. In one embodiment, the mesh-type material is an open framework material that includes openings too small to permit an infant to insert a finger or toe therethrough. However, any breathable material known to a person of ordinary skill in the art may be used, such as the breathable materials described herein. The mesh material has an air permeability of between 385 CFM to 1530 CFM, a light permeability of between 47 and 99%, and $CO_2$ rebreathing values of less than about 20%.

The body portion 120 extends along a length (L panel 1) extending from a first end 122 of the first side panel 102 to a second end 124 thereof. Further, the laid flat first side panel 102 has a width (W panel 1) that is sized to cover at least a majority portion of side rail 12. However, the first side panel may cover less than a majority portion.

The first side panel 102 further includes a fastening apparatus 126 that extends along an entire edge 144 of the side panel 102 for use in attaching the side panel 102 to the top bar 22 of the side rail 12, as is shown in further detail in FIGS. 6A-6D. The fastening apparatus 126, at least in one embodiment, includes first and second fastening portions 147, 148 that are configured for mating with one another in order to hold the first side panel 102 in a fixed position relative to side rail 12.

In various embodiments, the fastening apparatus 126 may be a series of straps or ties intermittently disposed along the edge 144 of the side panel 102 for use in attaching the side panel 102 to the top bar 22 of the side rail 12. Each of the straps or ties of fastening apparatus 126, at least in one embodiment, includes first and second fastening portions 147, 148 that are both for mating with one another in order to hold the first side panel 102 in a fixed position relative to side rail 12.

Figure 6A:
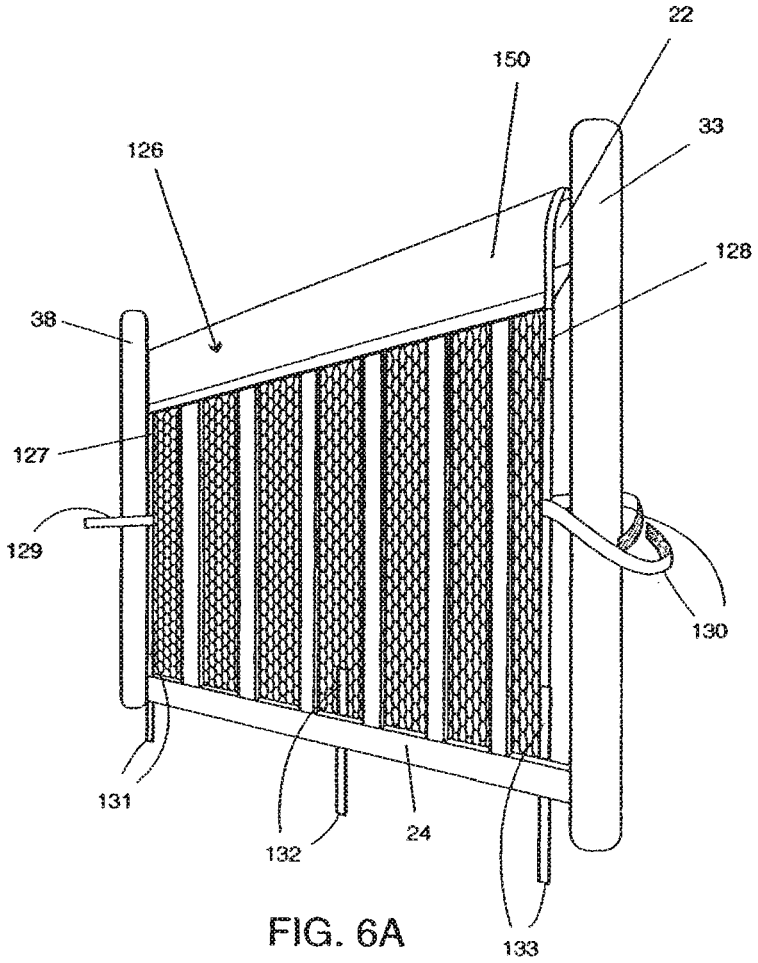

As shown in FIG. 6A, the exemplary fastening apparatus 126 may include a padded portion 150 that is wrapped around top rail 22 such that first and second fastening portions 147, 148 (shown in FIGS. 6C, 6D) can be placed in contact with one another. As a result, the padded portion 150 covers the top bar 22 of the side rail 12. With use of the fastening apparatus 126 that extends along the entire edge 148 of the first side panel 102, the first side panel 102 can be fixed in a stable position with respect to side rail 12. For example, the first side panel 102 can be fixedly positioned to prevent movement thereof relative to the side rail 12 using one or more other various fastening apparatus.

In another embodiment, the padded portion 150 may be removably attached to the fastening apparatus 126. For example, the padded portion 150 may comprise a strip of padded material with one fastening side, the fastening side designed to be removably attached to the fastening apparatus 126 using hook and loop fasteners, snaps, zippers, or other appropriate fastening apparatus. The padded material may be any suitable material, not just the aforementioned mesh-type material.

For example, as shown in FIG. 5A, closures 127-128 provide for additional affixing functionality about a top bar of the crib. In addition, closures 129-130 assist in affixing the first side panel 102 to corners of the crib. Yet further, for example, a plurality of closures 131, 132, and 133, located opposite the edge 144 can be used to attach the first side panel 102 to a bottom bar 24 of the side rail such that the panel 102 is held in a taut manner across the plurality of support elements 20.

FIG. 5B shows a back side of a liner of a crib shield system according to one example embodiment. A crib shield 102 may include one or more ties 115 along a top end of the crib shield 102. The ties 115 may allow connection of the crib shield 102 with a rail cover described below with reference to FIG. 5D. Although not shown, ties may also be provided at a bottom end of the crib shield 102. The crib shield 102 may also include a number of nook and loop fasteners 113 including hooks 113*a*, 113*b*, and 113*c*, and loops 113*d*, 113*e*, and 113*f* The loops 113*d*, 113*e*, and 113*f* may extend around a support structure (not shown), such as a crib, and couple to the hooks 113*a*, 113*b*, and 113*c*. It is to be appreciated that the hooks and loops may be provided interchangeably.

FIG. 5C shows a front side and several magnified views of a side panel for use in a crib shield system according to the present invention. The crib shield 102 of FIG. 5C is shown facing an inside of a crib. In one embodiment, the crib shield 102 may have a size of approximately 128 inches by approximately 19.5 inches, although various sizes may be configured to fit different crib sizes and shapes. A fastener 105*a* may couple the crib shield 102 to a front/back crib rail cover 103 through a fastener 105*b*. The cover 103 may have a size of approximately 46 inches by approximately 14 inches. The fasteners 105*a* and 105*b* may be halves of a zipper and the zipper pull located on one or the other of fastener 105*a* and 105*b*. For example, the rail cover 103 may include the zipper pull 105*b*, such as a dual separating zipper, which may be opened or closed from either end. A flap 107 may extend over the fastener 105*a* to conceal the zipper. Although a zipper is illustrated connecting the crib shield 102 and the rail cover 103, other fasteners such as buttons, snaps, and ties are possible. A second rail cover may be used for sides of a crib. FIG. 5D shows a side view of a second crib rail cover 107. The cover 107 includes ties 115 for coupling to the ties 115 of the crib shield 102 illustrated in FIG. 5B.

The rail cover 103 may include multiple layers of material. FIG. 5E such a multi-layered rail cover. As shown, the cover 103 may include an outer layer 151 such as mesh fabric, a middle layer 153 such as a padded filler, and a bottom layer 155 such as a waterproof layer, allergen-blocking layer, or other fabric. The cover 107 may have a size of approximately 27 inches by approximately 14 inches.

One skilled in the art will recognize that many types of closures may be used to provide the attachment functionality, such as those described previously herein with respect to crib shield system 40. In one particular embodiment, all of the closures are provided with hook and loop fasteners (e.g., Velcro fasteners). In such a manner, no ties are necessary.

FIGS. 6A-6F show further detail illustrating the attachment of the first side panel 102 to the crib 10. Element numbers used in the figures are to be ascribed the meaning used for the same element numbers in other figures.

FIG. 6A shows the fastening apparatus 126 wrapped around a top bar 22 of the crib and, in particular, a closure 130 wrapped around post 33 but not yet in a closed position.

Figure 6B:
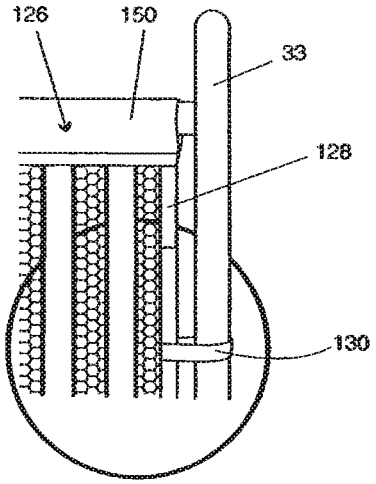

FIG. 6B shows the closure 130 in a wrapped around configuration and closed (e.g., the hook and loop fasteners in direct contact with one another and providing attachment to corner post 33).

FIG. 6C shows the fastening apparatus 126 in further detail, including fastening portions 147-148 and closure 127 in a partially unattached configuration.

FIG. 6D shows a cross-section view of the top bar 22 having the padded rail cover portion 150 wrapped therearound.

FIG. 6E shows one of the bottom closure strap attachments 133 used to wrap around bottom bar 24. The strap attachment 133 is shown in a partially closed position with a part of the hook and loop fasteners in direct contact.

FIG. 6F shows a cross-section of the bottom bar 24 having strap attachment closure 133 wrapped therearound and in a fastened configuration.

It will be readily understood that second side panel 104 is substantially similar to that of first side panel 102. In addition, the attachment of second side panel 104 to side rail 14 is performed in substantially the same manner as the attachment of first side panel 102 to side rail 12 of crib 10.

Figure 7A:
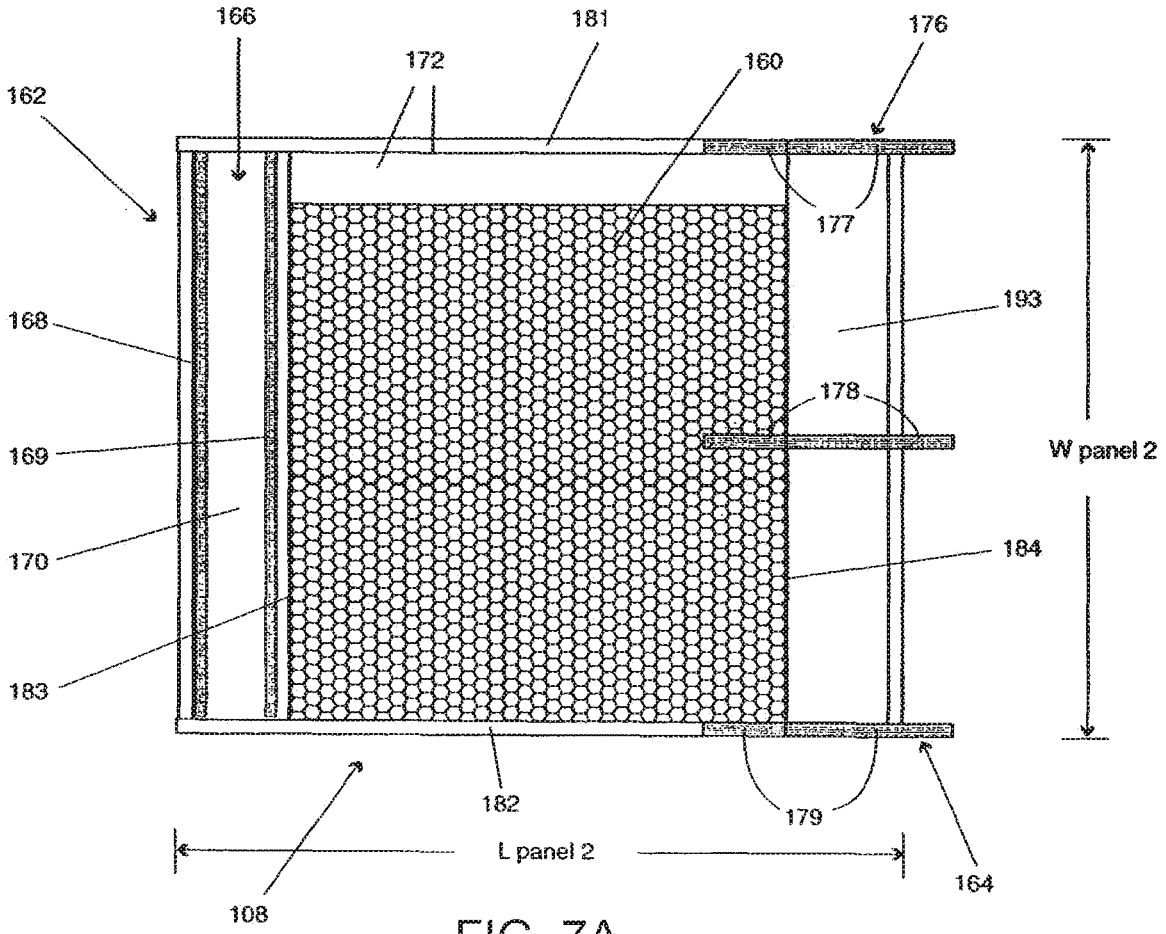
FIG. 7A is a top view of an end panel for use in the full crib shield system shown in FIG. 4A in an unattached position laid flat, according to one example embodiment of the present invention.

FIG. 7A shows an exemplary end panel 108 in an unattached laid flat position. The end panel 108 includes a body portion 160 of mesh-type material, such as that described with respect to first side panel 102, which extends along a length (L panel 2) from a first end 162 to a second end 164 of the end panel 108. Further, the end panel 108 has a width (W panel 2) that along with length (L panel 2) is sized to cover a substantial portion of headboard 18. The end panel 108 includes fastening apparatus 166, for example, along the all or substantially all of edge 183 of the body portion 160 for use in attachment of the end panel 108 to a support element 37 of the headboard 18. The fastening apparatus 166 includes fastener portions 168-169 and a body portion 170. The body portion 170 is wrapped around the support element 37, as shown in further detail in FIG. 8, with the fastener portions 168, 169 placed in direct contact with one another to provide attachment of the end panel 108 to the headboard 118. The fastener portions 168, 169 may be hook and loop fasteners to provide a consistent closure along the entire width (W panel 2).

At least one other fastening apparatus, such as fastening apparatus 176, may be provided at one or more positions along an edge 184 opposite edge 183 to allow a user to pull the panel taut across the headboard 118 when fastening apparatus 166 has been attached to support element 37. Such fastening apparatus 176 can be thereafter used to secure the end panel 108 around support element 35 and maintain the end panel 108 in a taut position adjacent the support elements 34. In one embodiment, the fastening apparatus 176 includes hook and loop fasteners 177, 178, 179 positioned along edge 184 using a body of material 193 that can be wrapped about support element 35.

Figure 7C:
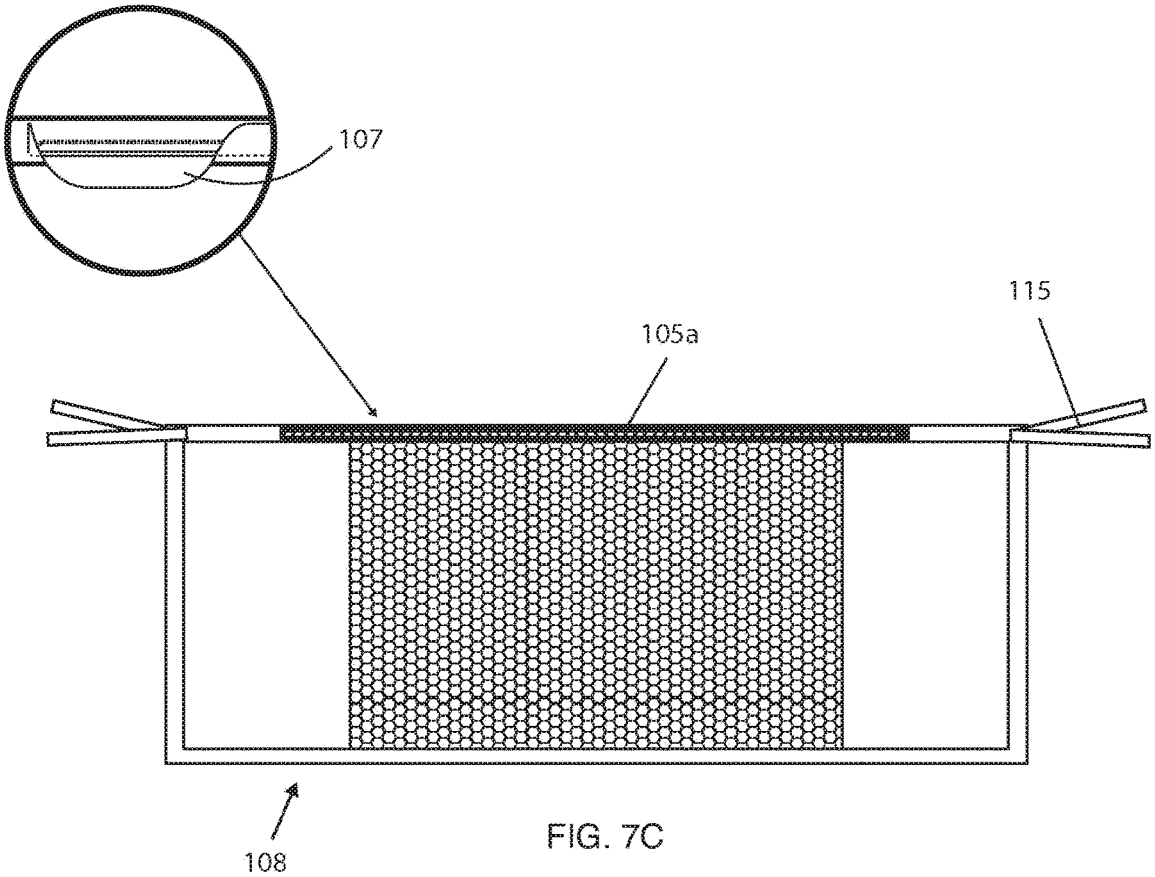
FIG. 7C is a front side of a back panel wrap for attaching to a rail cover, according to one example embodiment of the present invention.
Figure 7B:
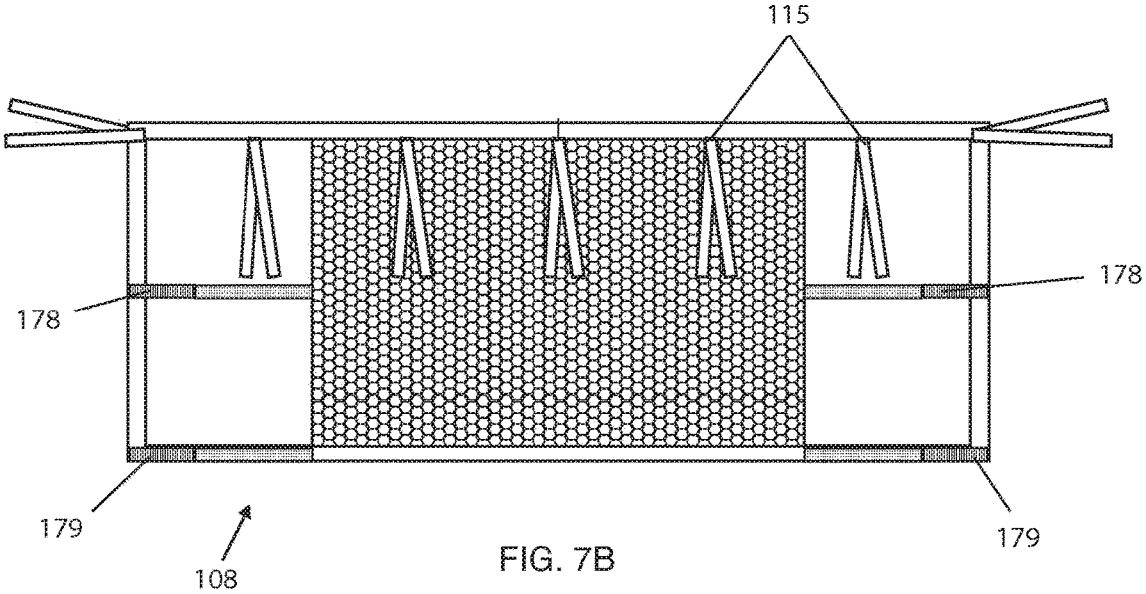
FIG. 7B is a back side of a back panel wrap for attaching to a rail cover, according to one example embodiment of the present invention.

FIG. 7B shows a back side of a back panel wrap for attaching to a rail cover in accordance with one embodiment. The short back panel 108 may include a number of ties 115 for coupling to a rail cover. The short back panel 108 may also include a number of hook and loop fasteners 178 and 179.

FIG. 7C shows a front side of a back panel wrap for attaching to rail cover in accordance with one embodiment. The front side of the short back panel 108 may face an inside of a crib. The back panel 108 may include a receptor 105*a* for coupling to a rail cover. The receptor 105*a* may be, for example, one half of a zipper or one half of a zipper with a zipper pull. The flap 107 may conceal the receptor 105*a*. The back panel 108 may have a size of approximately 56 inches by approximately 22 inches.

Figure 8:
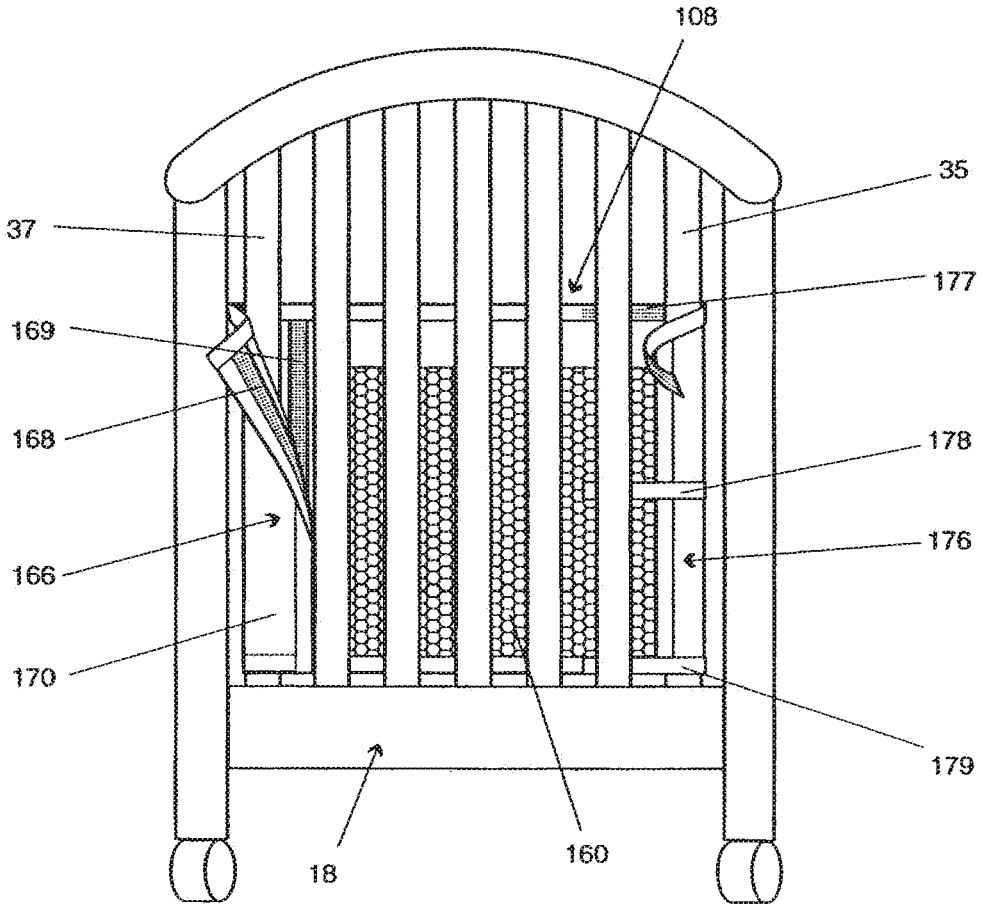
FIG. 8 is an illustration for attachment of the end panel shown generally in FIG. 7A to a headboard or footboard of a crib, according to one example embodiment of the present invention.

FIG. 8 illustrates attaching the end panel 108 to headboard 118 in accordance with one embodiment. As illustrated, closure 177 is in an unattached configuration, whereas closures 178, 179 are in a fastened configuration. Likewise, fastening apparatus 166 along the first end 162 of the end panel 108 is shown in a partially fastened configuration.

It will be readily understood that a second end panel 106 may be substantially similar to that of first end panel 108 and placed opposite the first end panel 108. The attachment of second end panel 106 to the footboard 16 may be performed in substantially the same manner as the attachment of first end panel 108 to headboard 18 of crib 10.

Both the side panel 102 and the end panel 108 may be provided with associated finishing material for functional or decorative purposes (e.g., to prevent the fraying of mesh material of body portion 120, to provide further padding, etc.). For example, as shown in FIG. 5A, finishing edge material 138 may be used along edges 141, 142, 143. Likewise, as shown in FIG. 7A, finishing material 172 may be used along edges 181-182. Further, it will be recognized by one skilled in the art that various types of materials may be used along the edges and in combination with various fastening apparatus for attaching the panels to the crib 10. However, preferably, the exposed portions of the panels (e.g., exposed to a child in the crib) are formed of the mesh-type material, while the finishing edge material may be less breathable.

In another embodiment, the crib shield system may comprise a crib liner with two side panels 106, 108, two end panels 102, 104, and a bottom panel 428, where the side and end panels are attached to the bottom panel.

Figure 9A:
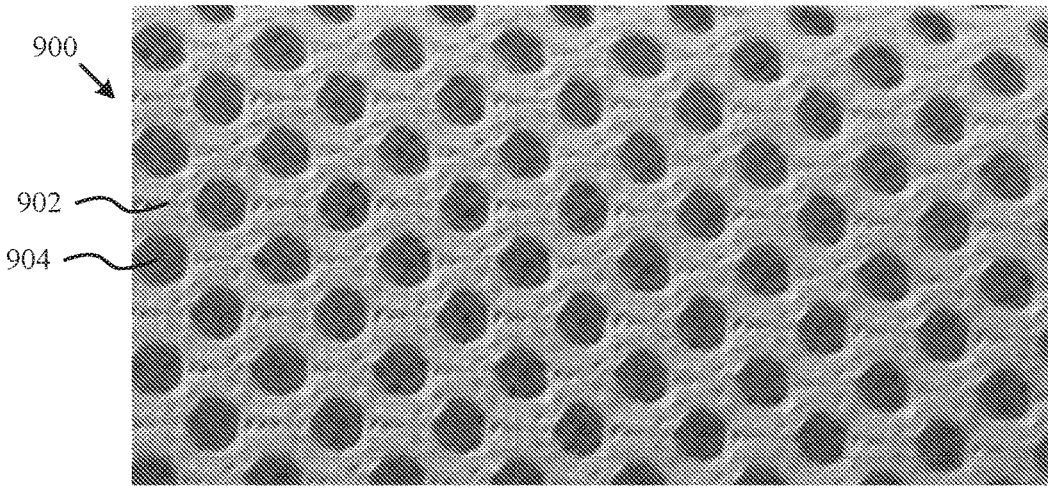
FIGS. 9A-9C show illustrations of an exemplary breathable material, according to one example embodiment of the present invention.
Figure 9B:
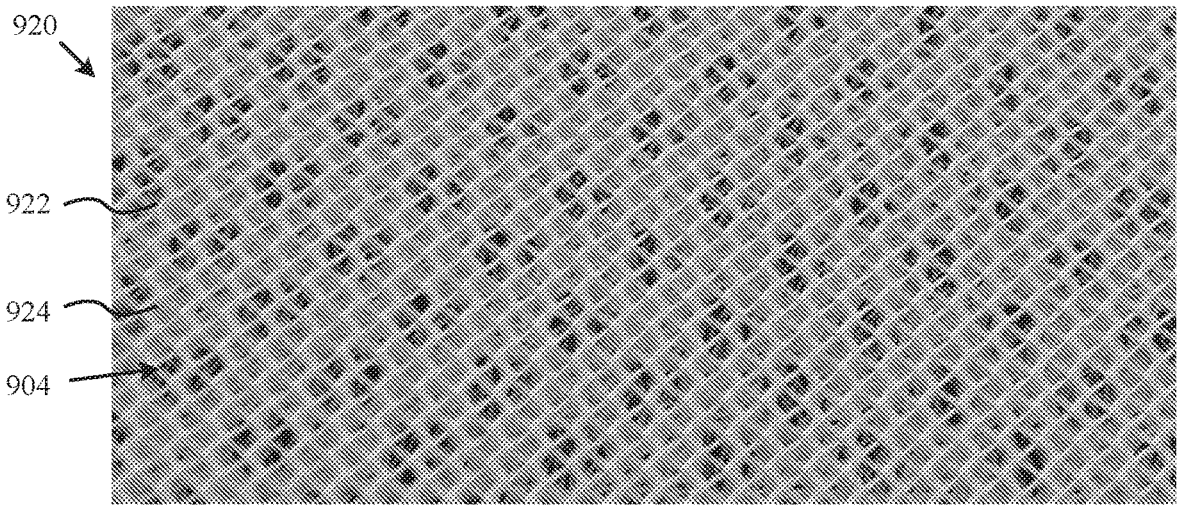
Figure 9C:
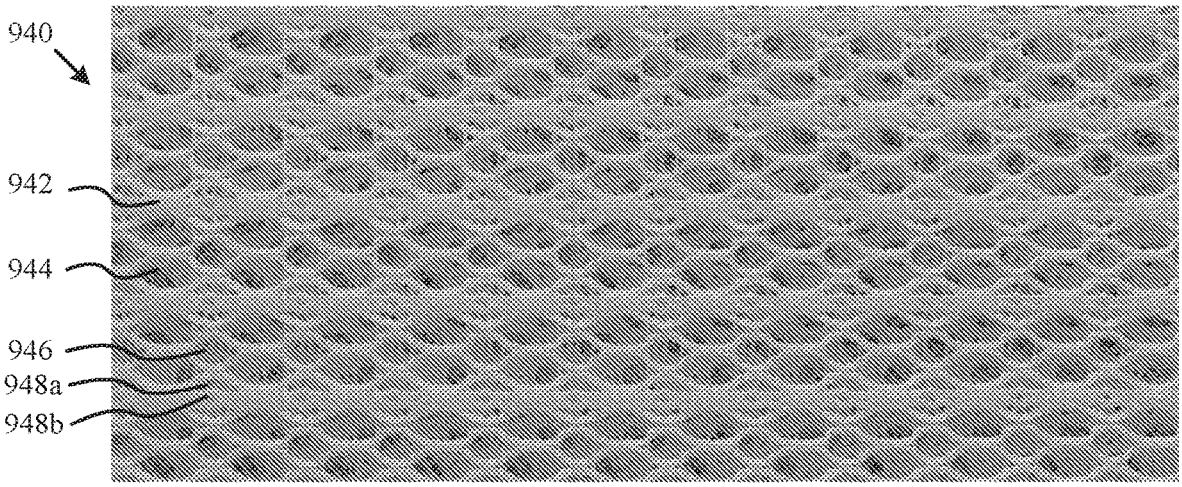

FIGS. 9A-9C show illustrations of exemplary breathable materials according to various embodiments of the present invention. The breathable material may be used for a body portion of a liner of a crib shield system. The breathable material may have an air permeability of between 385 CFM to 1530 CFM, a light permeability of between 47 and 99%, and $CO_2$ rebreathing values of less than about 20%.

FIG. 9A illustrates an exemplary breathable material 900. In the illustrated embodiment, the breathable material 900 includes a front substructure 391 composed of a woven material. The woven portion of the front substructure 391A is illustrated at 902. The woven material 902 is the portion of the front substructure 391A with which a pile substructure 393 may be attached and/or integrated. The woven material 902 is configured with openings 904, which are voids lacking any material. These openings 904 do not have any pile substructure 393 attached, and as such, may be configured to create channels between the front substructure and a back substructure. An exemplary opening 904 may be 1-6 millimeters and preferably 2-4 millimeters in diameter. As illustrated, the exemplary openings 904 are round, although other shapes are available (e.g., oval, triangle, etc.).

FIG. 9B illustrates an exemplary breathable material 920. In the illustrated embodiment, the breathable material 920 includes a front substructure 391B with a plain weave woven portion 922 with openings 924, thereby creating a "netting" pattern. In this exemplary weave configuration, the woven portion 922 is reduced, thereby increasing airflow, but diminishing the distinct channels found in openings 904. Further, the fine pattern of the woven portion 922 lacks a perceivable ornamental pattern when the liner is viewed as a whole. For this reason, in many embodiments, the breathable material 920 may be used as an interior layer when two or more breathable materials are layered together. This may be useful in more durable crib liner embodiments that nevertheless retain breathability, as further discussed in conjunction with FIGS. 12A-12C. As shown by openings 904 in FIG. 9B, with reference to FIGS. 2E-2H for element numbers, the back substructure 392 may be comprised of the front substructure 391 from breathable material 900. Thus, the fabric pattern of the front substructure need not mirror the fabric pattern of the back substructure in the various embodiments.

FIG. 9C, with reference to FIGS. 2E-2H for element numbers, illustrates an exemplary breathable material 940. In the illustrated embodiment, the breathable material 940 includes a front substructure 391 composed of a cableweave fabric. The woven portion of the front substructure 391 is illustrated at 942. The woven material 942 is the portion of the front substructure 391 with which a pile substructure 393 may be attached and/or integrated. The woven material 942 is configured with primary openings 944 (which may also be referred to as first openings), which are voids lacking any material. An exemplary primary opening 944 may be 1-6 millimeters and preferably 2-4 millimeters in diameter, similar to opening 904 of FIG. 9A. The front substructure 391 may also include secondary openings 946, which are smaller than primary openings 944. Additionally, the woven portion may include even smaller openings 948*a* and 948*b* (which may also be referred to as third openings) incorporated into the fabric pattern, in which the openings are smaller than openings 942 and 944. The benefit of two or more opening sizes in the fabric pattern is the ability to create a fabric that has increased breathability by reducing the amount of thick woven portions (e.g., 902) while maintaining fabric strength by having many interwoven threads. For example, a secondary opening 946 may be located at the intersection of four primary openings (first openings), thus reducing the amount of woven material between the primary openings. As another example, the third openings may be located between the first openings and second openings in order to further reduce the amount of woven material. Additional openings, such as secondary openings and third openings, further improve the air permeability (or suffocation resistance level) of the breathable material. Further, the larger openings 944, in combination with the other openings, create a perceivable ornamental pattern when the liner is viewed as a whole. The various openings (e.g., 944 and 946) do not have any pile substructure 393 attached, and as such, may be configured to create channels between the front substructure and the back substructure.

The air permeability of breathable materials 900, 920, and 940 may allow the breathable material to be layered with other breathable material (e.g., 900, 920, 940, etc.) to create a layered crib liner, while still maintaining air permeability (CFM) and low $CO_2$ rebreathing values.

Testing was conducted by Bureau Veritas in accordance with ASTM D737 standards to determine the air permeability (CFM) of a single layer of textile materials. Additionally, various combinations of layered materials 900, 920, and 940—such as those described in paragraph 0129—were also tested to determine air permeability. For example, the single layer of breathable material 900 with a thickness of 0.13 inches provided an air permeability of 1013.1 CFM, similar to the 1.6 cm $H_2O$ discussed in paragraph 0067 above. Adjusting the properties (e.g., thickness, weave pattern, etc.) of the single layer of a breathable material may allow the air permeability to achieve an air permeability of at least 1250 CFM. Adjusting the properties (e.g., thickness, weave pattern, etc.) of the layered breathable material may allow the air permeability to achieve an air permeability of at least 900 CFM.

The breathability of the body portion of a crib liner can be measured using a variety of methodologies, including air permeability, mesh coverage (both location and cover factor measurement via light microscopy), light permeability as measured by photodetector, spectrophotometer or by transmittance or blocking of ultraviolet radiation, $CO_2$ rebreathing, or other suitable tests. Preferably, the body portion has an air permeability of between 385 CFM to 1530 CFM. Of course, the higher the air permeability the more breathable the material is. Preferably, the body portion 46 has a mesh coverage of between 32% and 91%. Mesh coverage is measure of the holes versus material in a mesh material. Preferably, the body portion 46 has a light permeability by photodetector of between 47% and 99%, by spectrophotometer of between 4 and 71%, and by ultraviolet radiation of between 47% and 100%. The tested samples may have one or more layers that compose the crib liner and may or may not be "padded". The below chart illustrates tests performed on various samples of materials that could comprise the body portion 46:

Breathability of Body Portion of Crib Liner

| Sample | Air Permeability - Air Permeability of Textile Materials | Mesh Coverage - Location of Mesh | Mesh Coverage - Cover Factor Measurement via Light Microscopy | Light Permeability - Light Blocking Effect of Curtain Materials, Photodetector Method | Light Permeability - Light Blocking Via Spectrophotometer | Light Permeability - Transmittance or Blocking of Erythemally Weighted Ultraviolet Radiation Through Fabrics |
|---|---|---|---|---|---|---|
| Sample 1 | 1,013.1 CFM | 11" total height 2" poly trim (1" at top, 1" at bottom) | Facing in - 47% coverage Facing out - 40% coverage | Facing in - 86.37% avg % of light blocked Facing out - 86.84% avg % of light blocked | Facing in - 48.60% avg light transmission Facing out - 49.09% avg light transmission | Facing in - UPF rating 10; blocked 87.78% UVA rays and 91.46% UVB rays Facing out - UPF rating 10; blocked 86.41% UVA rays and 91.69% UVB rays |
| Sample 2 | 1,013.1 CFM | 11" total height 2" poly trim (1" at top, 1" at bottom) 9" mesh | Facing in - 39% coverage Facing out - 32% coverage | Facing in - 87.73% avg % of light blocked Facing out - 88.26% avg % of light blocked | Facing in - 12.67% avg light transmission Facing out - 11.99% avg light transmission | Facing in- UPF rating 10; blocked 86.56% UVA rays and 91.70% UVB rays Facing out) -- UPF rating 10; blocked 88.64% UVA rays and 92.45% UVB rays |
| Sample 3 | 536.6 CFM | 11" total height 2" poly trim (1" at top, 1" at bottom) 9" mesh | Facing in - 50% Coverage Facing out - 43% coverage | Facing in - 97.58% avg % of light blocked Facing out - 97.75% avg % of light blocked | Facing in - 24.83% avg light transmission Facing out - 22.90% avg light transmission | Facing in - UPF rating 50+; blocked 98.76% UVA rays and 99.37% UVB rays Facing out - UPF rating 50+; blocked 98.71% UVA rays and 99.33% UVB rays |
| Sample 4 | 536.6 CFM | 11" total height 2" poly trim (1" at top, 1" at bottom) 9" mesh | Facing in - 44% Coverage Facing out - 49% coverage | Facing in - 98.50% avg % of light blocked Facing out - 98.44% avg % of light blocked | Facing in- 4.01% avg light transmission Facing out- 5.09% avg light transmission | Facing in - UPF rating 50+; blocked 98.56% UVA rays and 99.01% UVB rays Facing out - UPF rating 10; blocked 98.59% UVA rays and 98.96% UVB rays |
| Sample 5 | 520.5 CFM | 11" total height 2" poly trim (1" at top, 1" at bottom) 9" mesh | Facing in - 52% Coverage Facing out - 49% coverage | Facing in - 97.57% avg % of light blocked Facing out - 97.59% avg % of light blocked | Facing in - 27.03% avg light transmission Facing out - 25.66% avg light transmission | Facing in - UPF rating 50+; blocked 97.88% UVA rays and 99.01% UVB rays Facing out - UPF rating 50+; blocked 98.01% UVA and 99.08% UVB rays |
| Sample 6 | 384.6 CFM | 11" total height 2" poly trim (1" at top, 1" at bottom) 9" mesh | Facing in - 51% Coverage Facing out- 50% coverage | Facing in- 99.18% avg % of light blocked Facing out- 99.20% avg % of light blocked | Facing in - 12.25% avg light transmission Facing out- 10.44% avg light transmission | Facing in - UPF rating 50+; blocked 99.91% UVA rays and 99.89% UVB rays Facing out - UPF rating 50+; blocked 99.89% UVA rays and 99.97% UVB rays |
| Sample 7 | 547.6 CFM | 14" total height 4" poly trim (3" at top, 1" at bottom) 10" mesh | Facing in - 80% Coverage Facing out - 80% coverage | Facing in - 80.87% avg % of light blocked Facing out - 81.47% avg % of light blocked | Facing in- 45.32% avg light transmission Facing out- 45.43% avg light transmission | Facing in - UPF rating 5; blocked 76.91% UVA rays and 82.06% UVB rays Facing out - UPF rating 50+; blocked 77.24% UVA rays and 82.29% UVB rays |
| Sample 8 | 855 CFM | 11" total height 2" poly trim (1" at top, 1" at bottom) 9" mesh | Facing in -- 91% Coverage Facing out - 92% coverage | Facing in -- 82.46% avg % of light blocked Facing out - 81.50% avg % of light blocked | Facing in - 57.21% avg light transmission Facing out- 52.48% avg light transmission | Facing in - UPF rating 5; blocked 75.61% UVA rays and 87.58% UVB rays Facing out - UPF rating 0; blocked 77.17% UVA rays and 85.63% UVB rays |

-continued

Breathability of Body Portion of Crib Liner

| Sample | Air Permeability - Air Permeability of Textile Materials | Mesh Coverage - Location of Mesh | Mesh Coverage - Cover Factor Measurement via Light Microscopy | Light Permeability - Light Blocking Effect of Curtain Materials, Photodetector Method | Light Permeability - Light Blocking Via Spectrophotometer | Light Permeability - Transmittance or Blocking of Erythemally Weighted Ultraviolet Radiation Through Fabrics |
|---|---|---|---|---|---|---|
| Sample 9 | 730 CFM | 11" total height. 2" poly trim (1" at top, 1" at bottom) 9" mesh | Facing in - 61% Coverage Facing out - 62% coverage | Facing in - 89.64% avg % of light blocked Facing out - 89.67% avg % of light blocked | Facing in - 34.20% avg light transmission Facing out - 38.01% avg light transmission | Facing in - UPF rating 10; blocked 90.87% UVA rays and 92.28% UVB rays Facing out - UPF rating 0; blocked 90.80% UVA rays and 92.79% UVB rays |
| Sample 10 | 929 CFM | 11" total height 2" poly trim (1" at top, 1" at bottom) 9" mesh | Facing in - 86% Coverage Facing out - 86% coverage | Facing in - 79.85% avg % of light blocked Facing out - 80.36% avg % of light blocked | Facing in- 46.39% avg light transmission Facing out- 57.03% avg light transmission | Facing in - UPF rating 5; blocked 65.89% UVA rays and 82.85% UVB rays Facing out - UPF rating 0; blocked 63.69% UVA rays and 80.86% UVB rays |
| Sample 11 | 530 CFM | 11" total height 2" poly trim (1" at top, 1" at bottom) 9" mesh | Facing in - 71% Coverage Facing out) - 39% coverage | Facing in - 90.74% avg % of light blocked Facing out - 90.39% avg % of light blocked | Facing in) - 43.14% avg light transmission Facing out) - 43.96% avg light transmission | Facing in) - UPF rating 10; blocked 81.66% UVA rays and 94.13% UVB rays Facing out) - UPF rating 10; blocked 81.35% UVA rays and 93.77% UVB rays |
| Sample 12 | 760 CFM | 11" total height 2" poly trim (1" at top, 1" at bottom) 9" mesh | Facing in -- 53% Coverage Facing out- 71% coverage | Facing in - 94.40% avg % of light blocked Facing out - 94.99% avg % of light blocked | Facing in - 9.21% avg light transmission Facing out) - 10.00% avg light transmission | Facing in- UPF rating 25; blocked 92.74% UVA rays and 96.01% UVB rays Facing out - UPF rating 20; blocked 92.59% UVA rays and 95.77% UVB rays |
| Sample 13 | 650 CFM | 11" total height 2" poly tam (1" at top, 1" at bottom) 9" mesh | Facing in - 61% Coverage Facing out - 50% coverage | Facing in- 91.84% avg % of light blocked Facing out- 92.15% avg % of light blocked | Facing in- 35.96% avg light transmission Facing out- 37.24% avg light transmission | Facing in- UPF rating 15; blocked 91.76% UVA rays and 93.80% UVB rays Facing out- UPF rating 15; blocked 92.15% UVA rays and 94.21% UVB rays |
| Sample 14 | 1530 CFM | 10" total height 6" poly trim (5" at top, 1" at bottom) 4" mesh | Facing in -- 51% Coverage Facing out - 51% coverage | Facing in - 47.03% avg % of light blocked Facing out - 47.87% avg % of light blocked | Facing in - 70.60% avg light transmission Facing out- 66.37% avg light transmission | Facing in - UPF rating 0; blocked 47.63% UVA rays and 49.00% UVB rays Facing out- UPF rating 0; blocked 47.24% UVA rays and 48.71% UVB rays |

In contrast, competing crib bumpers provide a CFM of less than 100 CFM.

Figure 10:
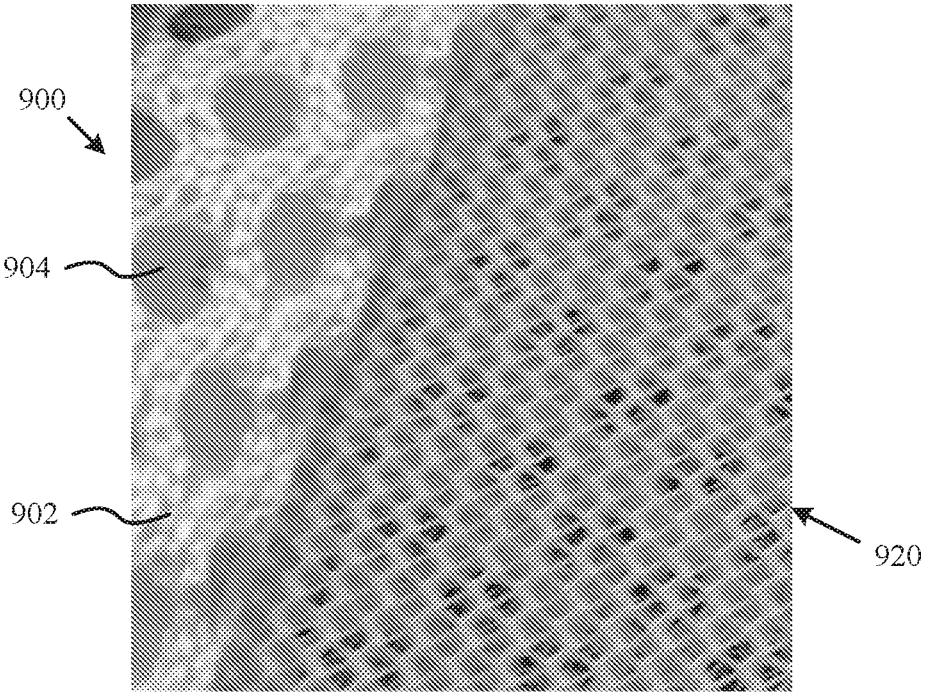
FIG. 10 is an illustration of two exemplary breathable material layers, according to one example embodiment of the present invention.

FIG. 10 shows an illustration of two exemplary breathable materials according to at least one embodiment of the present invention. In particular, breathable material 900 with openings 904 is part of a multi-layer breathable material further including breathable material 920. The large openings 904 of breathable material 900 is evident next to the finer plain weave fabric pattern of breathable material 920.

Figure 11A:
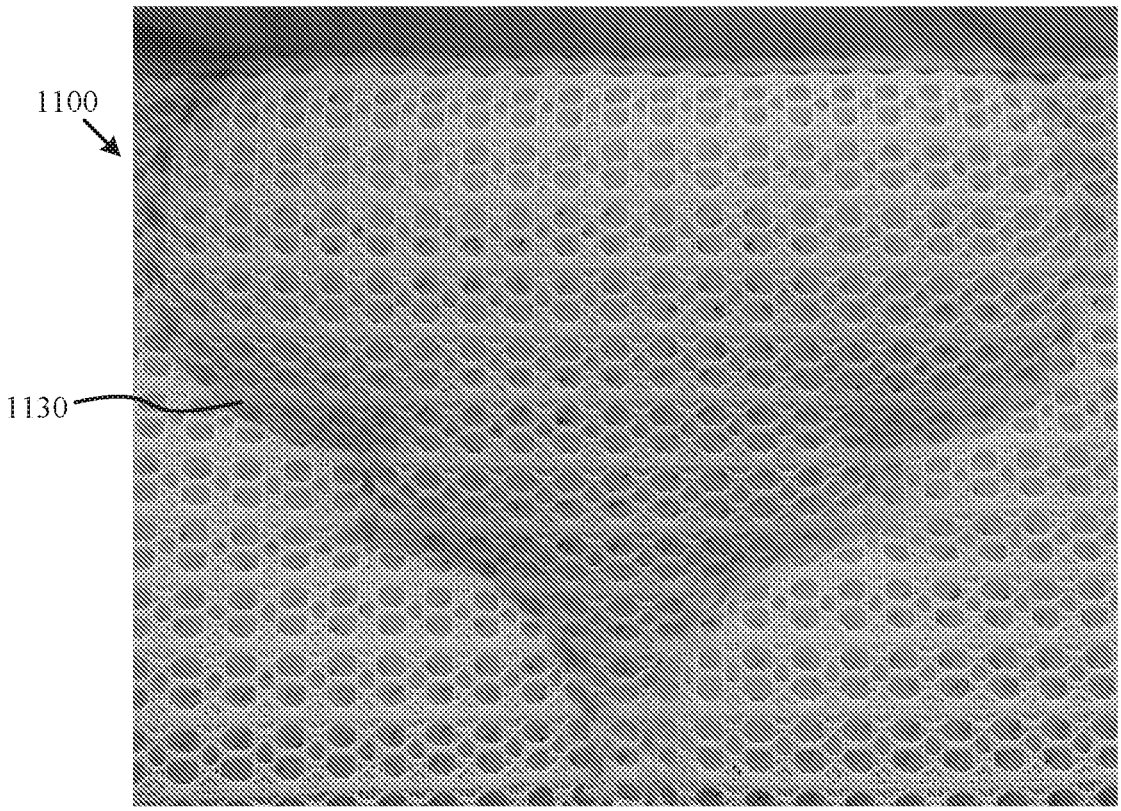
FIGS. 11A-11B are illustrations of two exemplary compartmentalized portions of a breathable material, according to one example embodiment of the present invention.
Figure 11B:
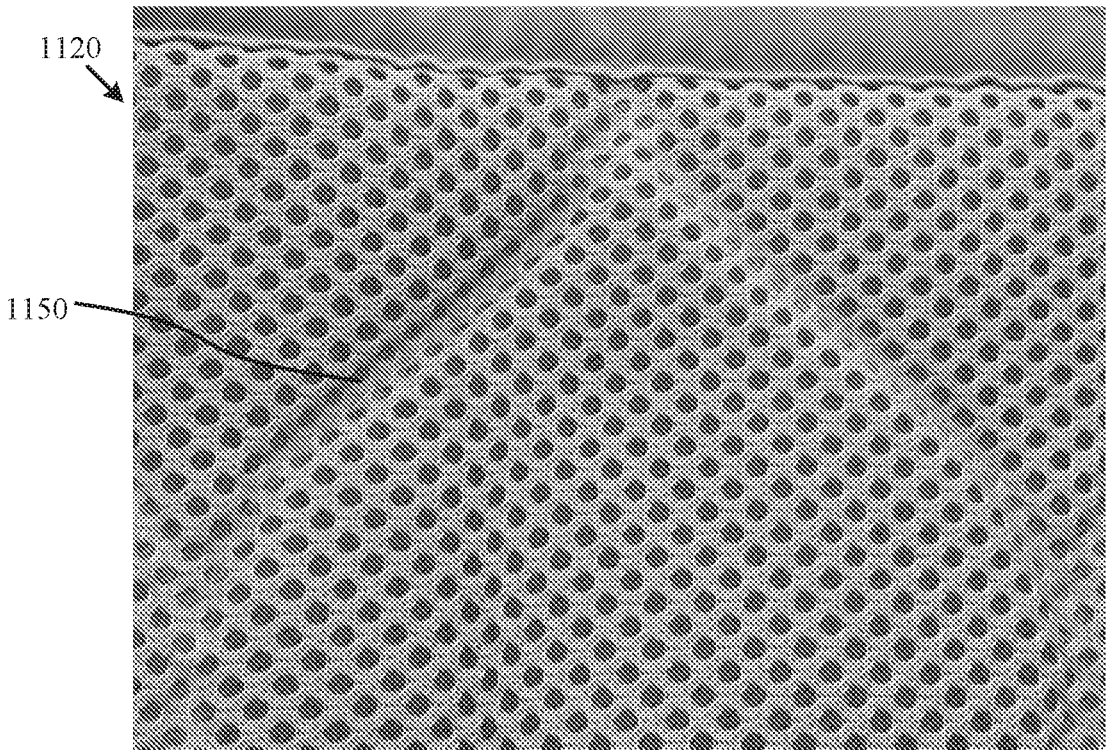

FIGS. 11A and 11B show illustrations of two exemplary compartmentalized portions of a breathable material. FIG. 11A illustrates an exemplary embodiment in which at least one layer of breathable material 1100 is stitched 1130 to create distinct "compartments." These compartments may be stitched 1130 in any ornamental pattern, such as illustrated design. The stitching 1130 may be used to improve the durability of one layer of breathable material, or alternatively, to strengthen liners configured of multiple layers of breathable material. The compartments provide additional rigidity to the layer(s) of breathable material, especially configurations of crib liners that have more than one layer of breathable material. For example, the compartmented breathable material 1100 resists torsional strain better than breathable material that is not compartmented/quilted. Further, the compartmented breathable material 1100 may be more durable over repetitive wash cycles, and further, less susceptible to deformity as a result of being repetitively compressed/crushed (e.g., an infant repeatedly stepping on the crib liner). FIG. 11B illustrates an exemplary embodiment in which at least one layer of breathable material 1120 is embossed, thereby forming compartments similar to those illustrated by FIG. 11A. The embossing 1150 may be limited to one layer of breathable material 1120 (which may be configured of a front, pile, and back substructure) or may connect two or more layers of breathable material. The embossing of breathable material improves the properties of the breathable material 1120 in the same manner that the stitching improved the properties of breathable material 1100. Typically, heat and pressure is used to emboss the one or more layers of breathable material 1120.

Figure 12A:
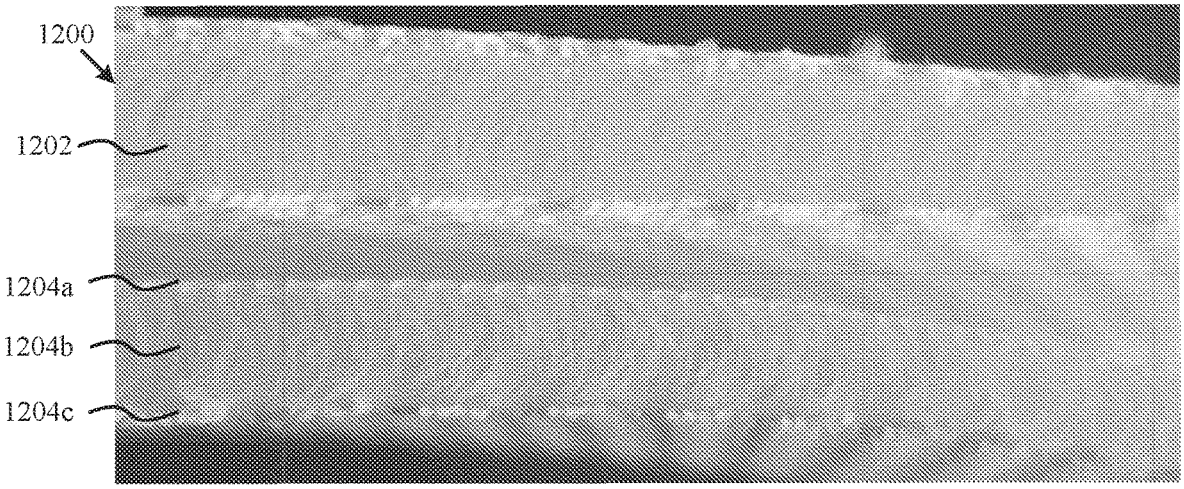
FIGS. 12A-12C are illustrations of exemplary breathable material combinations composed of more than one layer of breathable material, according to one example embodiment of the present invention.
Figure 12B:
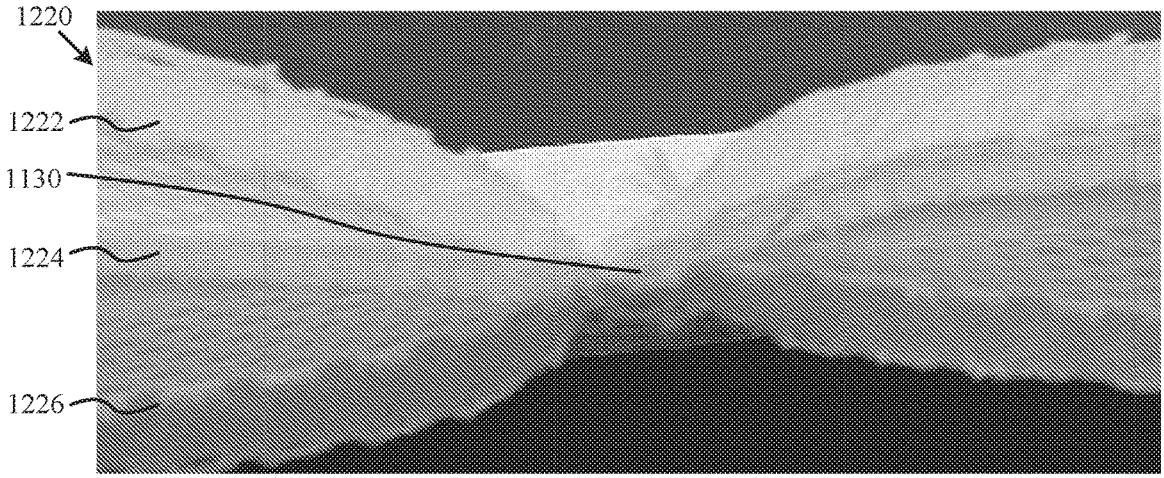
Figure 12C:
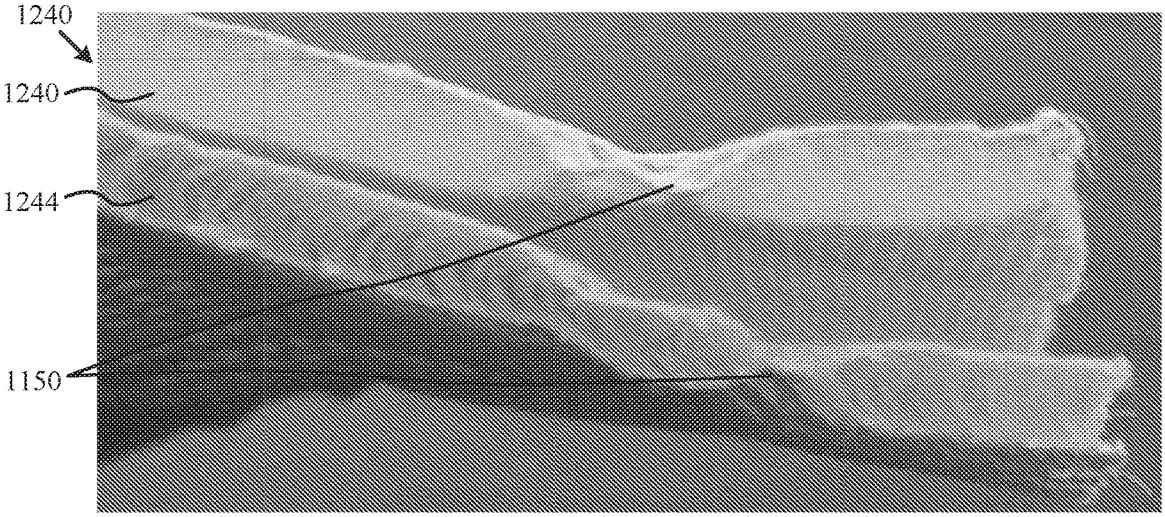

FIGS. 12A-12C show illustrations of various exemplary breathable material combinations composed of more than one layer of breathable material according to multiple embodiments of the present invention. FIG. 12A illustrates an exemplary crib liner cross section 1200 configured with two layers of breathable material, 1202 and 1204. In the exemplary illustrated embodiment, layer 1202 is 4 mm thick and layer 1204 is 3 mm thick in order to achieve a total thickness of approximately 7 mm. Layers with varying thicknesses may be combined to achieve the desired total thickness. This thicker breathable material combination improves the padding properties of the crib liner while having a negligible effect on breathability. The thicker breathable material may be achieved with a single layer, which may range from 1 mm to 15 mm. However, a thicker single layer may be more susceptible to torsional strain. Further, a single layer with a thickness greater than 5 mm increases manufacturing costs.

As illustrated in FIG. 12A, an exemplary breathable material layered to form cross section 1200 may include a front substructure 1204, a pile substructure 1204*b*, and a back substructure 1204*a*. In the illustrated embodiment, back substructure 1204*a* is the fine woven portion 922.

FIG. 12B illustrates an exemplary crib liner cross section 1220 configured with three layers of breathable material, 1222, 1224, and 1226, thereby creating a breathable material combination with a total thickness of 10 mm. An exemplary cross section of stitching 1130 is shown, as discussed in conjunction with FIG. 11A. As shown, the exemplary stitching 1130 binds all three layers. The other embodiments, the stitching may bind only one layer or less than all of the layers.

FIG. 12C illustrates an exemplary crib liner cross section 1240 configured with three layers of breathable material, 1242 and 1244. An exemplary cross section of embossing 1150 is shown, as discussed in conjunction with FIG. 11B. As shown, the exemplary embossing 1150 only binds each individual layer; the embossing does not necessarily bind the layers together. However, the embossing 1150 may bind more than one layer.

Figure 13:
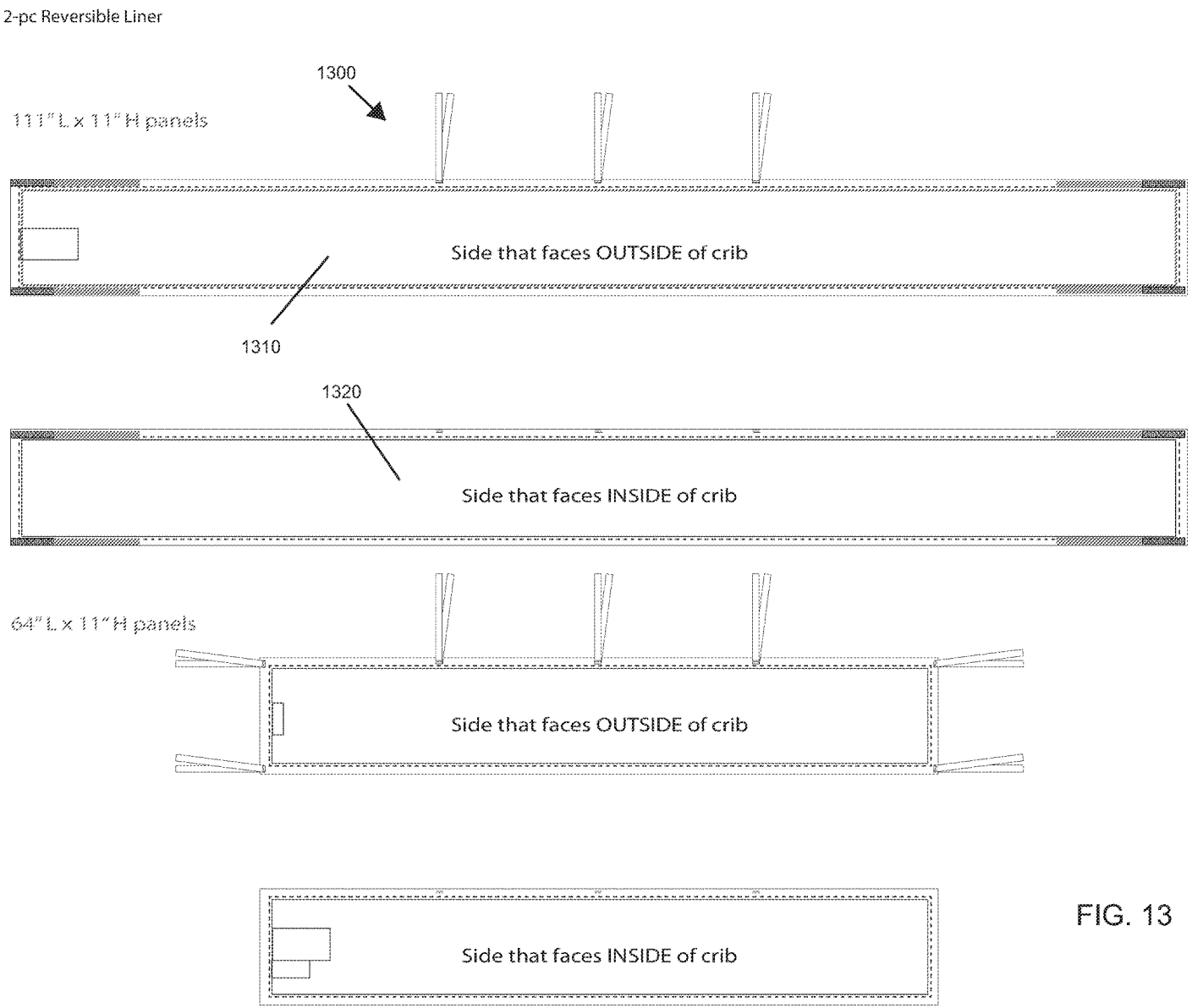
FIG. 13 is an illustration of an exemplary crib liner, which may be reversible, according to one example embodiment of the present invention.

FIG. 13 show illustrations of an exemplary crib liner, which may be reversible, according to various embodiments of the present invention. In many embodiments, the breathable material will have a different fabric weave, fabric color, and/or ornamental features on one side of the panel, 1310, compared to the opposite side of the panel, 1320. This difference in fabric weave, fabric color, and/or ornamental features (e.g., stitching, embossing, fabric shapes, etc.) provides at least two options for sides of the panel which may be exposed to the outside of the crib (and conversely, the inside of the crib). In such configurations, the crib liner is sized and shaped to be reversible. Further, in such configurations, the various fastening apparatus are also configured to be used with either side of the panel exposed to the outside of the crib (i.e., reversible). In some embodiments, the breathable material will have a front substructure with one color while a back substructure has a different color. In such a configuration, the breathable material may be one layer of breathable material (e.g., breathable padded mesh, as shown in FIG. 2F). In embodiments with more than one layer of breathable material, such as illustrated in FIG. 12A-C, different layers of breathable material may be combined to create a reversible liner. For example, one layer of breathable material may be embossed with a pattern while the other layer of breathable material lacks embossing. As another example, both breathable material layers may be embossed, but with different patterns. As yet another example, one layer of breathable material may have a different fabric weave (e.g., FIG. 9A) compared with the other layer of breathable material (e.g., FIG. 9C). Additionally, the color of the layers of breathable material may differ.

Figure 14:
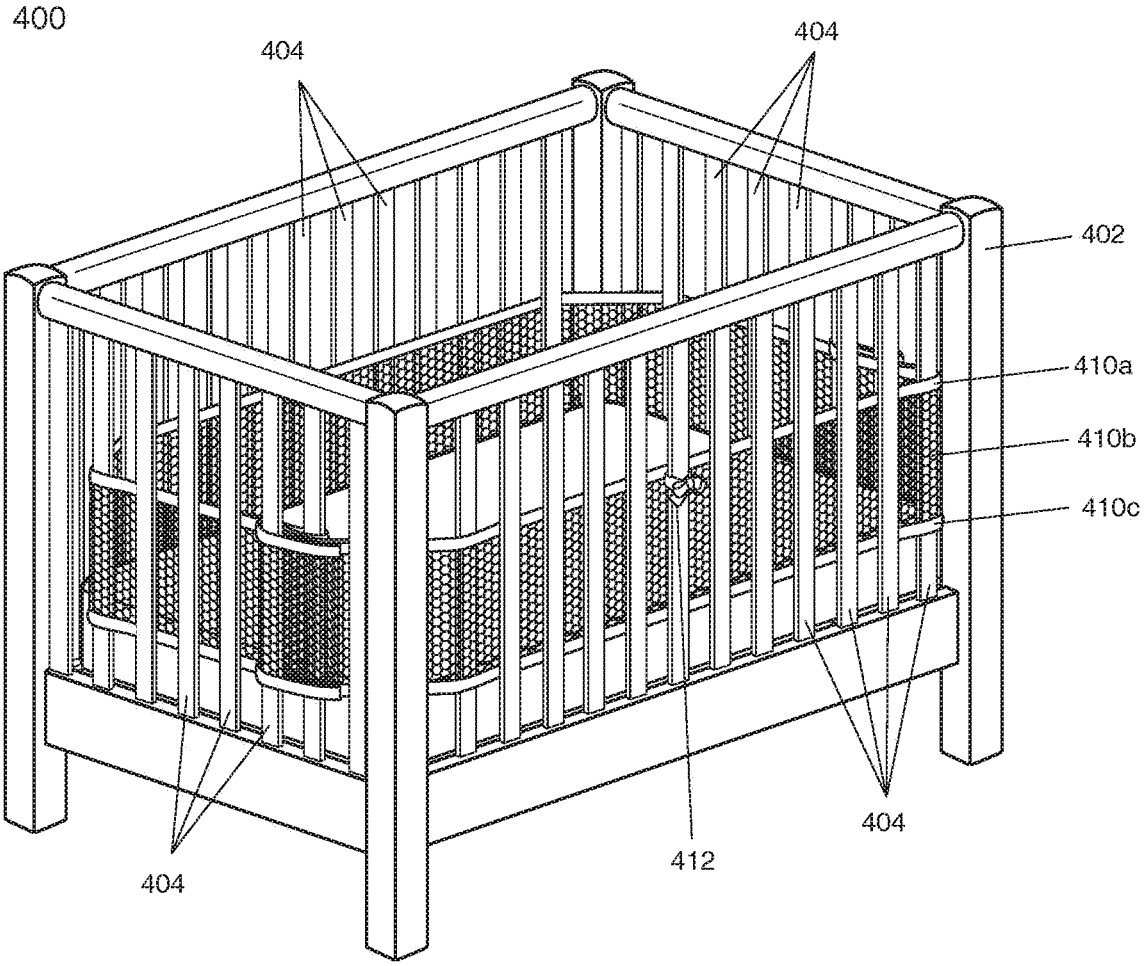
FIG. 14 is an illustration of one embodiment of a crib liner, according to one example embodiment of the present invention.

FIG. 14 shows a crib liner according to one example embodiment of the disclosure. A crib frame 402 may include a number of slats 404. A crib liner 410 may be weaved in and out of various slats 404. In the figure, the crib liner 410 is provided interior of the majority of the slats 404 and woven outside of the last slats before reaching each corner. It is to be appreciated that the crib liner 410 may be woven in and out of the slats 404 in any suitable configuration. The crib liner 410 may provide cushioning for a child in the crib 402 to prevent injury from impact with the slats 404. The crib liner 410 may also provide a barrier to prevent a child in the crib 402 from extending appendages through the slats 404. The crib liner 410 may include a top portion 410*a* and a bottom portion 410*b* separated by a single layer mesh fabric 410*c*. The mesh fabric 410*c* includes a number of holes allowing circulation of air as described in detail above. The top portion 410*a* may be referred to as a top border, the bottom portion 410*b* may be referred to as a bottom portion, and the mesh fabric 410*c* may be referred to as a breathable body portion.

The top portion 410*a* and the bottom portion 410*b* of the crib liner 410 may be similar materials or different materials. In one embodiment, the top portion 410*a* and the bottom portion 410*b* may be fabric material provided for aesthetic purposes to improve the appearance of the mesh fabric 410*c*. According to another embodiment, the top portion 410*a* and the bottom portion 410*b* may be a cushioning material, such as fabric material filled with padding.

The crib liner 410 may be weaved in and out of each of the slats 404 as shown in FIG. 14 and secured to the slats 404 by a fastener 412. The fastener 412 may be, for example, a ribbon that is tied around one of the slats 404 and tied in a bow. Although only one fastener 412 is illustrated, additional fasteners may be included to provide additional support.

According to one embodiment, the crib liner 410 may be a one-piece liner wrap design. The crib liner 410, when a one-piece liner wrap design, may be adjusted for different crib sizes by wrapping the liner 410 multiple times around the slats 404 to consume a portion of the liner 410 in excess length that the perimeter of the crib 402. According to other embodiments, the crib liner 410 may be a multi-piece liner. For example, the crib liner 410 may include several lengths of shorter material, which may be assembled together to form an appropriate length for the crib 402. Thus, the crib liner 410 may be adapted for use on cribs of different sizes.

Additional detailed illustrations of the crib liner 410 are shown in FIGS. 15A, 15B, and 15C. As shown in these figures, in some embodiments, the crib liner 410 may be woven through the slats 404 only at corners of the crib 402. Installing the crib liner 410 by weaving through the slats 404 at corners of the crib 402 may decrease the installation time of the crib liner 410 on the crib 402.

Figure 16A:
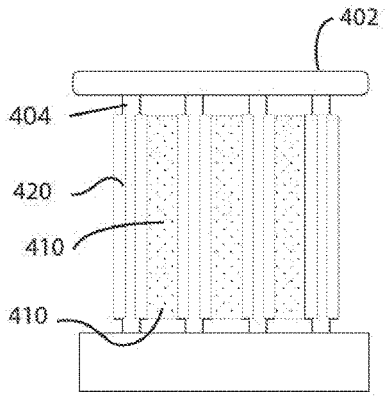
FIGS. 16A-C are illustrations of a crib liner with crib slat pads, according to one example embodiment of the present invention.
Figure 16B:
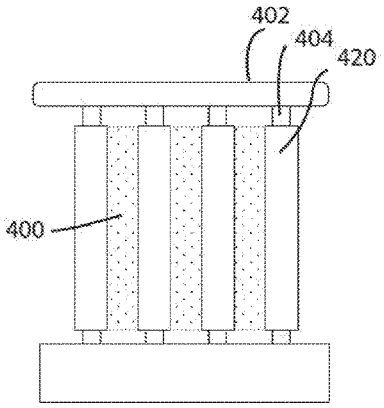
Figure 16C:
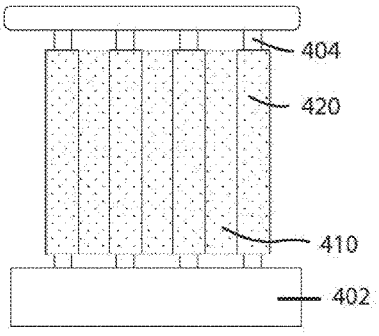

Further details of the crib liner 410 are described below with reference to FIGS. 16-21B. FIGS. 16A-C shows an illustration of the crib liner 410 having crib slat pads according to embodiments of the disclosure. FIG. 16A illustrates a view of a crib liner 410 with crib slat pads 420 as seen from the outside of the crib after installation of the crib liner 410. The crib slat pads 420 cover at least the portion of the slats 404 facing inside the crib 402. The crib slat pads 420 may be made of fabric or other materials.

The crib slat pads 420 may be attached to the slats 404 through attachment mechanisms such as, for example, sewing, snapping, tying, zipping, using a hook and loop fastener, buttoning, free form molding, clipping, and/or strapping the slat pads 420 to the slats 404. According to one embodiment, the slat pads 420 are separate pieces that are inserted between the slats. According to another embodiment, the slat pads 420 line the inside of the crib 402 and adhere to the slats 404. FIG. 16B shows the crib liner 410 with slat pads 420 as viewed from the inside of the crib 402. The slat pads 420 may cover substantially all of the slat 404 facing inside the crib.

In certain embodiments, such as that of FIG. 16A, the slat pads 420 do not extend the entire circumference of the slat 404 such that a portion of the slat 404 is exposed. According to another embodiment, the slat pads 420 may be installed behind the crib liner 410 as shown in FIG. 16C. In this embodiment, the crib liner 410 may be attached to the front of the slat pads 420.

Figure 17:
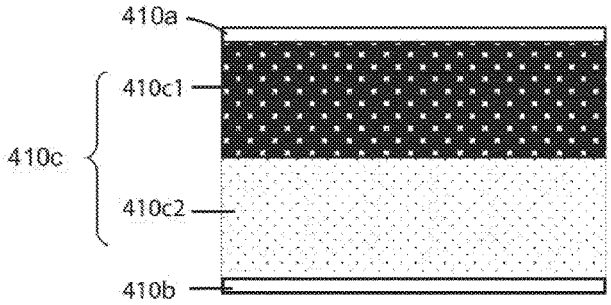
FIG. 17 is an illustration of a two-part liner system, according to one example embodiment of the present invention.

FIG. 17 shows a two-part liner system. More specifically, FIG. 17 illustrates a two-part panel of a liner system. According to one embodiment, the mesh 410*c* of the crib liner 410 may be comprised of multiple fabrics or a combination of other materials. For example, the mesh 410*c* may be divided into an upper fabric 410*c*1 and a lower fabric 410*c*2. The lower fabric 410*c*2 may be selected to be a fabric having higher breathability than the upper fabric 410*c*1. Thus, additional airflow may be facilitated into the crib 402 at the child's head level.

Other configurations of the crib liner 410 with one or more fabric layers in the mesh are possible. According to one embodiment, the mesh 410 may include two or more cotton or poly-breathable outer layers with a breathable spaces mesh in-between the two or more outer layers. According to another embodiment, the mesh 410 may include two or more cotton or poly-breathable outer layers with a breathable poly foam in-between. According to yet another embodiment, a breathable poly foam may be placed in-between a thin mesh and a spacer mesh. Each of these configurations may comprise the entire liner 410 or may be added to the crib liner 410 as additional layers. Further, these configurations may be applied to any of the embodiments described in this disclosure.

Figure 18:
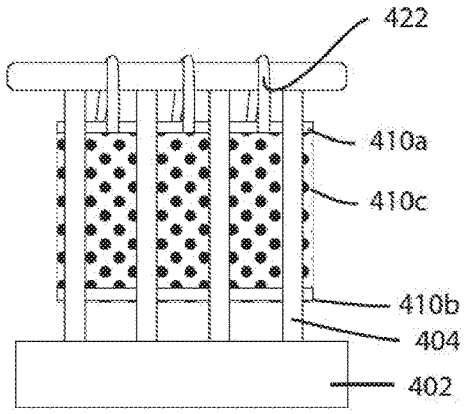
FIG. 18 is an illustration of a crib liner with attachment devices, according to one example embodiment of the present invention.

FIG. 18 shows the crib liner 410 with attachment to a top rail of a crib according to one embodiment of the disclosure. As described above, the crib liner 410 may be attached to the crib 402 through various mechanisms. According to the embodiment shown in FIG. 18, straps 422 are attached to the crib liner 410 such that the strap 422 may be extended over a rail of the crib 402 and attached again to the crib liner 410. The attachment 422 may be straps, ties, hook and loop closures, buttons, snaps, a zipper, or other.

Figure 19A:
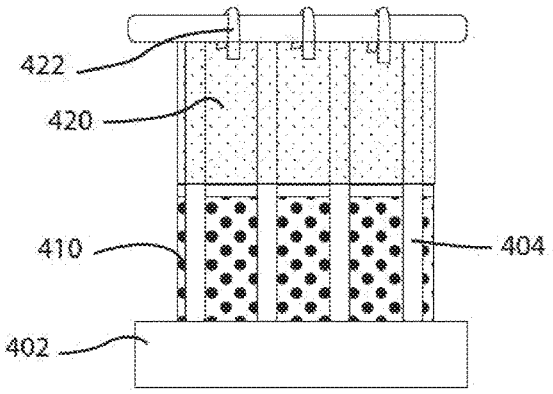
FIGS. 19A-B are illustrations of one embodiment of a crib liner with extended length, according to one example embodiment of the present invention.
Figure 19B:
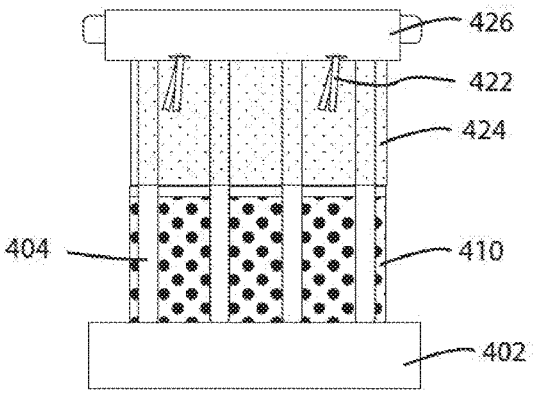

FIGS. 19A and 19B show the crib liner 410 attached to a second crib liner 424. As a child grows the crib liner 410 may become insufficient to protect the child from the dangers of the slats 404. The second crib liner 424 may be attached to the crib liner 410 to extend the height of the crib liner 410. According to one embodiment, the second crib liner 424 may be the same material as the crib liner 410. However, the second crib liner 424 may also be different material than the crib liner 410. For example, the crib liner 410 may be a more breathable material than the second crib liner 424 to allow increased airflow to the child in the crib 402 when the child is laying down and sleeping. The second crib liner 424 may include attachment 422 as described above for attaching the combined second crib liner 424 and the first crib liner 410 to the crib 402.

FIG. 19B shows the crib liner of FIG. 19A having the crib liner 410 and the second crib liner 424 may include a padded cover 426. The padded cover 426 may cover a portion of the crib 402 to protect a child from impact with the hard surfaces of the crib 402. The cover 426 may include slits through which the attachments 422 enter and exit the cover 426. The cover 426 may be installed on, for example, a top railing of the crib 402. However, the cover 426 may also be installed on other longitudinal structures of the frame from which the liners 410 and 424 may extend.

Figure 20A:
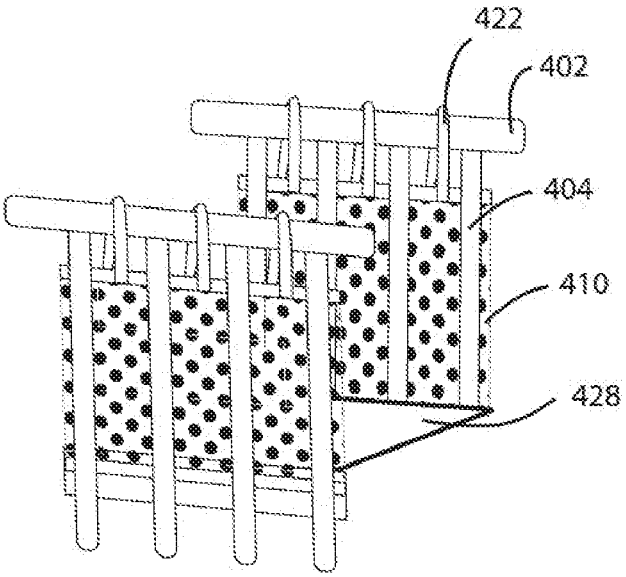
FIGS. 20A-B are illustrations of a crib liner with an underneath mattress fabric, according to one example embodiment of the present invention.
Figure 20B:
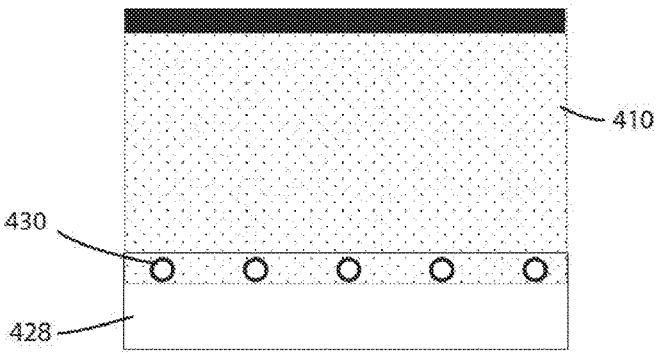

FIGS. 20A and 20B show a crib liner 410 with an underneath mattress fabric 428. The fabric 428 may be attached to the liner 410 or structurally integrated into the crib liner 410. Extending the crib liner 410 underneath a mattress with the fabric 428 may prevent the liner 410 from slipping and prevents a child from extending appendages into otherwise unprotected spaces. The fabric 428 may be attached to one portion of the liner 410 and then stretched and attached to another portion of the liner 410 to allow the fabric 428 to fit cribs of different sizes. The fabric 428 may be attached to the liner 410 through fasteners 430 including sewing, strapping, tying, hook and loop closures, snapping, and/or zipping.

FIG. 20B shows another perspective of the crib liner. The bottom panel 428 may have substantially the same length and width as a crib mattress. The side panels may have substantially the same length as the length of the bottom panel 428. The end panels may have substantially the same length as the width of the bottom panel 428. In this embodiment, the crib liner may be placed directly on top of the mattress, and the side and end panels attached to the four sides of the crib using fasteners 430, which may be disposed continuously or intermittently along the outer edges of the side and end panels.

Figure 21A:
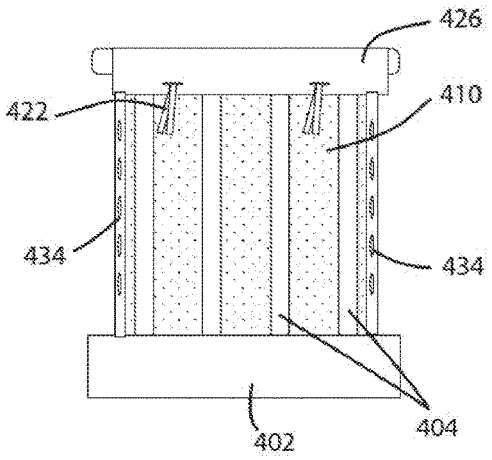
FIGS. 21A-B show an illustration of one embodiment of an expandable crib liner, according to one example embodiment of the present invention.
Figure 21B:
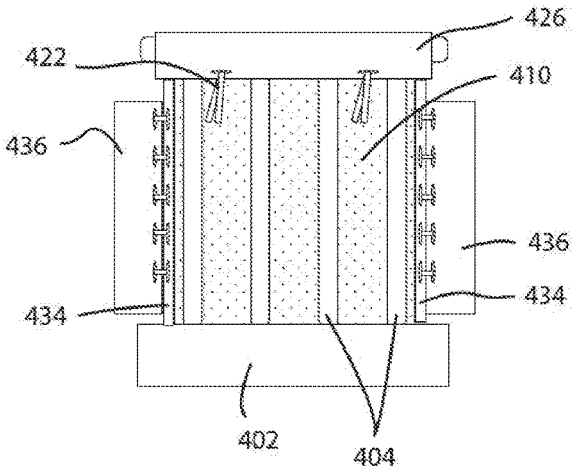

FIGS. 21A and 21B show a crib liner 410 with a receptor 434 for additional connecting pieces such as extra panels 436. Through the receptor 434 additional components may be affixed to the liner 410 using any of the attachment mechanisms described above. According to one embodiment the additional components may be, for example, the panels 436.

Figure 22A:
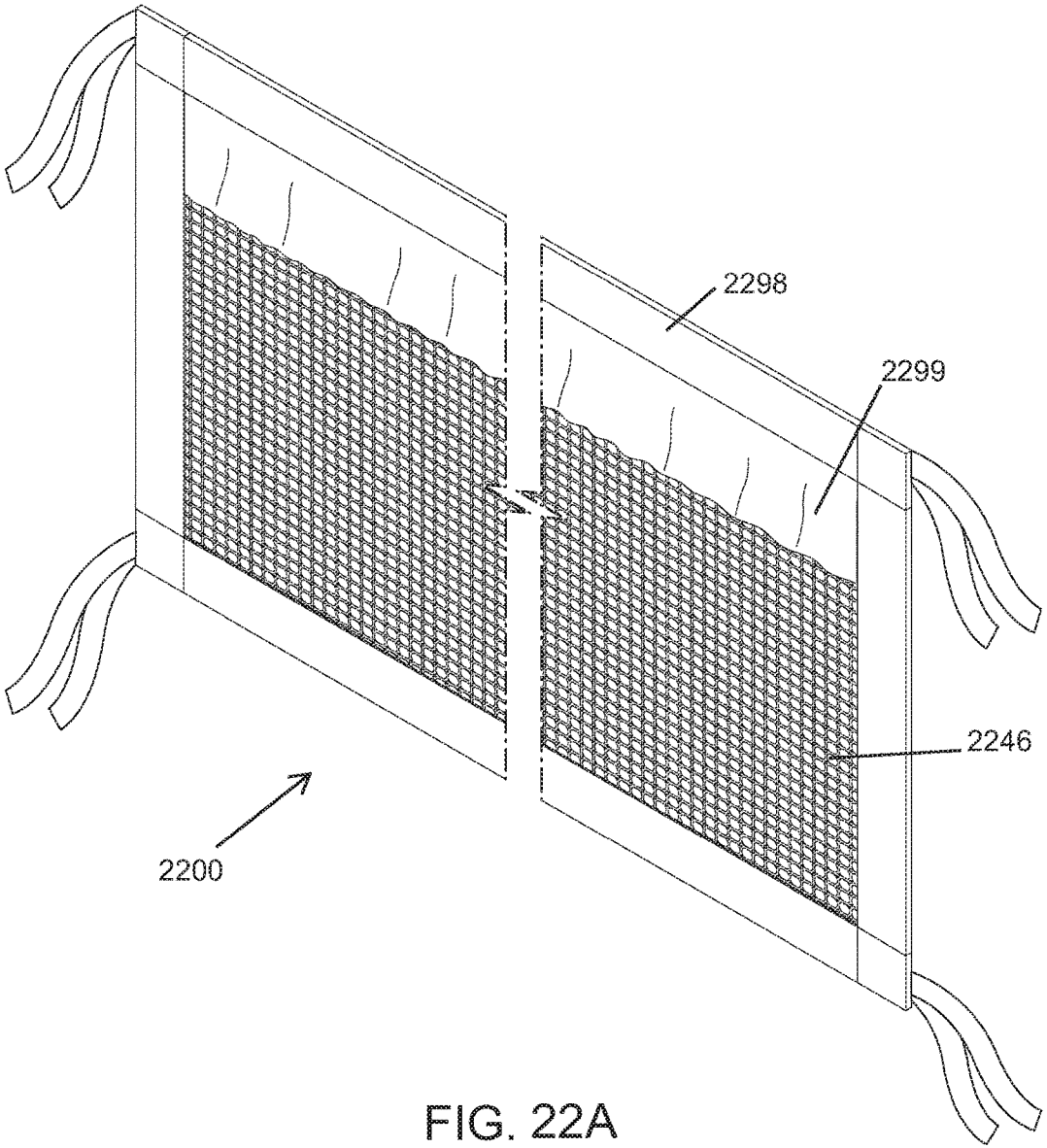
FIG. 22A is a perspective view of an illustration of one embodiment of a crib liner, according to one example embodiment of the present invention.
Figure 22B:
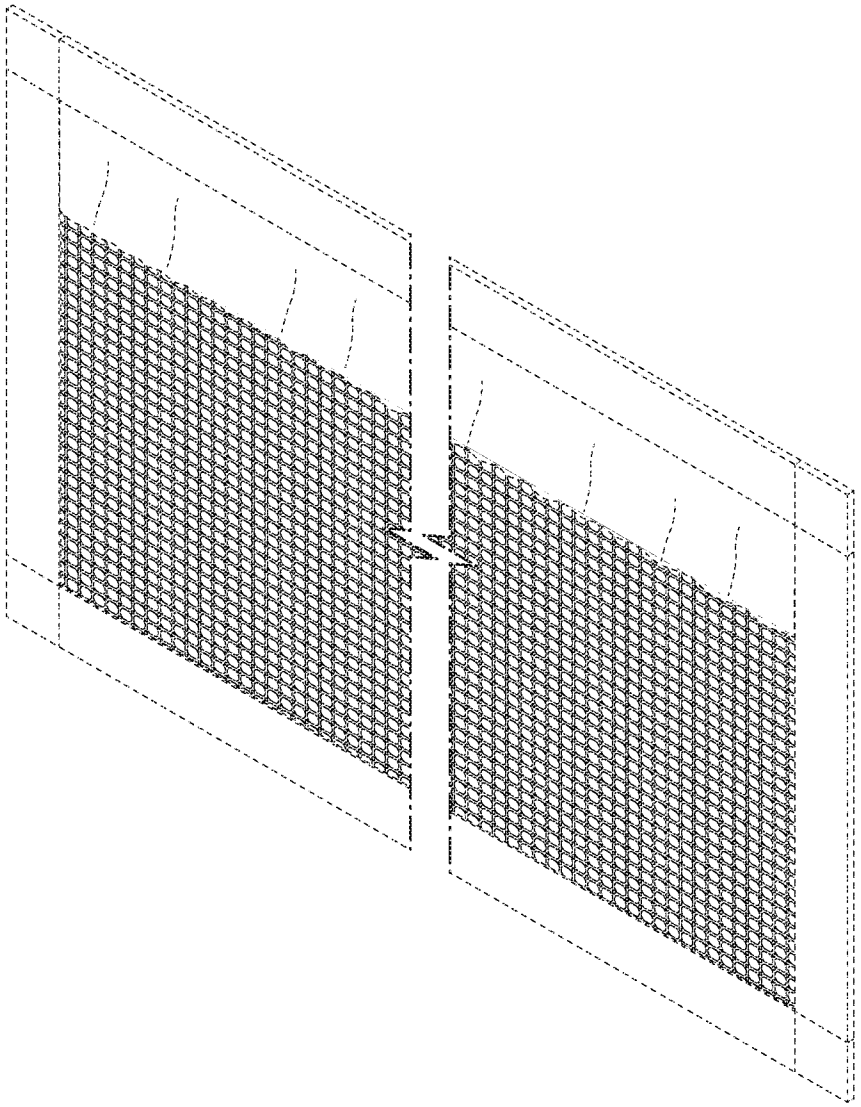
FIG. 22B is a perspective view of an illustration of an example body portion of the crib liner of FIG. 22A, according to one example embodiment of the present invention.
Figure 22C:
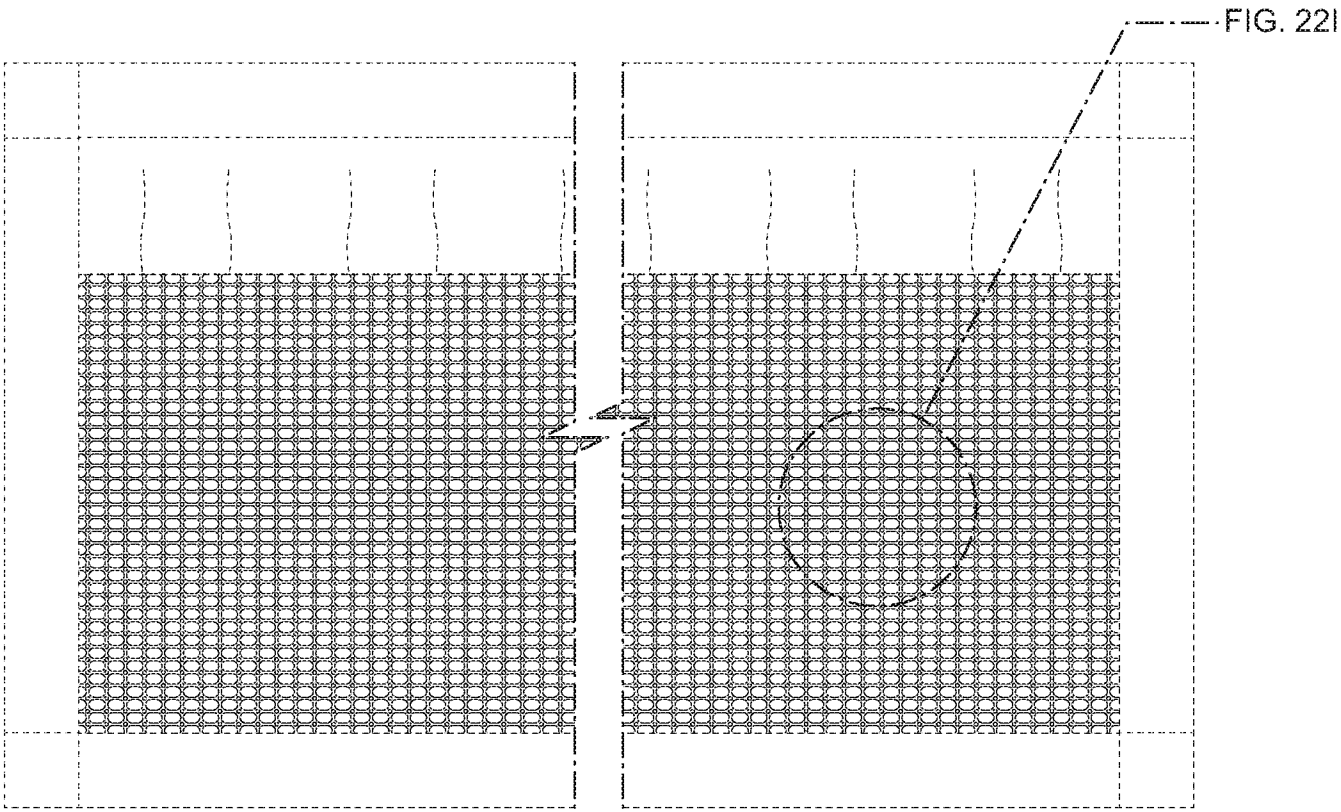
FIG. 22C is a front view of an illustration of the example body portion of the crib liner of FIG. 22A, according to one example embodiment of the present invention.
Figure 22D:
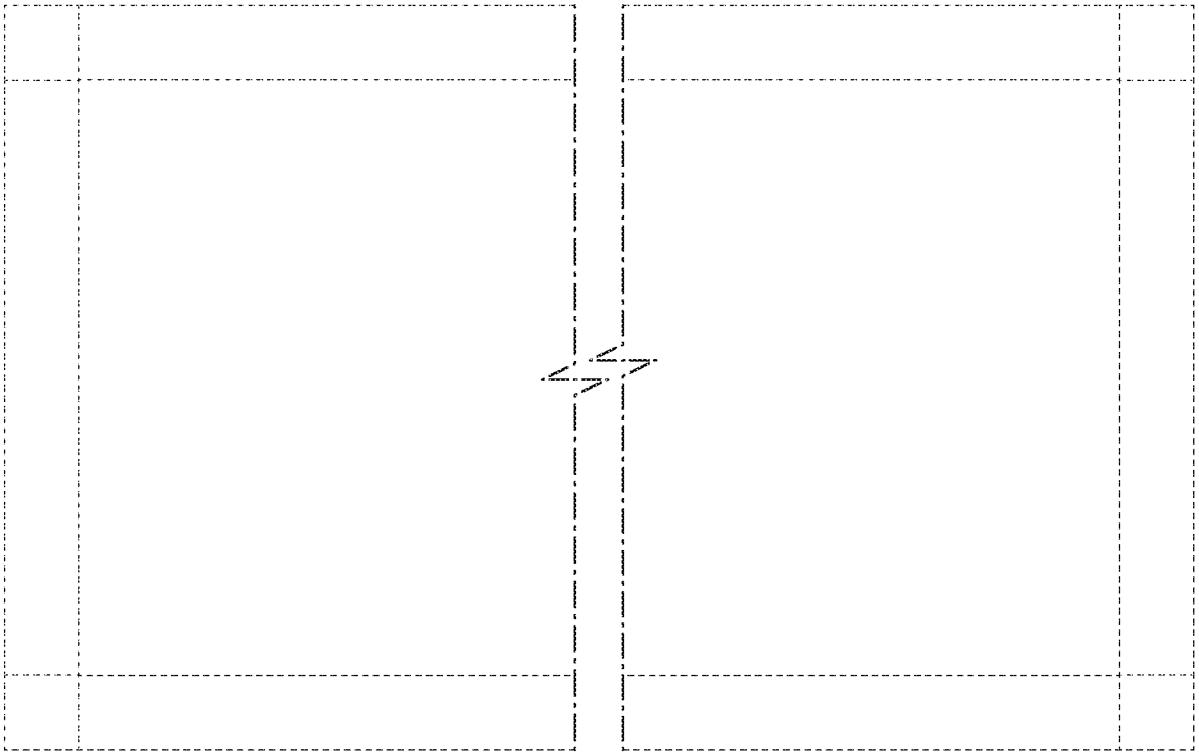
FIG. 22D is a back view of an illustration of an example body portion of the crib liner of FIG. 22A, according to one example embodiment of the present invention.
Figure 22I:
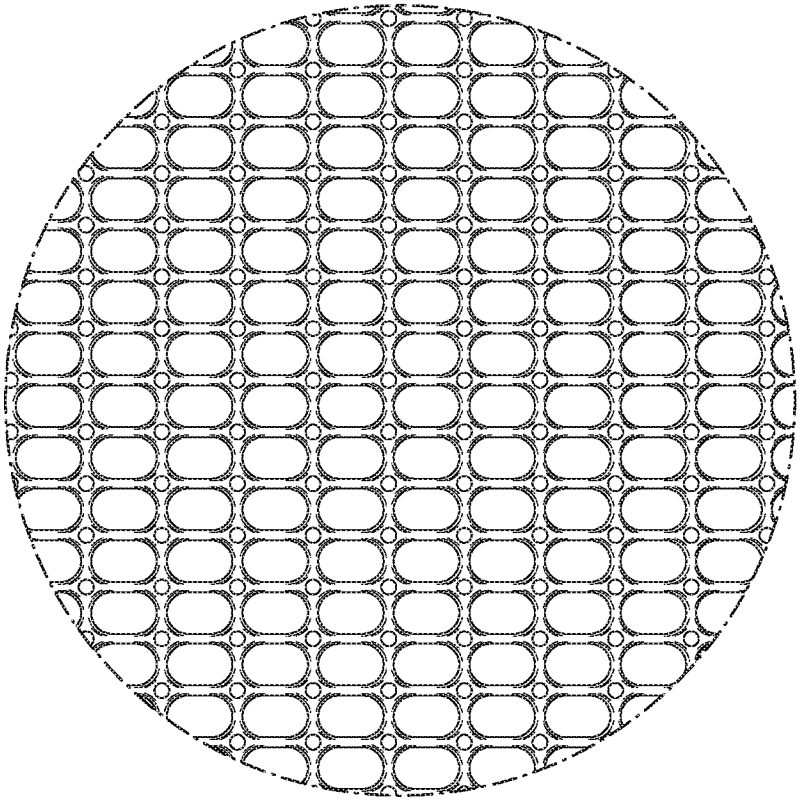
FIG. 22I is an exploded view of the body portion of the crib liner of FIG. 22A, according to one example embodiment of the present invention.
Figure 22J:
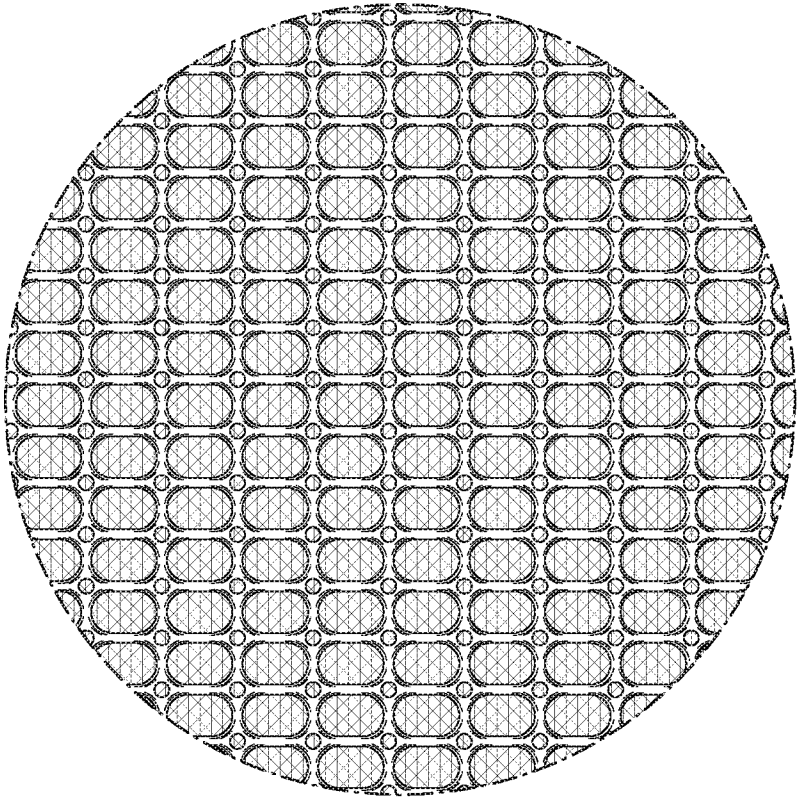
FIG. 22J is an alternative exploded view of the body portion of the crib liner of FIG. 22A, according to one example embodiment of the present invention.
Figure 23A:
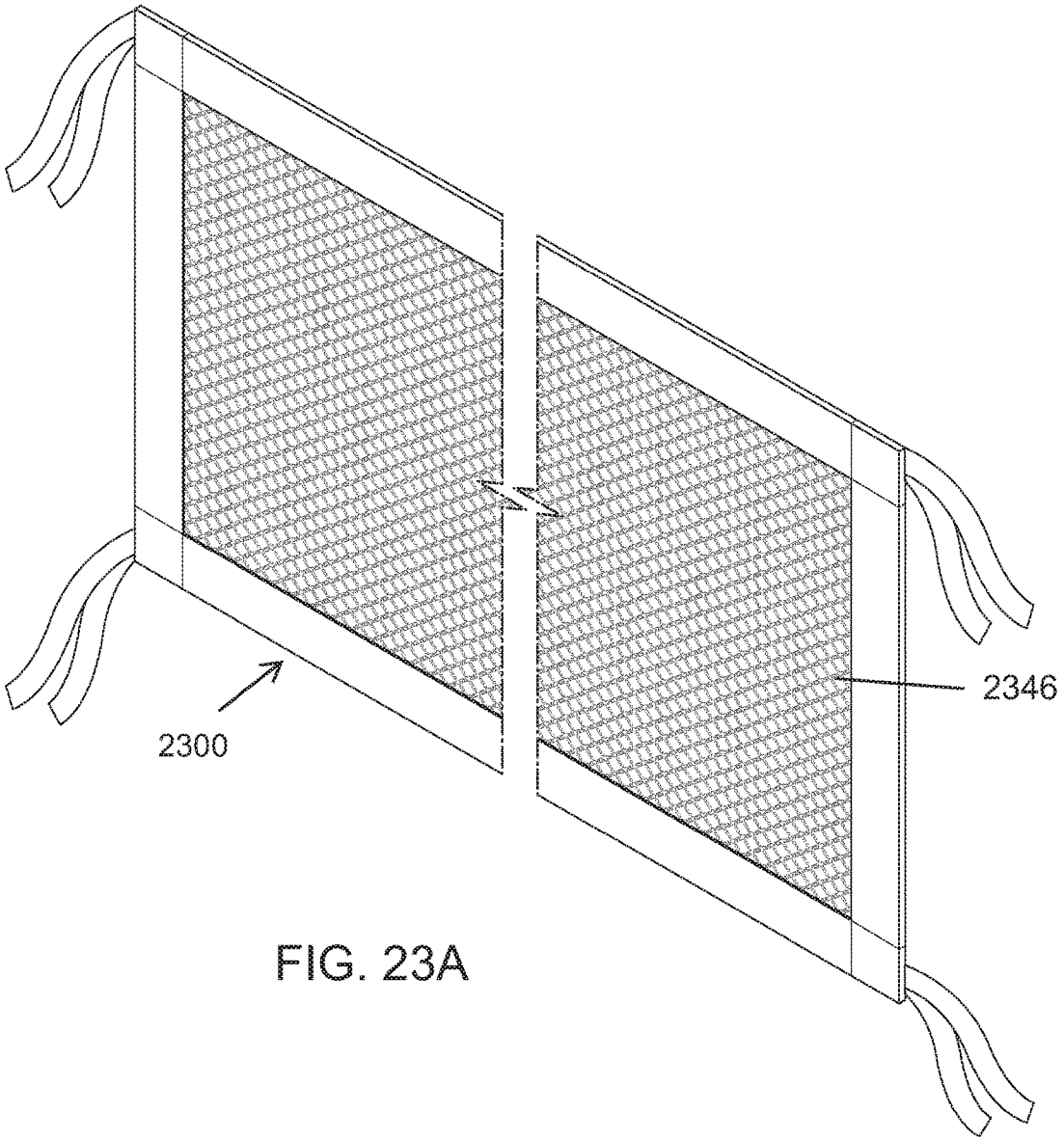
FIG. 23A is a perspective view of an illustration of one embodiment of a crib liner, according to one example embodiment of the present invention.
Figure 23B:
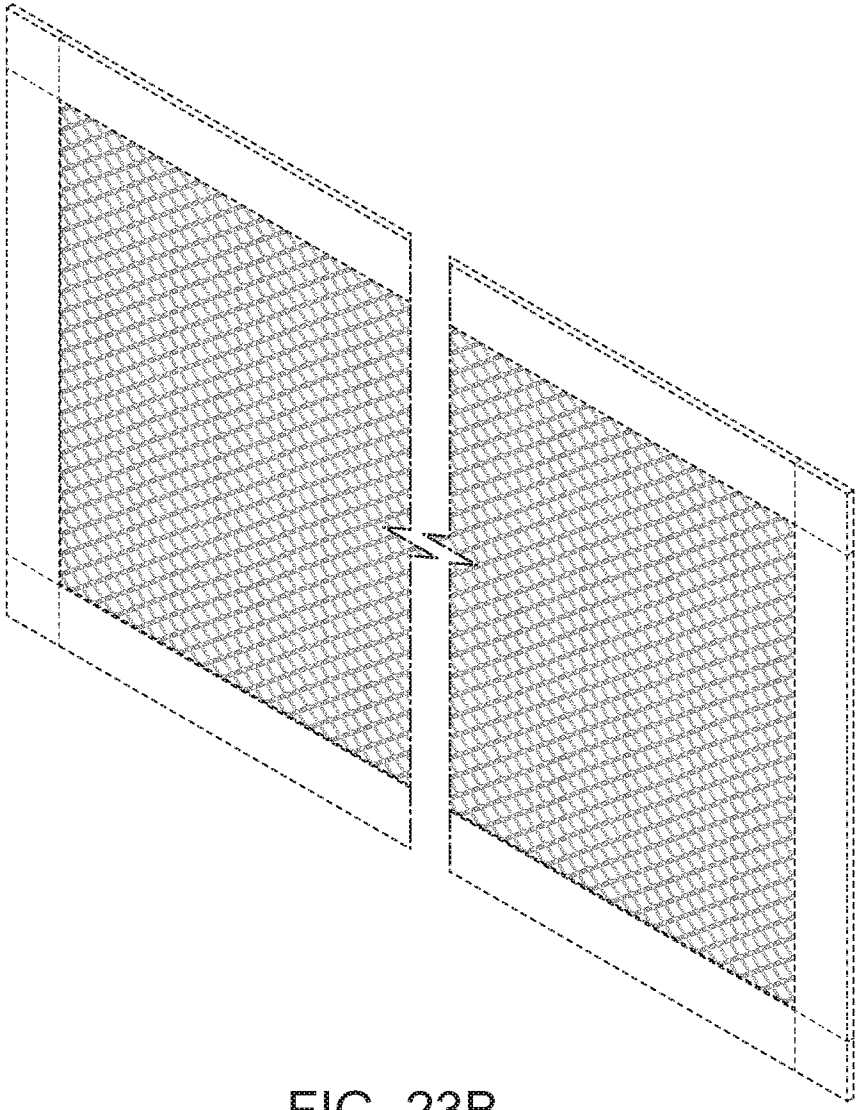
FIG. 23B is a perspective view of an illustration of an example body portion of the crib liner of FIG. 23A, according to one example embodiment of the present invention.
Figure 23C:
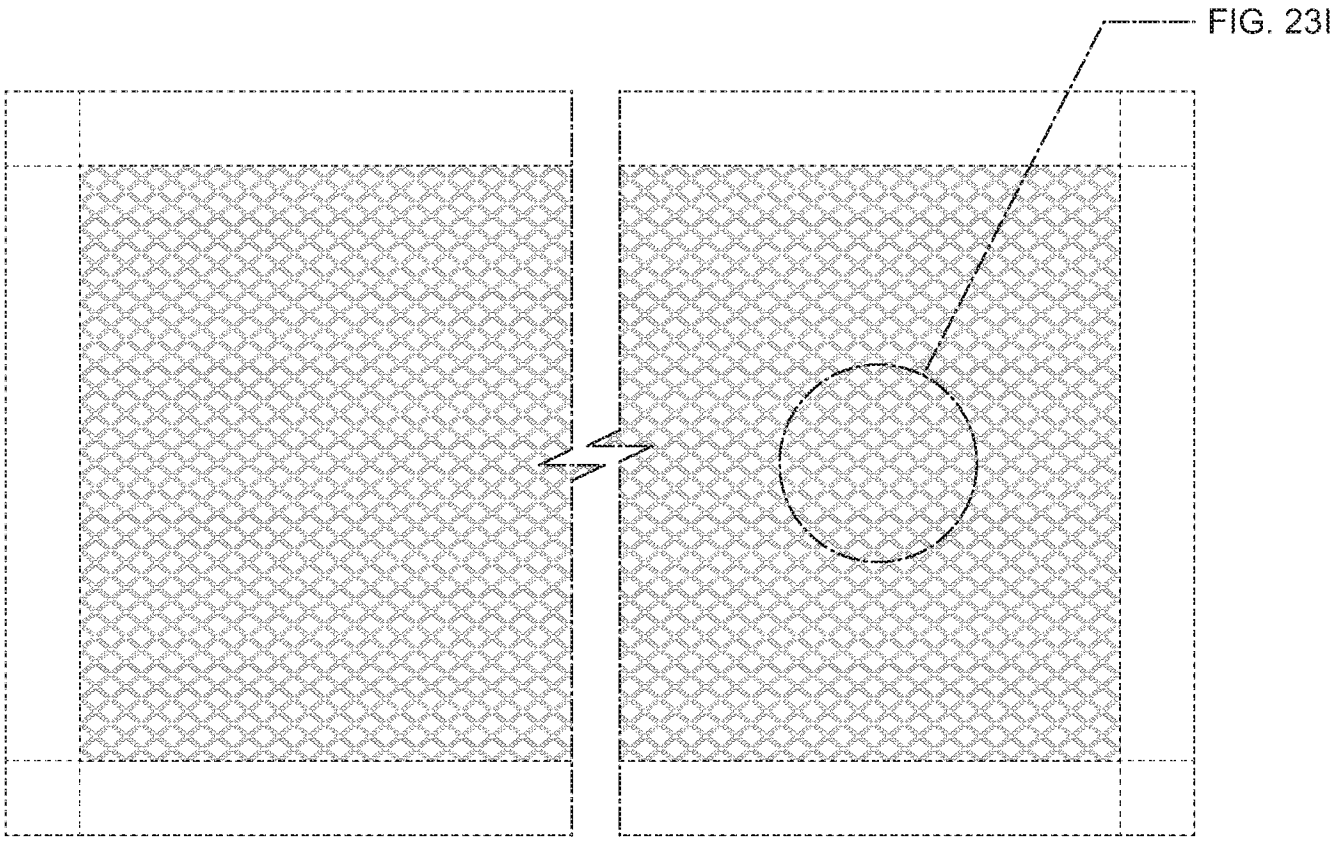
FIG. 23C is a front view of an illustration of the example body portion of the crib liner of FIG. 23A, according to one example embodiment of the present invention.
Figure 23D:
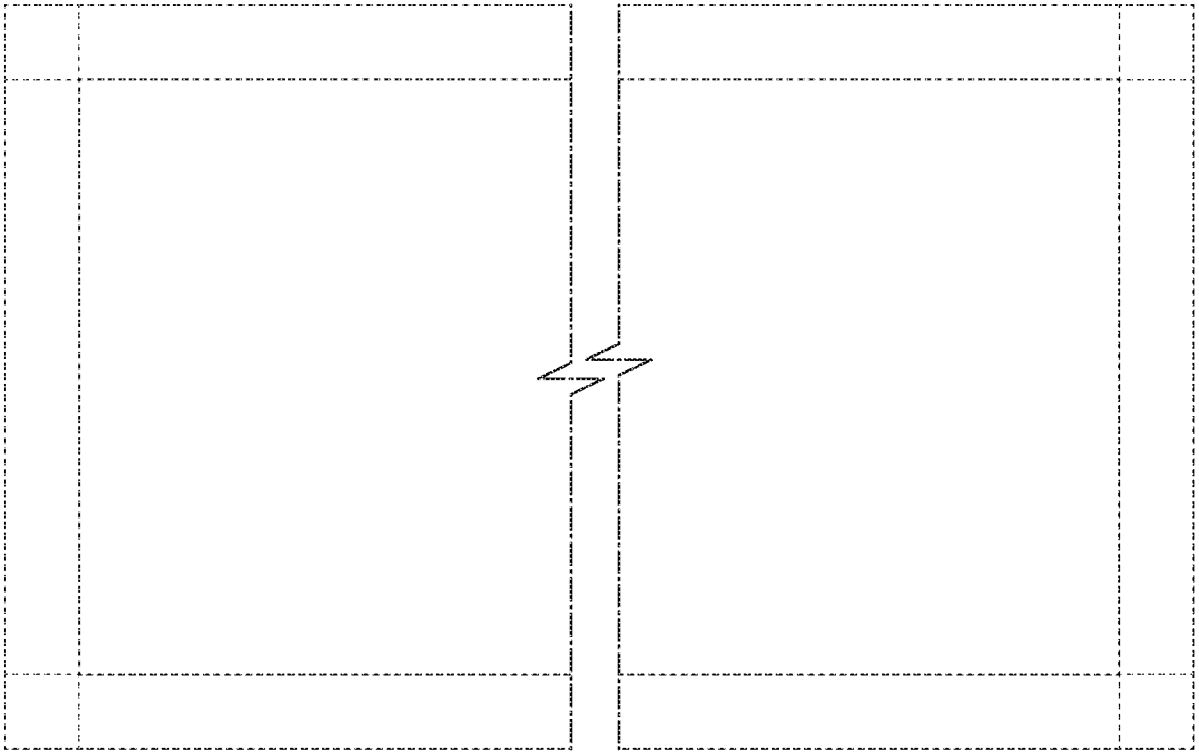
FIG. 23D is a back view of an illustration of an example body portion of the crib liner of FIG. 23A, according to one example embodiment of the present invention.
Figures 23E, 23F, 23G, 23H:
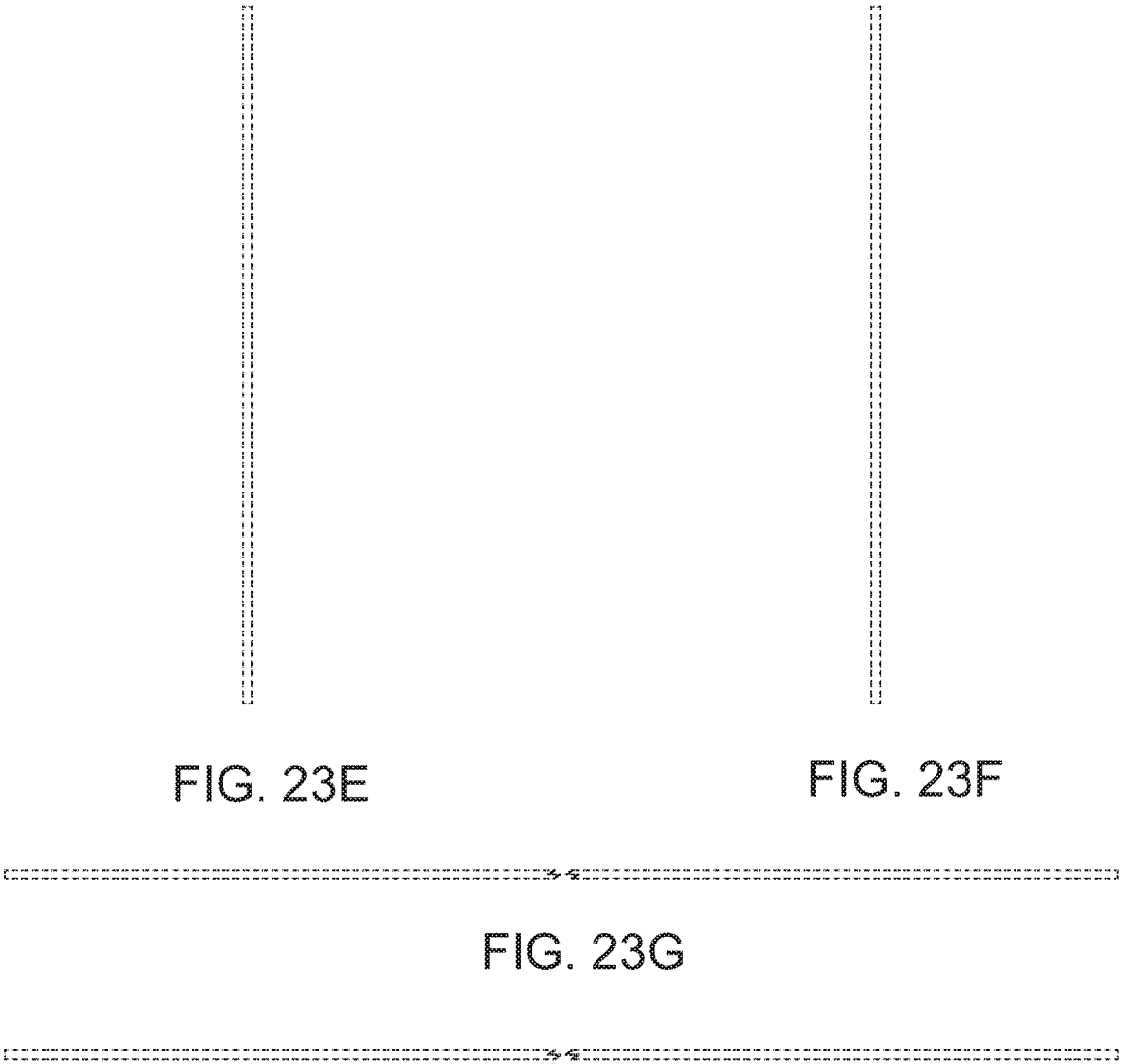
FIG. 23E is a first side view of an illustration of an example body portion of the crib liner of FIG. 23A, according to one example embodiment of the present invention.
FIG. 23F is a second side view of an illustration of an example body portion of the crib liner of FIG. 23A, according to one example embodiment of the present invention.
FIG. 23G is a top view of an illustration of an example body portion of the crib liner of FIG. 23A, according to one example embodiment of the present invention.
FIG. 23H is a bottom view of an illustration of an example body portion of the crib liner of FIG. 23A, according to one example embodiment of the present invention.
Figure 23I:
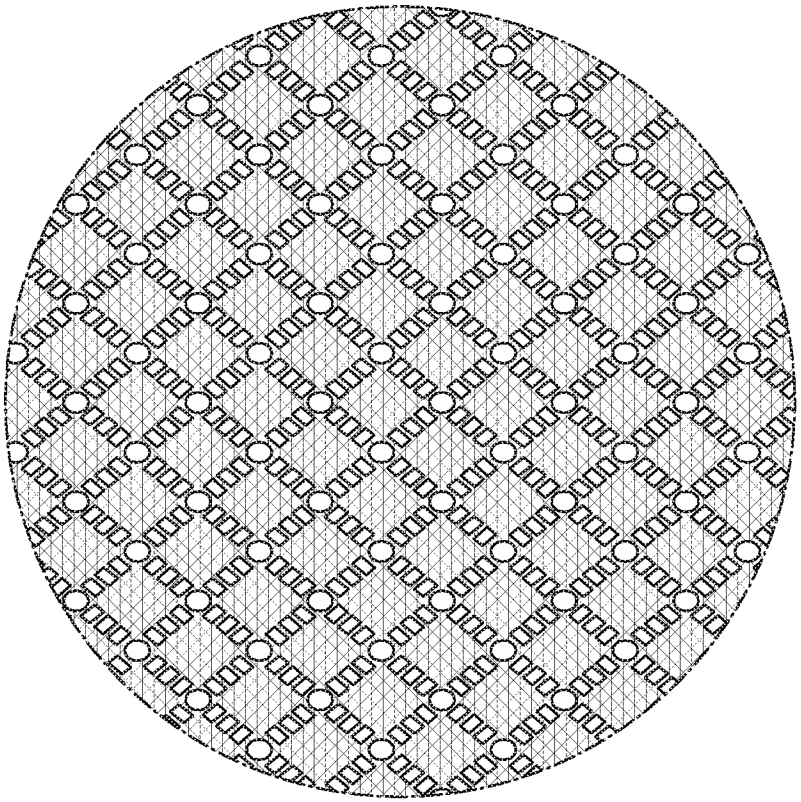
FIG. 23I is an exploded view of the body portion of the crib liner of FIG. 23A, according to one example embodiment of the present invention.

In an alternative example embodiment, FIGS. 22A-22J illustrate a crib liner 2200 where the body portion 2246 has a mesh type material having a fishnet appearance. The crib liner 2200 also includes a top border 2298 having ruffles 2299. FIG. 22J illustrates an alternative back layer having a different appearance than that of FIG. 22I.

In another alternative example embodiment, FIGS. 23A-23*l* illustrate a crib liner 2300 where the body portion 2346 has a mesh type material having a diamond appearance.

Figure 24A:
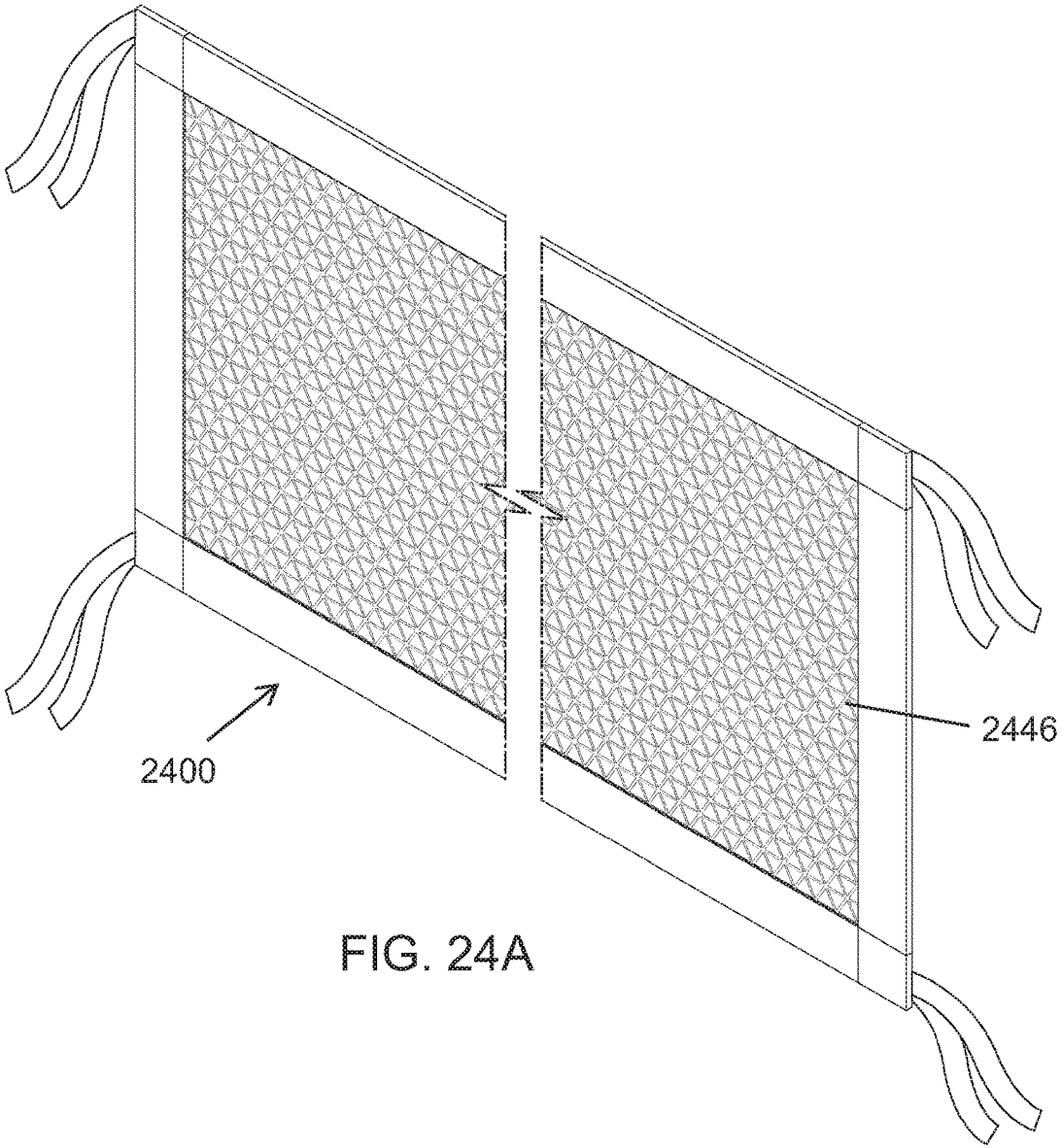
FIG. 24A is a perspective view of an illustration of one embodiment of a crib liner, according to one example embodiment of the present invention.
Figure 24B:
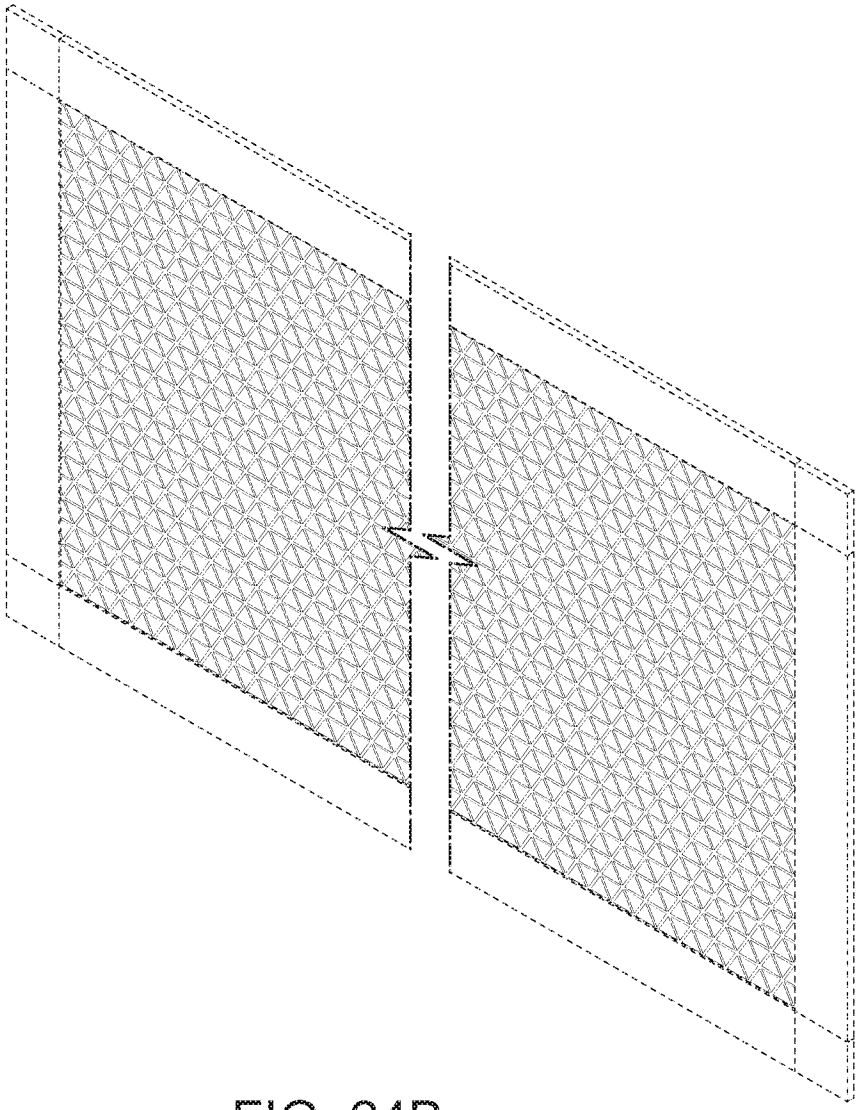
FIG. 24B is a perspective view of an illustration of an example body portion of the crib liner of FIG. 24A, according to one example embodiment of the present invention.
Figure 24C:
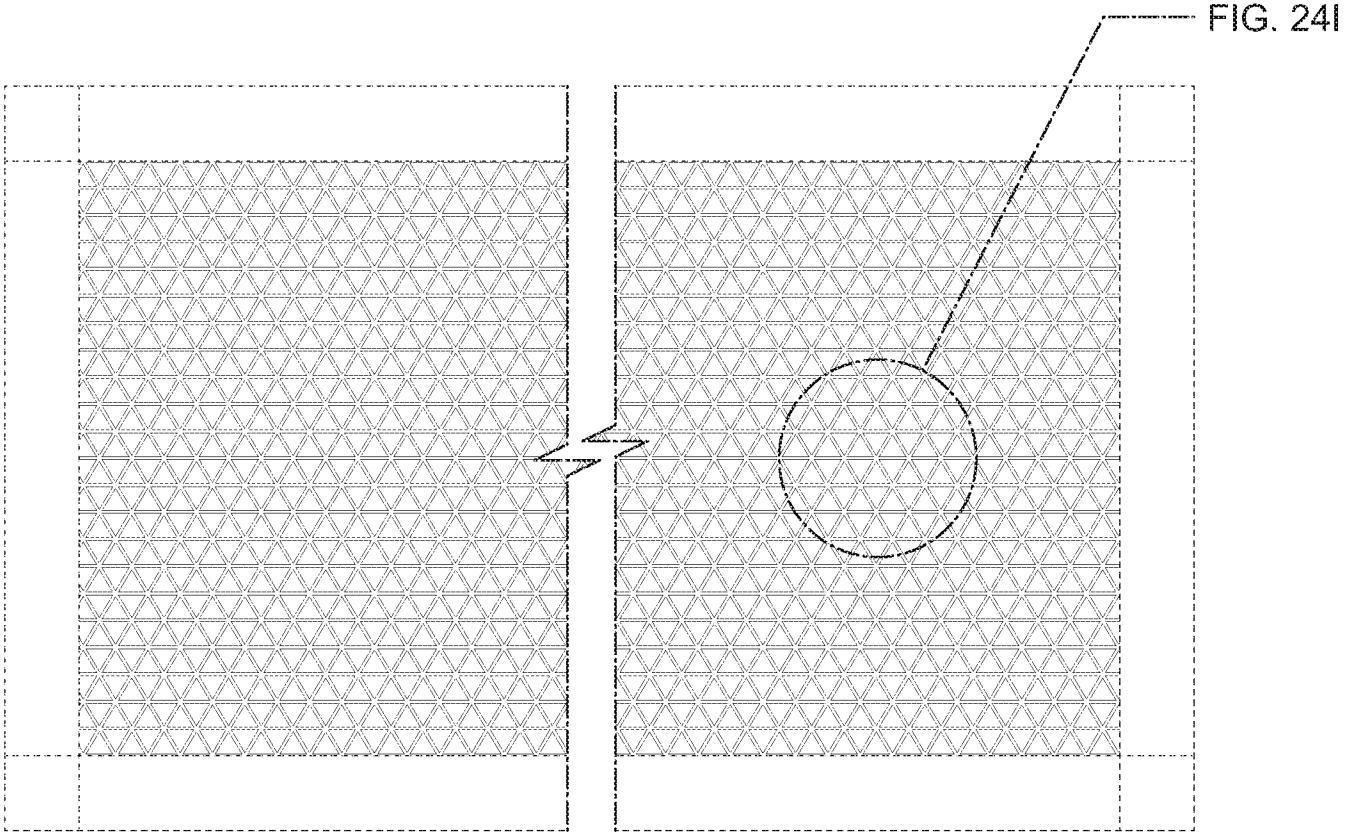
FIG. 24C is a front view of an illustration of the example body portion of the crib liner of FIG. 24A, according to one example embodiment of the present invention.
Figure 24D:
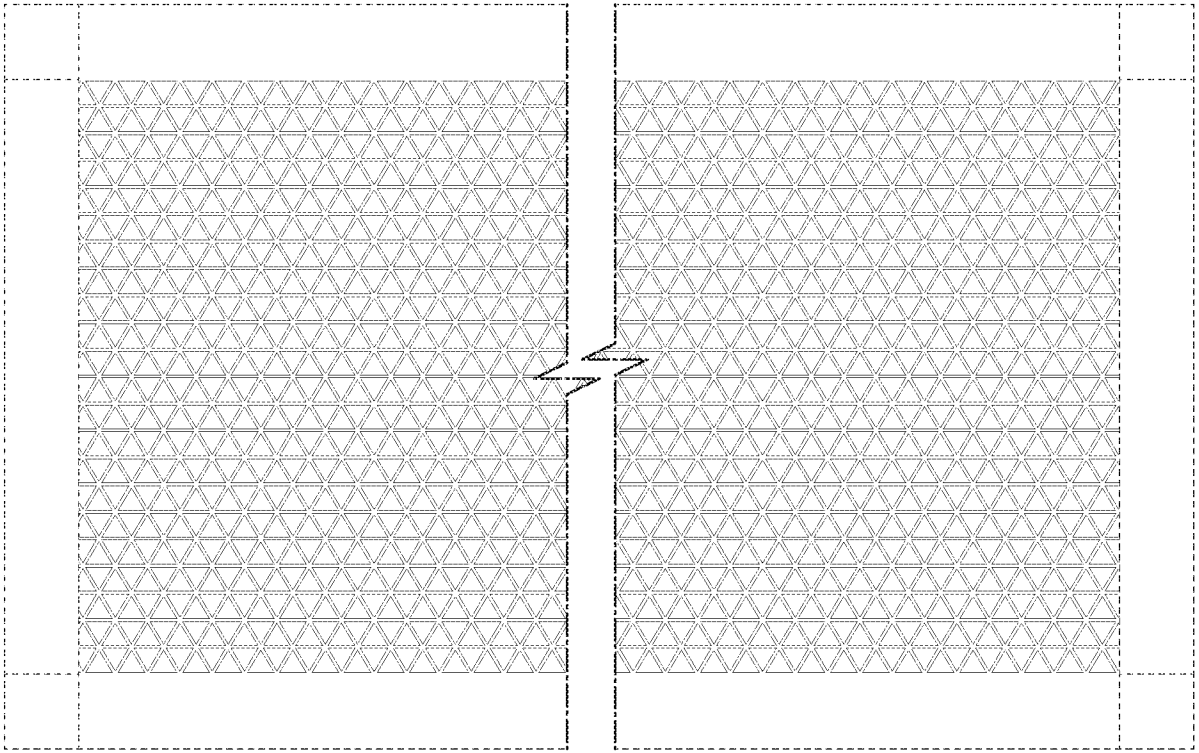
FIG. 24D is a back view of an illustration of an example body portion of the crib liner of FIG. 24A, according to one example embodiment of the present invention.
Figure 24I:
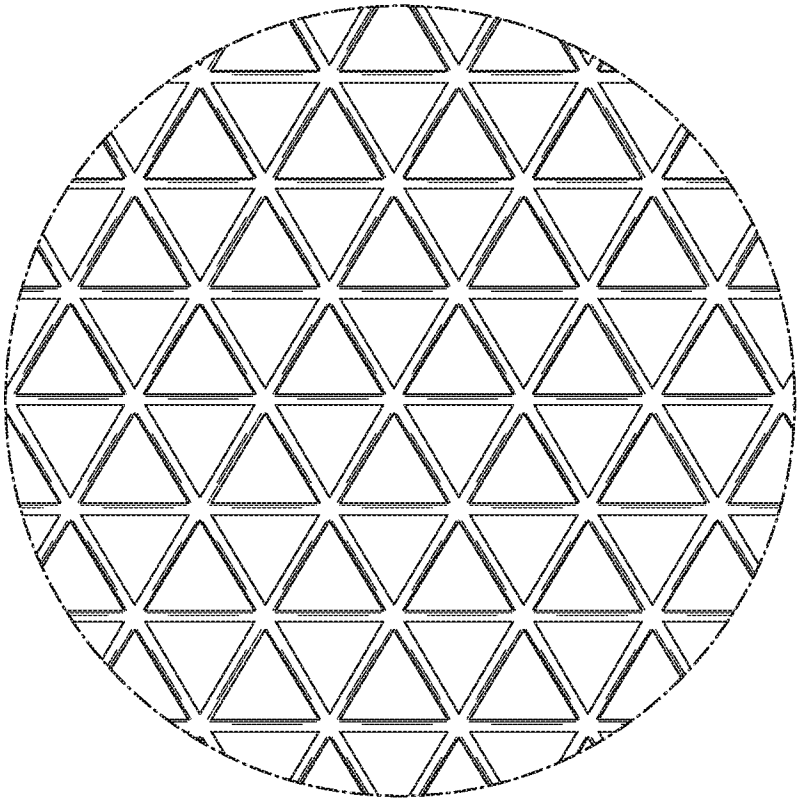
FIG. 24I is an exploded view of the body portion of the crib liner of FIG. 24A, according to one example embodiment of the present invention.
Figure 24J:
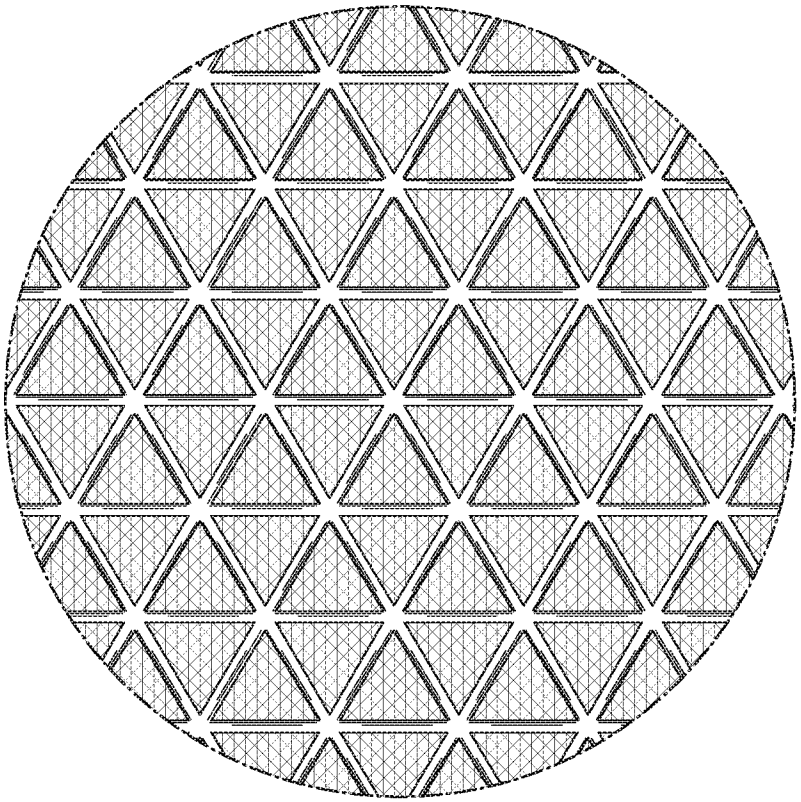
FIG. 24J is an alternative exploded view of the body portion of the crib liner of FIG. 24A, according to one example embodiment of the present invention.

In another alternative example embodiment, FIGS. 24A-24J illustrate a crib liner 2400 where the body portion 2446 has a mesh type material having a triangle appearance. FIG. 24J illustrates an alternative back layer having a different appearance than that of FIG. 24I.

Figure 25A:
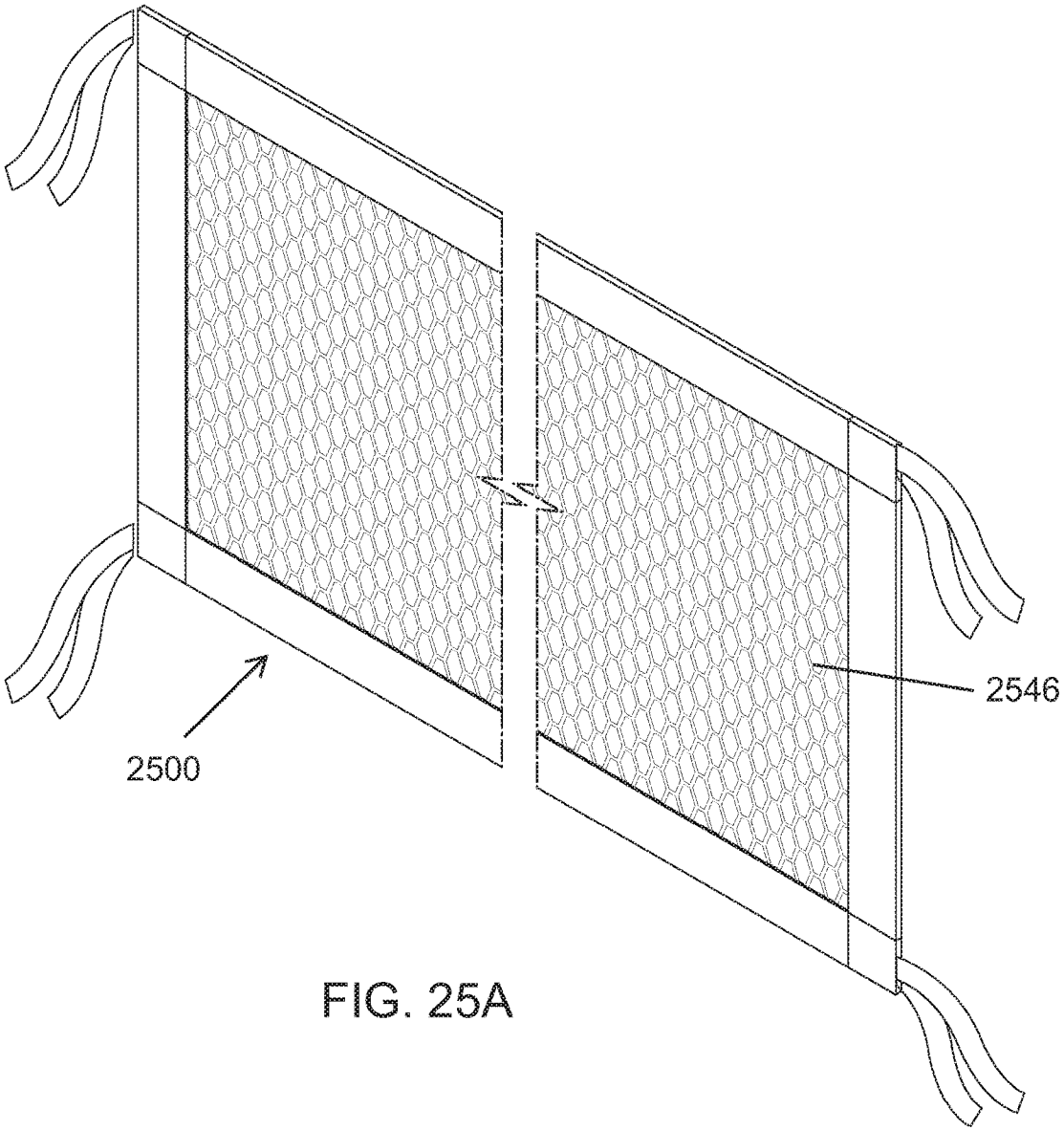
FIG. 25A is a perspective view of an illustration of one embodiment of a crib liner, according to one example embodiment of the present invention.
Figure 25B:
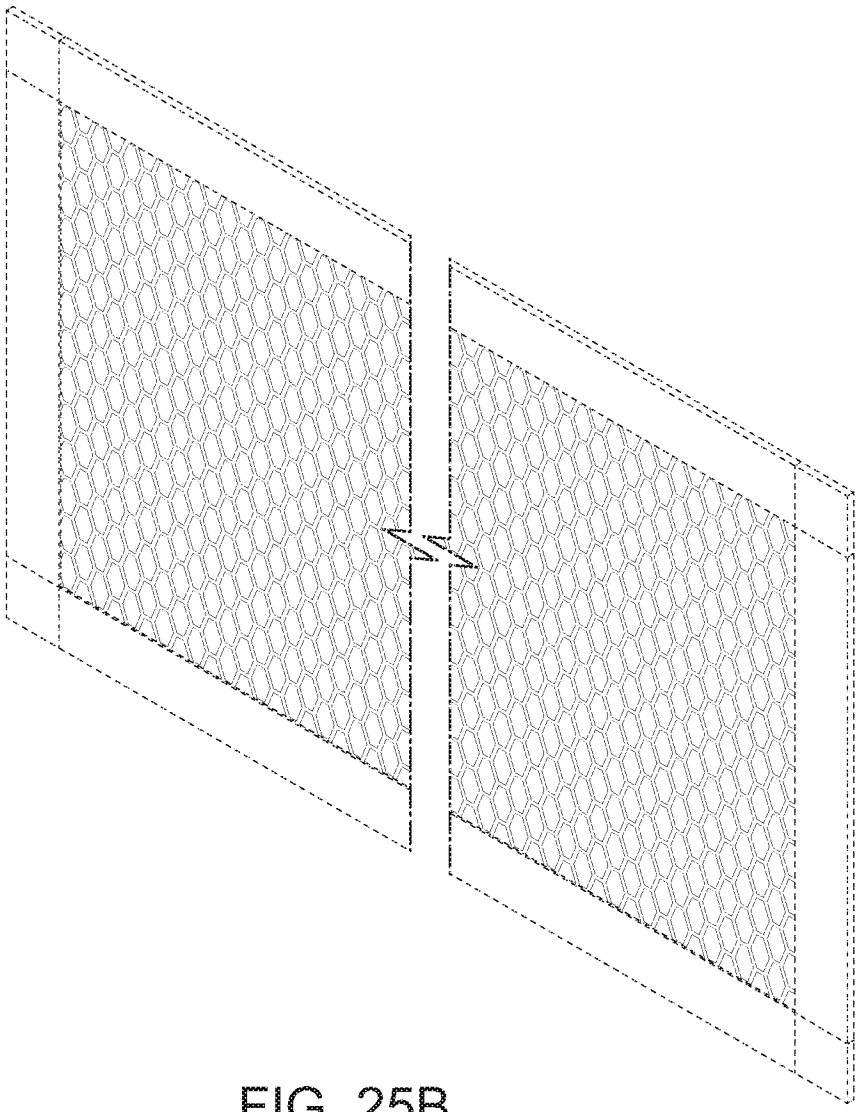
FIG. 25B is a perspective view of an illustration of an example body portion of the crib liner of FIG. 25A, according to one example embodiment of the present invention.
Figure 25C:
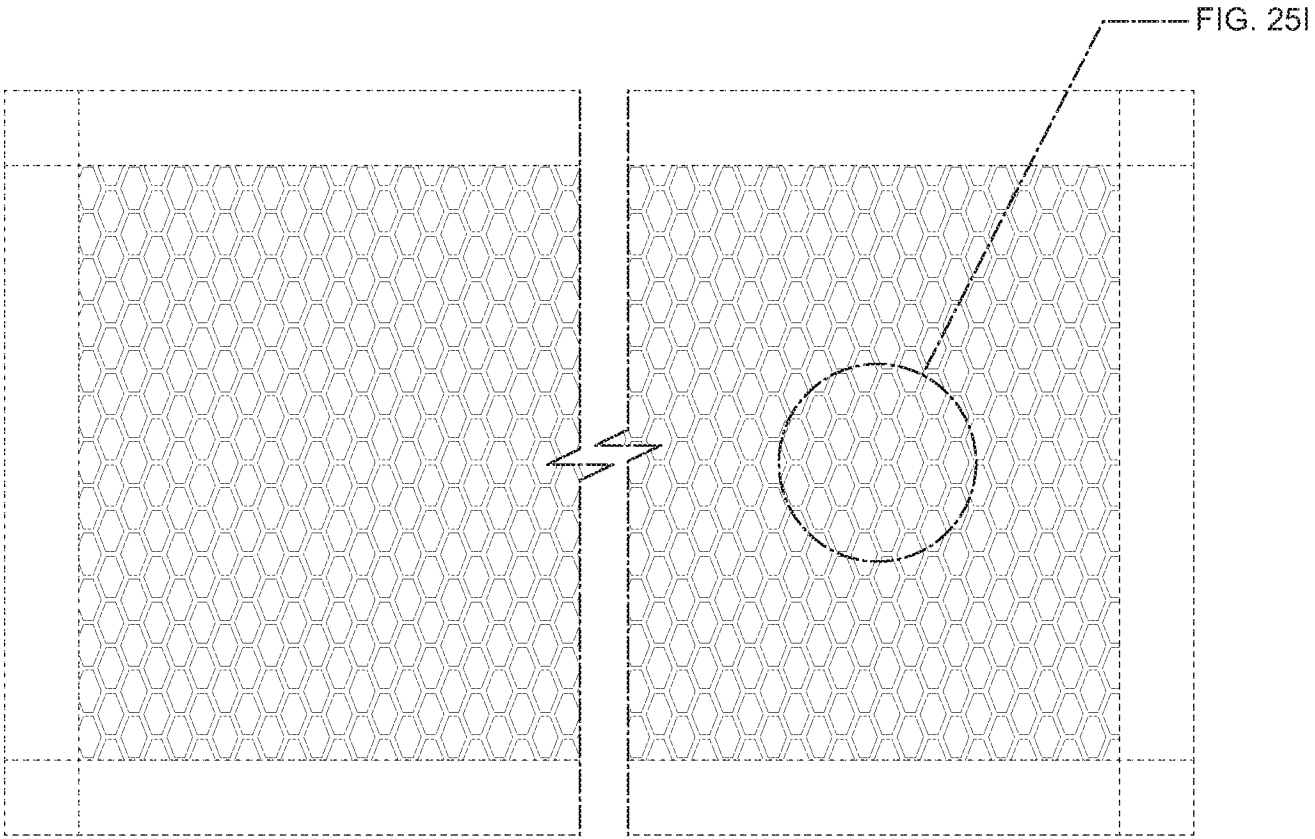
FIG. 25C is a front view of an illustration of the example body portion of the crib liner of FIG. 25A, according to one example embodiment of the present invention.
Figure 25D:
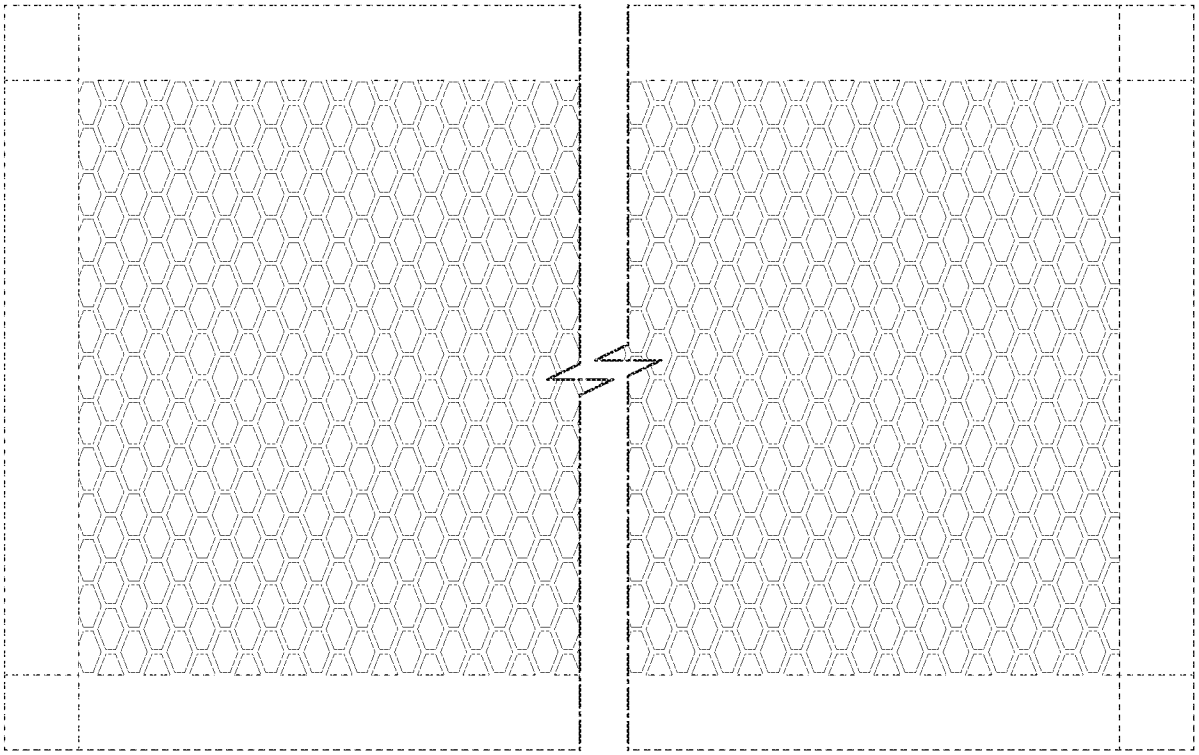
FIG. 25D is a back view of an illustration of an example body portion of the crib liner of FIG. 25A, according to one example embodiment of the present invention.
Figure 25I:
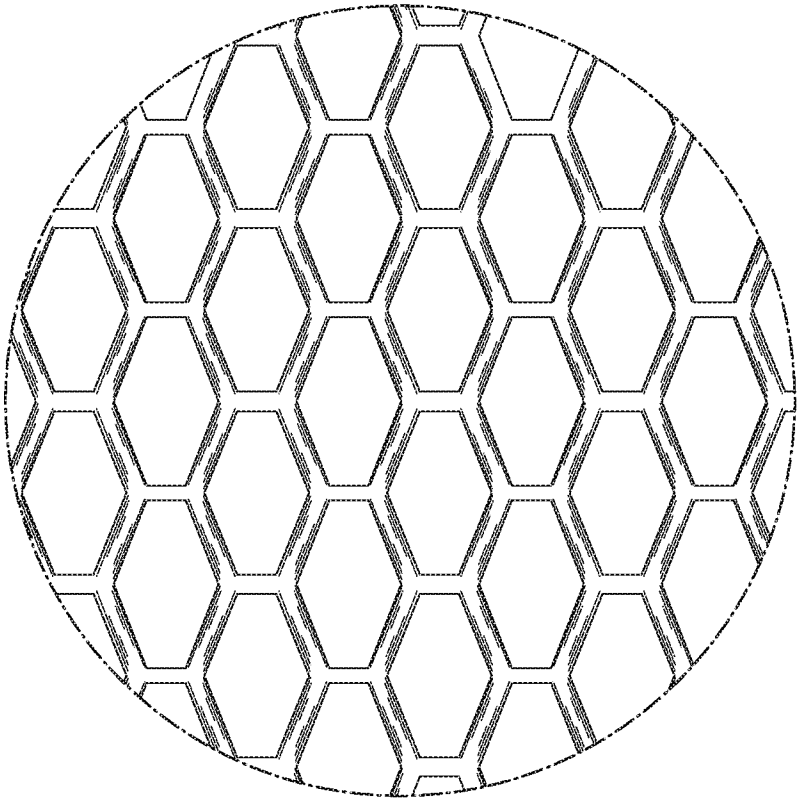
FIG. 25I is an exploded view of the body portion of the crib liner of FIG. 25A, according to one example embodiment of the present invention.
Figure 25J:
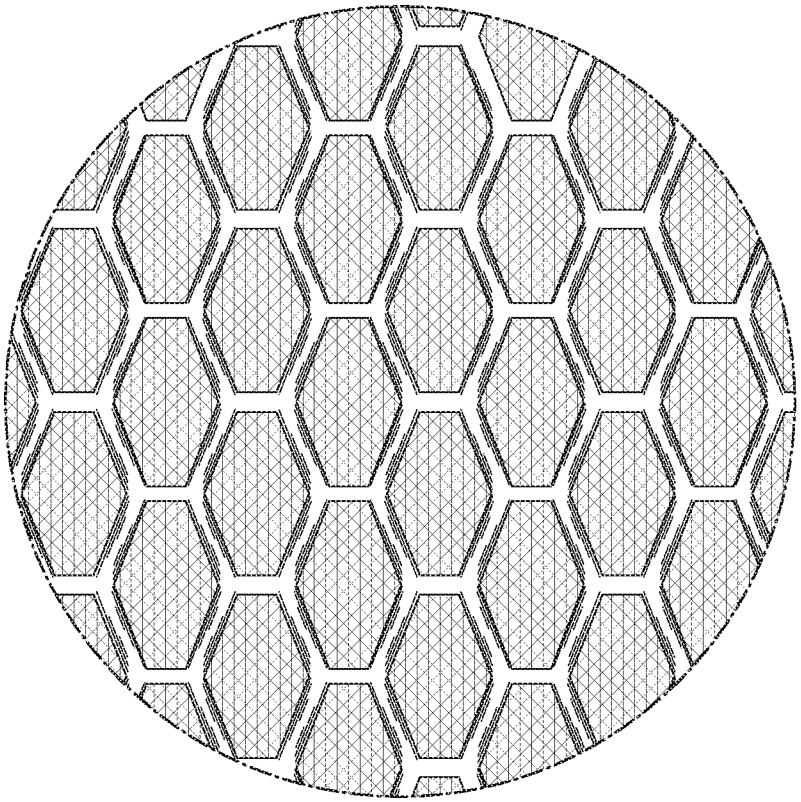
FIG. 25J is an alternative exploded view of the body portion of the crib liner of FIG. 25A, according to one example embodiment of the present invention.

In another alternative example embodiment, FIGS. 25A-25J illustrate a crib liner 2500 where the body portion 2546 has a mesh type material having a honeycomb appearance. FIG. 25J illustrates an alternative back layer having a different appearance than that of FIG. 25I.

Figure 26A:
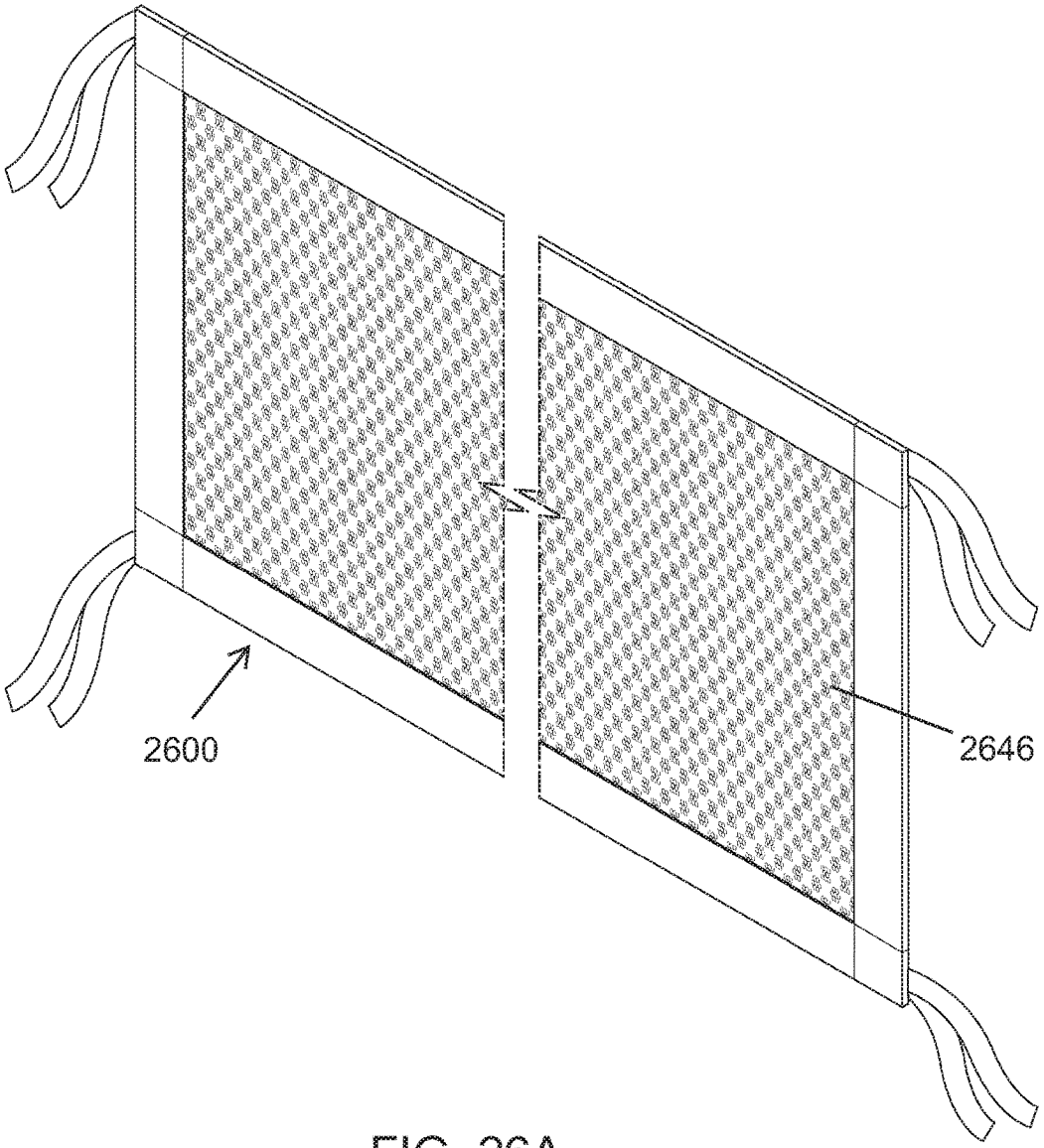
FIG. 26A is a perspective view of an illustration of one embodiment of a crib liner, according to one example embodiment of the present invention.
Figure 26B:
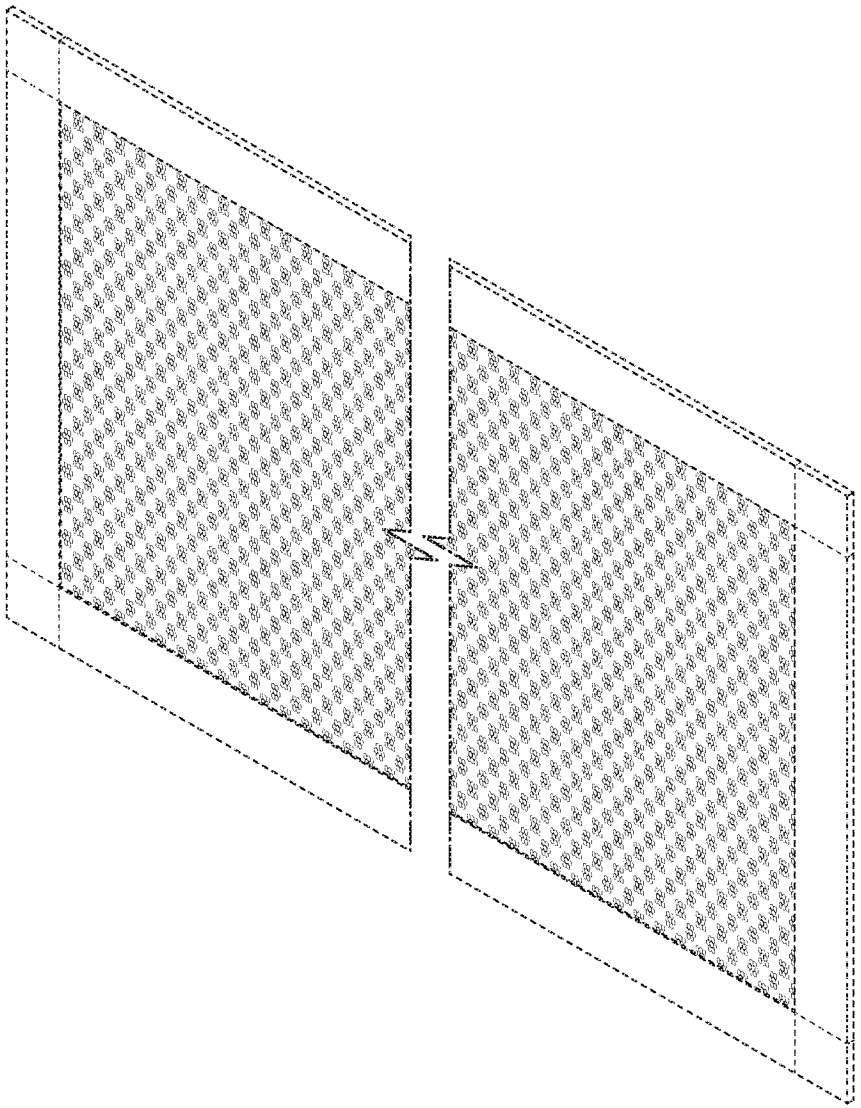
FIG. 26B is a perspective view of an illustration of an example body portion of the crib liner of FIG. 26A, according to one example embodiment of the present invention.
Figure 26C:
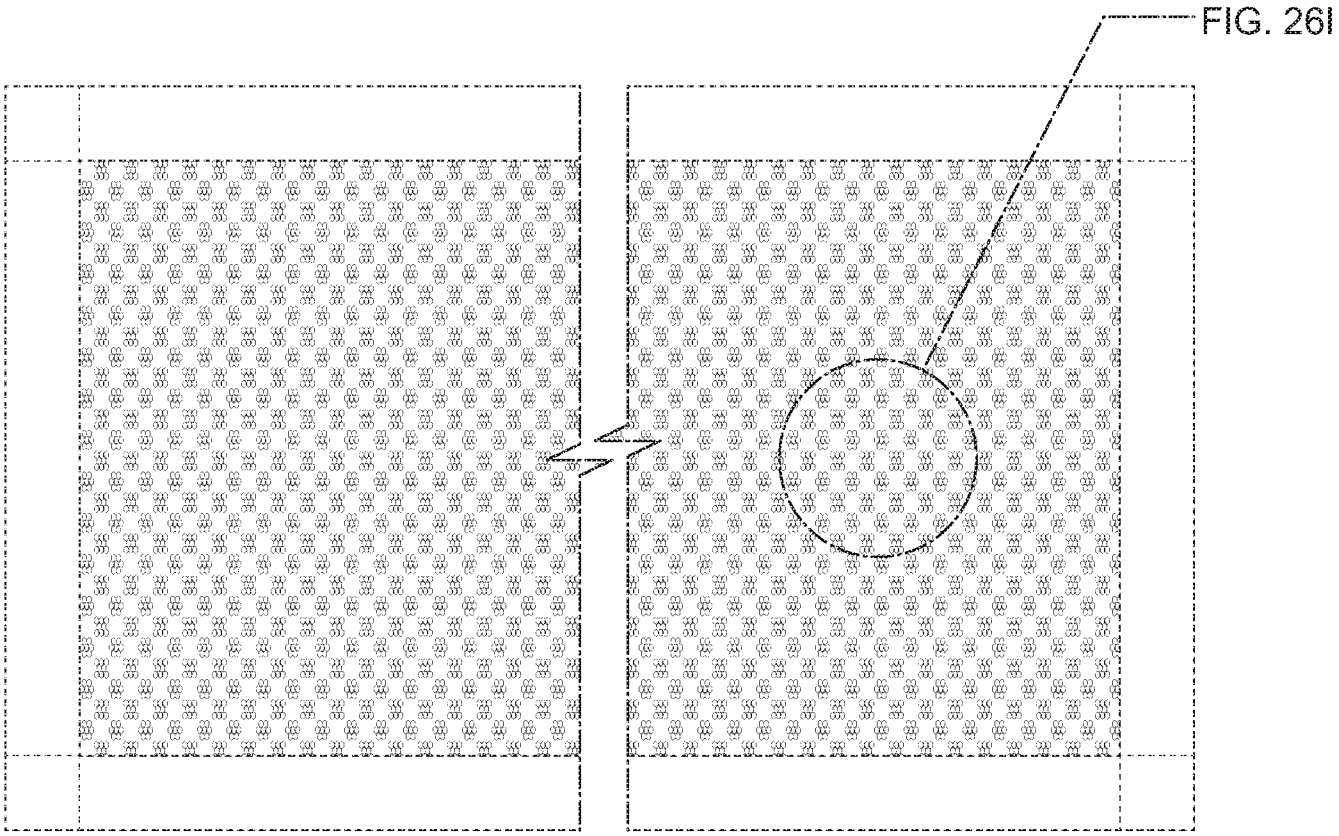
FIG. 26C is a front view of an illustration of the example body portion of the crib liner of FIG. 26A, according to one example embodiment of the present invention.
Figure 26D:
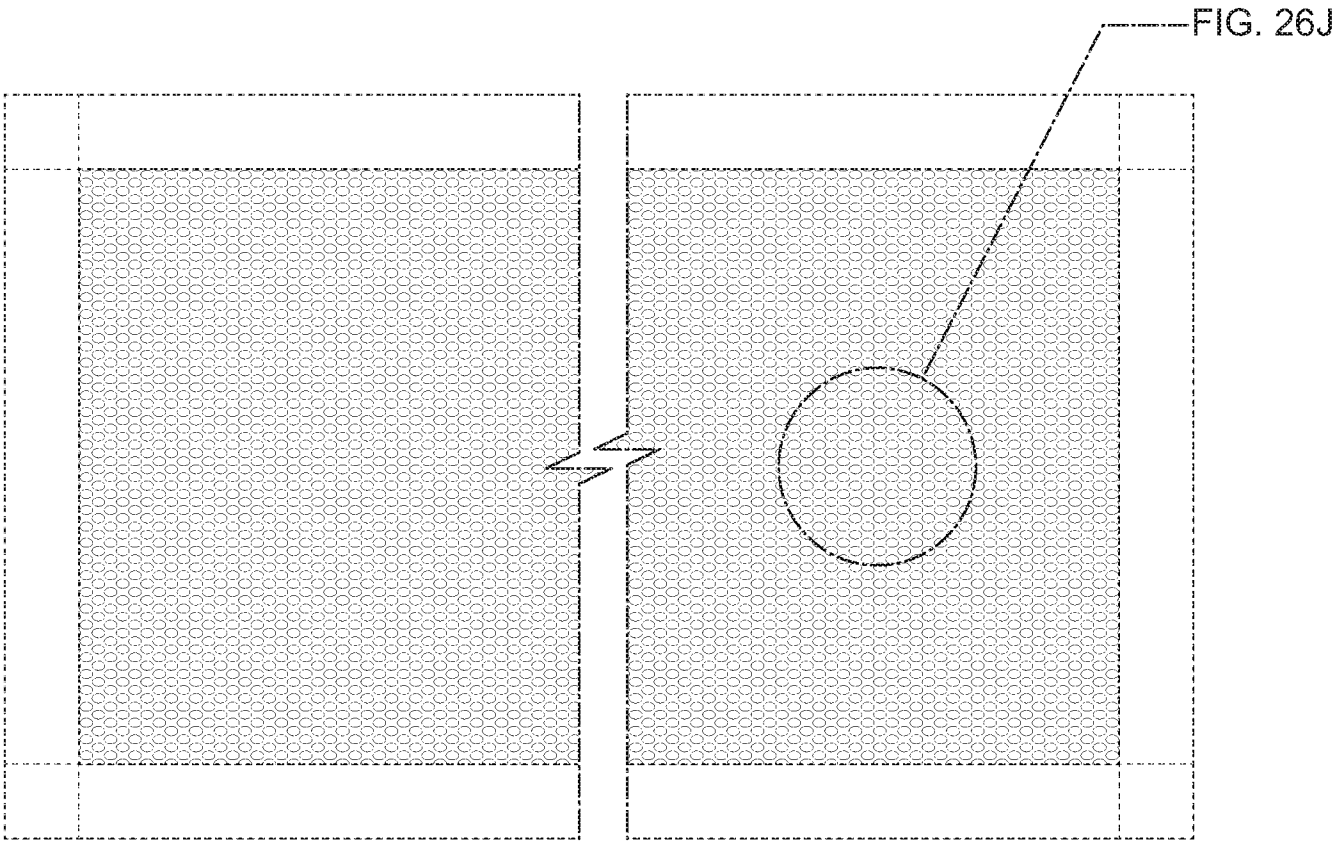
FIG. 26D is a back view of an illustration of an example body portion of the crib liner of FIG. 26A, according to one example embodiment of the present invention.
Figure 26I:
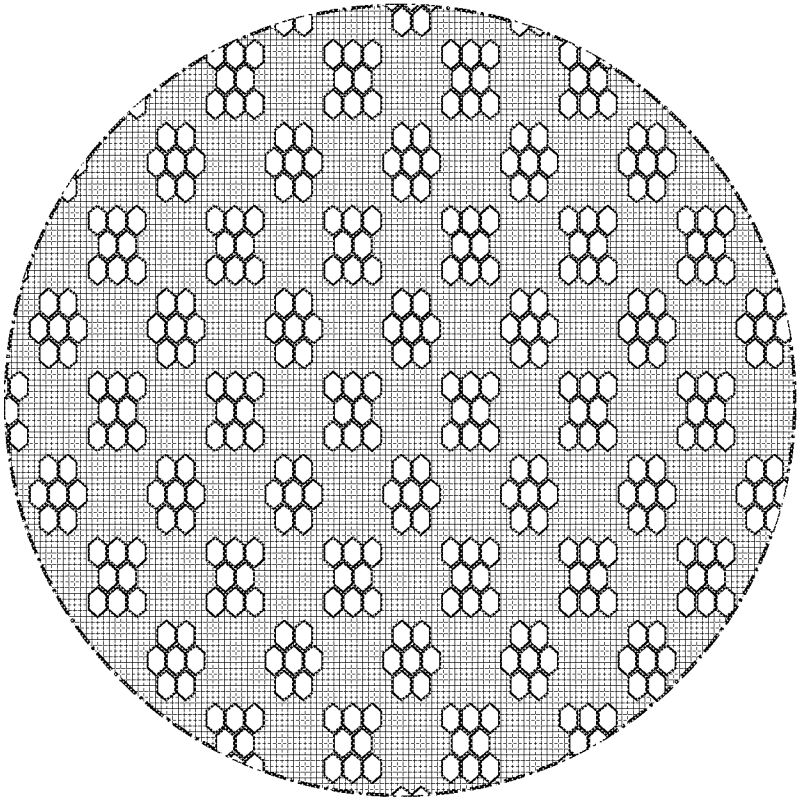
FIG. 26I is an exploded view of the body portion of the crib liner of FIG. 26A, according to one example embodiment of the present invention.
Figure 26J:
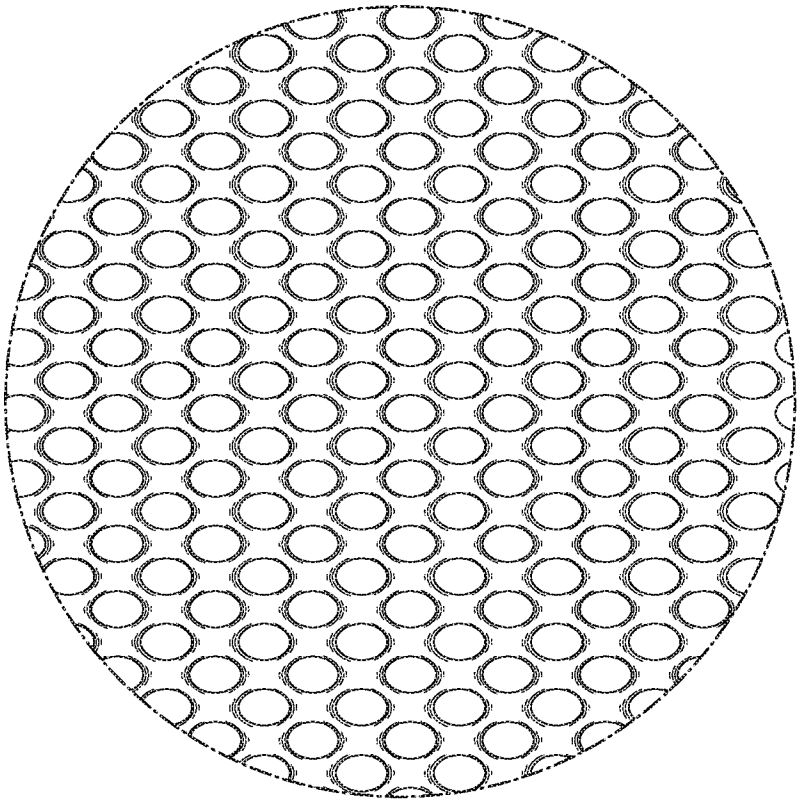
FIG. 26J is an exploded view of the body portion of the crib liner of FIG. 26D, according to one example embodiment of the present invention.
Figure 26K:
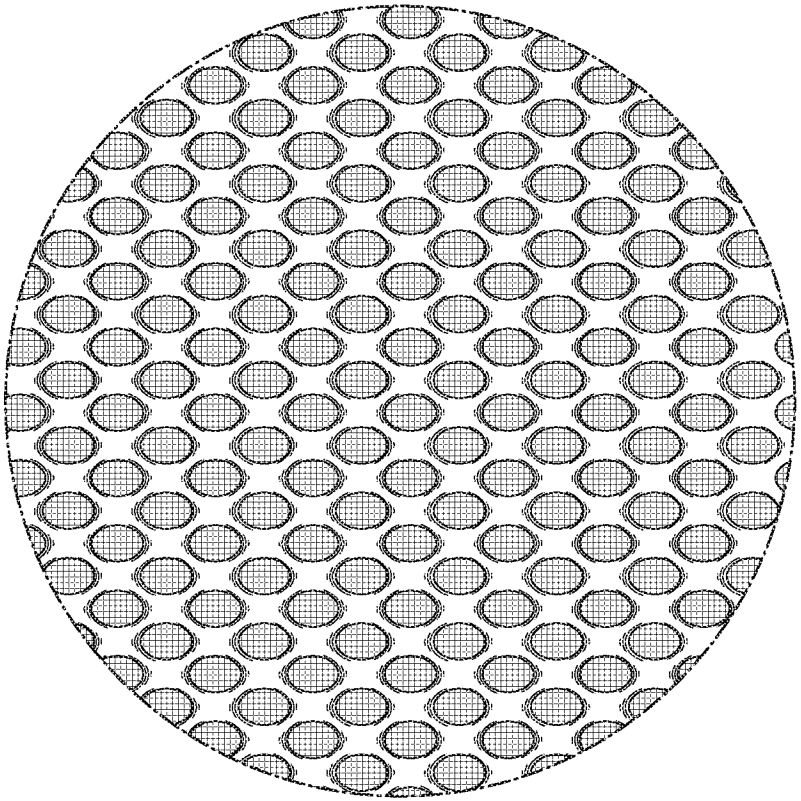
FIG. 26K is an alternative exploded view of the body portion of the crib liner of FIG. 26D, according to one example embodiment of the present invention.
Figure 27A:
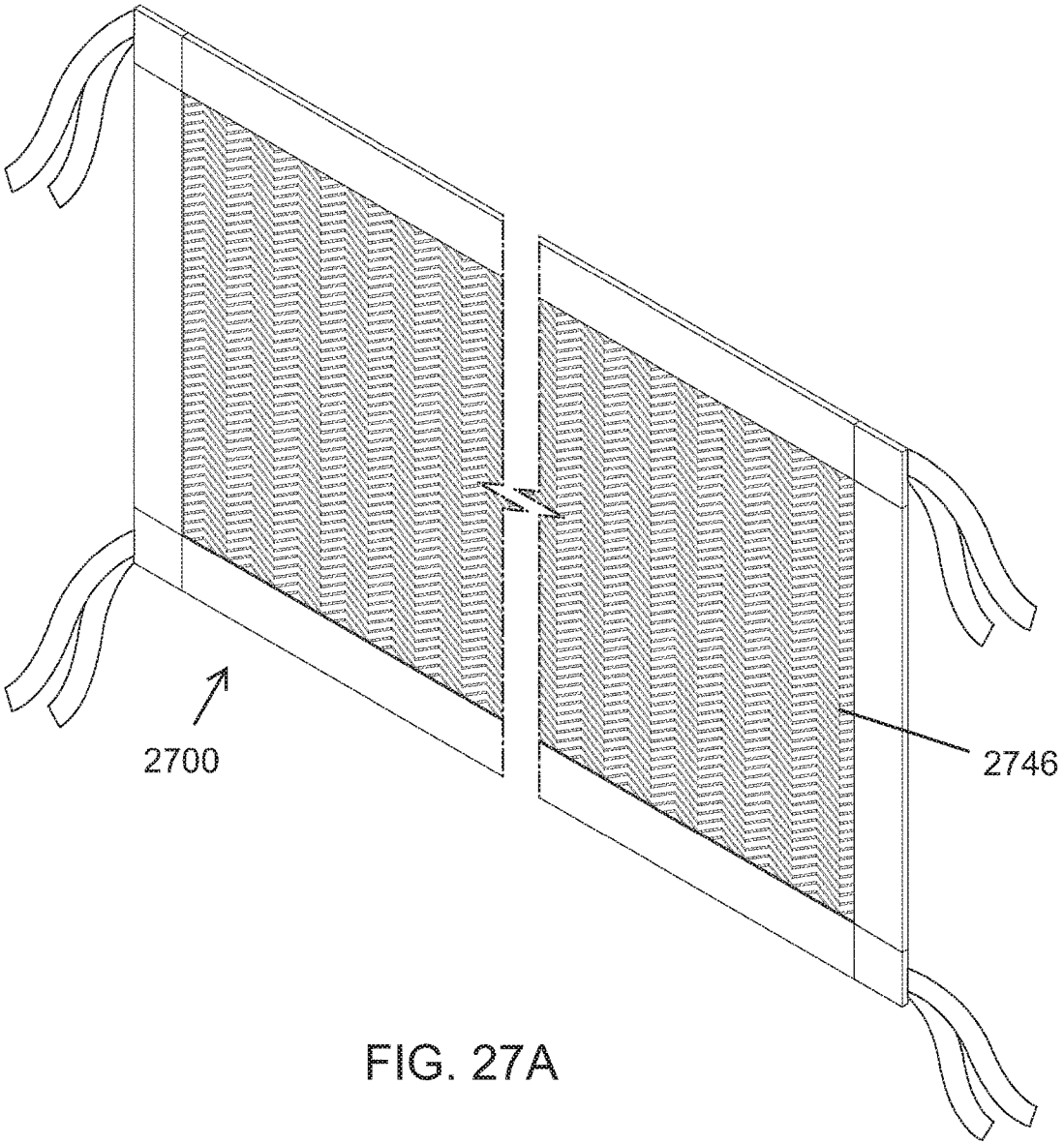
FIG. 27A is a perspective view of an illustration of one embodiment of a crib liner, according to one example embodiment of the present invention.
Figure 27B:
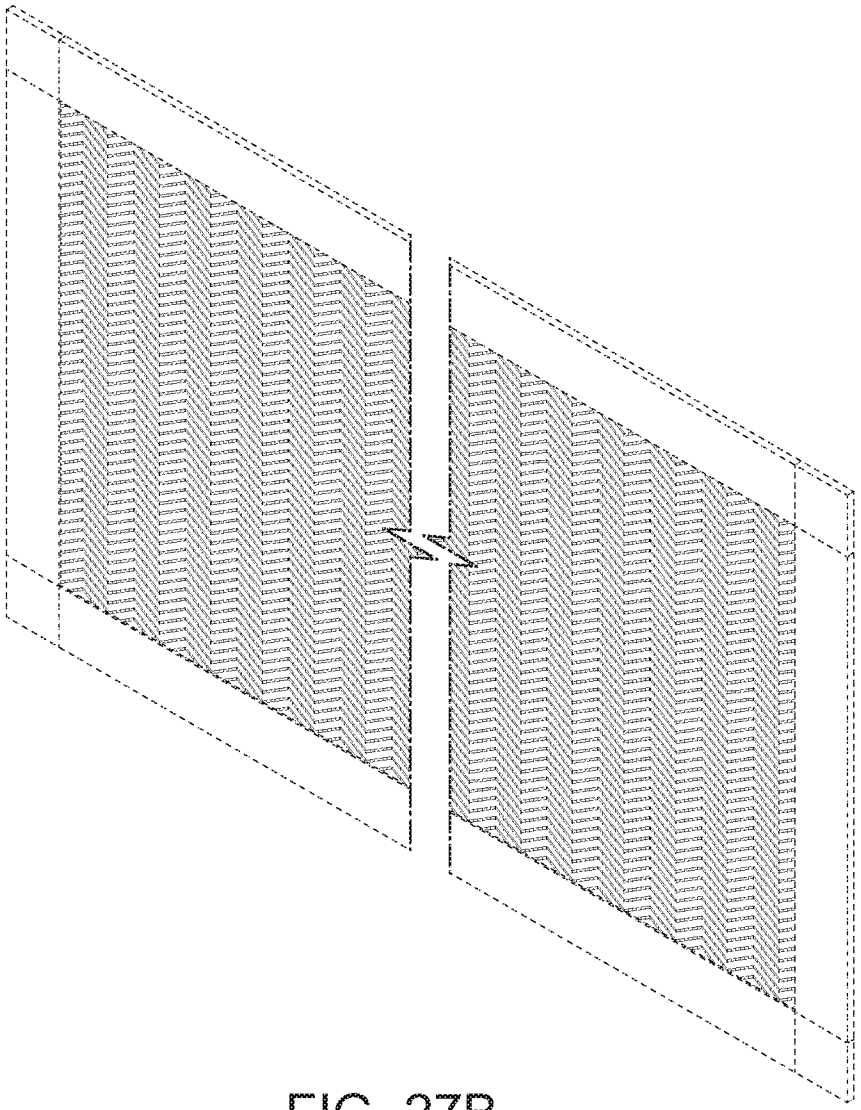
FIG. 27B is a perspective view of an illustration of an example body portion of the crib liner of FIG. 27A, according to one example embodiment of the present invention.
Figure 27C:
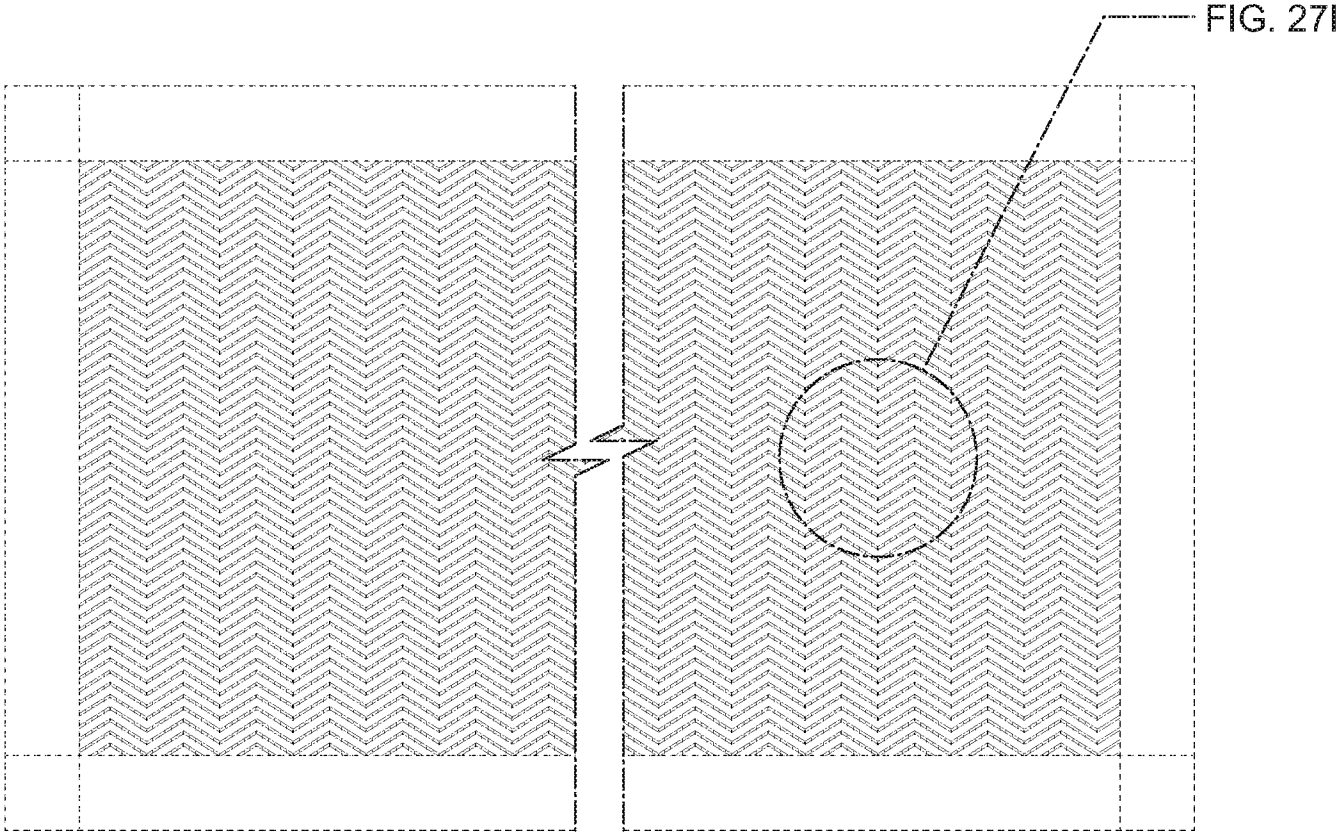
FIG. 27C is a front view of an illustration of the example body portion of the crib liner of FIG. 27A, according to one example embodiment of the present invention.
Figure 27D:
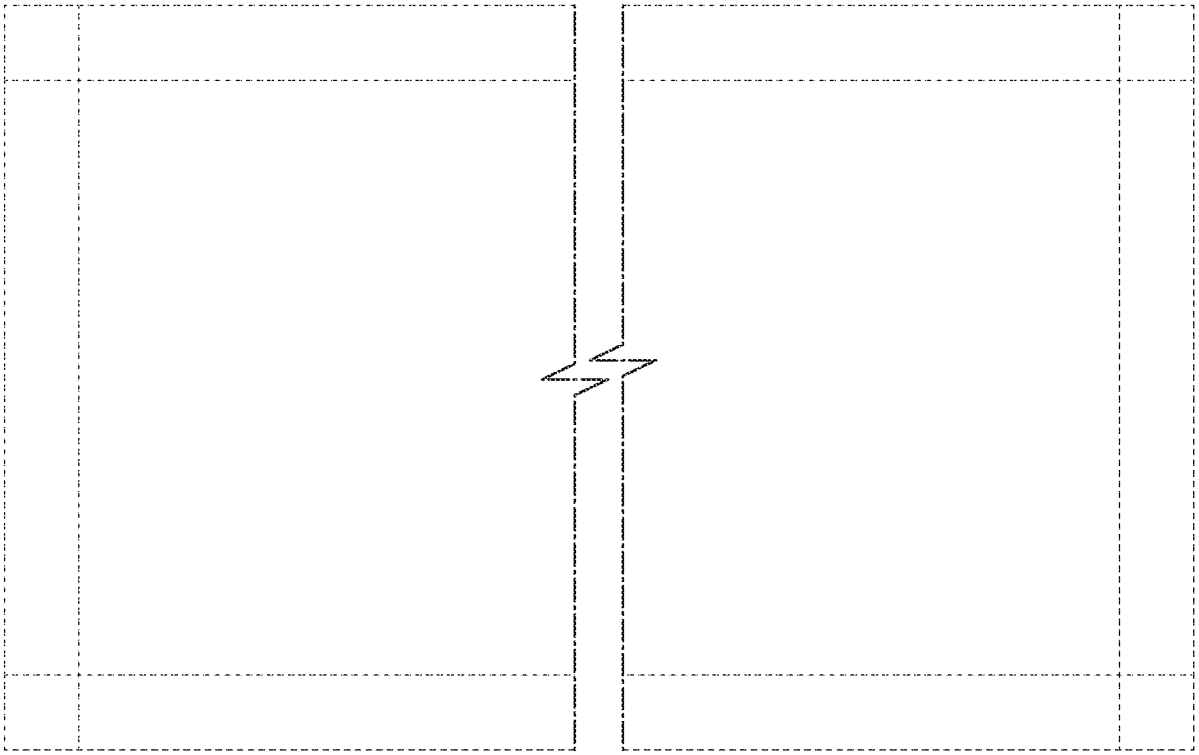
FIG. 27D is a back view of an illustration of an example body portion of the crib liner of FIG. 27A, according to one example embodiment of the present invention.
Figure 27I:
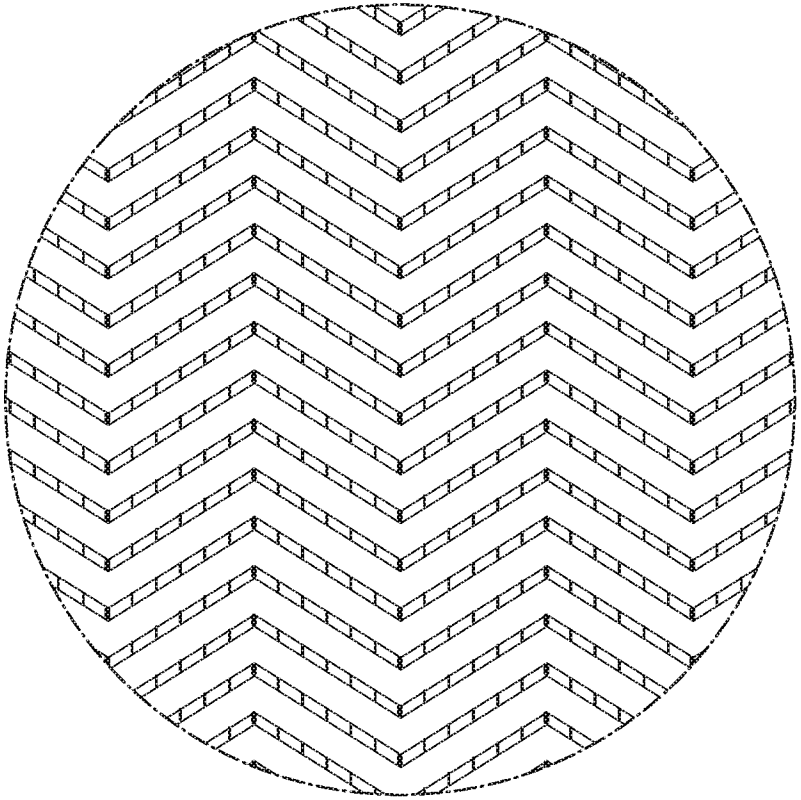
FIG. 27I is an exploded view of the body portion of the crib liner of FIG. 27A, according to one example embodiment of the present invention.

In another alternative example embodiment, FIGS. 26A-26K illustrate a crib liner 2600 where the body portion 2646 has a mesh type material having a microweave appearance. FIG. 26K illustrates an alternative back layer having a different appearance than that of FIG. 26J.

In yet another alternative embodiment, FIGS. 27A-27I illustrate a crib liner 2700 where the body portion 2746 has a mesh type material having a chevron appearance.

As is apparent from FIGS. 22A-27I, many different mesh appearances are possible.

In some exemplary embodiments, the panels are formed substantially of a breathable material (e.g., mesh-type material). However, in some configurations, the panels may be formed of less than substantially of a breathable material. For example, a majority of the area of a panel may be formed of a breathable material. In other configurations, less than a majority of a panel may be formed of a breathable material, such as some of the configurations discussed herein.

The panels formed of the mesh-type material may be used in combination with one or more layers of other material generally adjacent to the mesh-type material. For example, in one embodiment the body portion of the panels may be formed with strips of padded material attached to the mesh-type material on one side. The strips of padded material may be disposed such that when the panels are attached to a crib, the padded materials line up with the vertical support elements of the crib and offset the mesh-type material from the vertical support elements, thus providing additional padding. The padded material may be any suitable material, not just the aforementioned mesh-type material.

The breathable materials allow for air circulation. When a padded, soft breathable mesh material is utilized, further protection is provided to a child from bodily harm. When using one or more of the breathable mesh materials described herein, it is preferred that little rebreathing of carbon dioxide occur when a child's face is in direct contact with the material.

One skilled in the art will recognize that various types of padding may be used in addition to the breathable material in order to form one or more of the shapes of the objects previously described herein. Further, for example, such padding materials may be the breathable padded mesh material itself and/or other breathable materials, such as cotton, jersey, flannel, polyester, nylon, rayon, gabardine, terry cloth, etc.

The preceding described embodiments are illustrative of the practice of the invention. It is to be understood, therefore, that other expedients known to those skilled in the art or disclosed herein may be employed without departing from the invention or the scope of the appended claims. For example, various apparatus or steps of one embodiment described herein may be used with one or more other embodiments described herein to form various combinations of methods, systems, or apparatus contemplated by the present invention. As such, the present invention includes within its scope other methods, systems and apparatus for implementing and using the invention described herein.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A crib liner, suitable for use with a crib, wherein the crib has a perimeter, and wherein a plurality of spaced vertical support elements are provided along the perimeter, the crib liner comprising:

a first panel configured to cover a portion of the spaced vertical support elements, the first panel including:

first and second ends;

a single layer breathable body portion, a bottom finishing edge, and a top finishing edge, wherein each of the top finishing edge and the bottom finishing edge is less than 2 inches in height, wherein the breathable body portion includes a front substructure and a back substructure and the front substructure and the back substructure are integral to one another, and wherein the breathable body portion extends an entirety of an area between the bottom finishing edge and the top finishing edge, wherein the area is at least 4 inches in height;

a first fastening mechanism at the first end, wherein the first fastening mechanism attaches the first panel to the crib;

wherein the breathable body portion has an air permeability of between 385 CFM and 1530 CFM, a light permeability of between 47 and 99%, and a $CO_2$ rebreathing value of less than 20%.

2. The crib liner of claim 1, wherein the breathable body portion further comprises an intermediate substructure between the front substructure and the back substructure, wherein the intermediate substructure comprises fibers and the fibers are woven through the front substructure and the back sub structure.

3. The crib liner of claim 2, wherein the intermediate substructure is a pile substructure.

4. The crib liner of claim 1, wherein the breathable body portion comprises a padded spacer mesh.

5. The crib liner of claim 1, wherein the breathable body portion comprises a mesh-type material having a mesh coverage of between 32% and 91%.

6. The crib liner of claim 1, further comprising a second panel configured to cover a portion of the spaced vertical support elements, the second panel including:

first and second ends;

a single layer breathable body portion, a bottom finishing edge, and a top finishing edge, wherein each of the top finishing edge and the bottom finishing edge is less than 2 inches in height, wherein the breathable body portion includes a front substructure and a back substructure and the front substructure and the back substructure are integral to one another, and wherein the breathable body portion extends an entirety of an area between the bottom finishing edge and the top finishing edge, wherein the area is at least 4 inches in height;

a first fastening mechanism, wherein the first fastening mechanism attaches the second panel to the crib;

wherein the breathable body portion has an air permeability of between 385 CFM and 1530 CFM, a light permeability of between 47 and 99%, and a $CO_2$ rebreathing value of less than 20%.

7. The crib liner of claim 5, wherein the breathable body portion of the second panel comprises a mesh-type material having a mesh coverage of between 32% and 91%.

8. The crib liner of claim 6, wherein the second end of the first panel is removably coupleable to the second end of the second panel.

9. The crib liner of claim 6, wherein a length of the first panel is less than a length of the second panel.

10. The crib liner of claim 1, further comprising a second fastening mechanism at the second end, wherein the second fastening mechanism attaches the first panel to the crib.

11. The crib liner of claim 1, wherein the first panel further comprises side borders.

12. The crib liner of claim 1, wherein the first fastening mechanism comprises a first fastener and a second fastener.

13. The crib liner of claim 12, wherein the first fastener is a hook fastener and the second fastener is a loop fastener.

14. A crib liner, suitable for use with a crib, wherein the crib has a perimeter, and wherein a plurality of spaced vertical support elements are provided along the perimeter, the crib liner comprising:

a first panel configured to cover a portion of the spaced vertical support elements, the first panel including:

first and second ends;

a single layer breathable body portion, a bottom finishing edge, and a top finishing edge, wherein each of the top finishing edge and the bottom finishing edge is less than 2 inches in height, wherein the breathable body portion includes a front substructure and a back substructure and the front substructure and the back substructure are integral to one another, and wherein the breathable body portion extends an entirety of an area between the bottom finishing edge and the top finishing edge, wherein the area is at least 4 inches in height;

a first fastening mechanism at the first end, wherein the first fastening mechanism attaches the first panel to the crib;

a second panel configured to cover a portion of the spaced vertical support elements, the second panel including:

first and second ends;

a single layer breathable body portion, a bottom finishing edge, and a top finishing edge, wherein each of the top finishing edge and the bottom finishing edge is less than 2 inches in height, wherein the breathable body portion includes a front substructure and a back substructure and the front substructure and the back substructure are integral to one another, and wherein the breathable body portion extends an entirety of an area between the bottom finishing edge and the top finishing edge, wherein the area is at least 4 inches in height;

a first fastening mechanism at the first end, wherein the first fastening mechanism attaches the second panel to the crib;

wherein the second end of the first panel and the second end of the second panel are removably coupleable to one another; and wherein the breathable body portion of the first panel and the breathable body portion of the second panel each have an air permeability of between 385 CFM and 1530 CFM, a light permeability of between 47 and 99%, and a CO2 rebreathing value of less than 20%.

15. The crib liner of claim 14, wherein the breathable body portion of the first panel and the breathable body portion of the second panel each further comprise an intermediate substructure between the front substructure and the back substructure, wherein the intermediate substructure is woven through the front substructure and the back substructure.

16. A crib liner, suitable for use with a crib, wherein the crib has a perimeter, and wherein a plurality of spaced vertical support elements are provided along the perimeter, the crib liner comprising:

a first panel configured to cover a portion of the spaced vertical support elements, the first panel including:

first and second ends;

a single layer breathable body portion, a bottom finishing edge, and a top finishing edge, wherein each of the top finishing edge and the bottom finishing edge is less than 2 inches in height, wherein the breathable body portion includes a front substructure and a back substructure and the front substructure and the back substructure are integral to one another, and wherein the breathable body portion extends an entirety of an area between the bottom finishing edge and the top finishing edge, wherein the area is at least 4 inches in height;

a first fastening mechanism at the first end, wherein the first fastening mechanism attaches the first panel to the crib;

wherein the first panel comprises a breathable material having an air permeability of between 385 CFM and 1530 CFM, a light permeability of between 47 and 99%, and a $CO_2$ rebreathing value of less than 20%; and wherein the breathable material is a functional fabric.

17. The crib liner of claim 16, wherein the functional fabric at least partially blocks a hazard from penetrating the crib liner.

* * * * *